US006139400A

United States Patent [19]

Sato et al.

[11] Patent Number: 6,139,400

[45] Date of Patent: Oct. 31, 2000

[54] POLISHING SYSTEM AND METHOD WITH POLISHING PAD PRESSURE ADJUSTMENT

[75] Inventors: Shuzo Sato, Kanagawa; Hiizu Ohtorii; Yasuharu Ohkawa, both of Tokyo; Yutaka Ozawa, Ibaraki; Taiichi Kusano, Tokyo, all of Japan

[73] Assignee: Sony Corporation, Tokyo, Japan

[21] Appl. No.: 09/063,006

[22] Filed: Apr. 21, 1998

[30] Foreign Application Priority Data

| | | | |
|---|---|---|---|
| Apr. 22, 1997 | [JP] | Japan | 9-104648 |
| Apr. 25, 1997 | [JP] | Japan | 9-109346 |
| May 14, 1997 | [JP] | Japan | 9-124470 |
| Jun. 11, 1997 | [JP] | Japan | 9-153738 |

[51] Int. Cl.[7] ..... B24B 49/00

[52] U.S. Cl. ..... 451/10; 451/11; 451/57; 451/170; 451/274; 451/287

[58] Field of Search ..... 451/5, 8, 10, 11, 451/14, 16, 41, 59, 63, 170, 272, 273, 274, 285, 283, 287, 290, 57

[56] References Cited

U.S. PATENT DOCUMENTS

| | | | |
|---|---|---|---|
| 5,035,087 | 7/1991 | Nishiguchi et al. . | |
| 5,317,837 | 6/1994 | Stahli . | |
| 5,679,060 | 10/1997 | Leonard et al. | 451/43 |
| 5,679,212 | 10/1997 | Kato et al. . | |
| 5,816,895 | 10/1998 | Honda | 451/41 |
| 5,944,580 | 8/1999 | Kim et al. | 451/9 |

FOREIGN PATENT DOCUMENTS

| | | |
|---|---|---|
| 10-15810 | 1/1998 | Japan . |

*Primary Examiner*—Timothy V. Eley
*Attorney, Agent, or Firm*—Hill & Simpson

[57] ABSTRACT

Disclosed is a polishing system used for polishing a surface to be polished of an object to be polished by a polishing pad, which is capable of improving uniformity of the surface to be polished of the object to be polished by positively, accurately adjusting a polishing pressure, and a polishing method using the polishing system. Concretely, the surface to be polished of a wafer as the object to be polished is polished by relatively moving, along a plane, a polishing surface of the rotating polishing pad and the surface to be polished of the wafer in slide-contact with each other, and adjusting a pressing force applied from the polishing pad to the wafer in accordance with a polishing pressure previously set depending on a relative-positional relationship between the polishing surface of the polishing pad and the surface to be polished of the wafer.

25 Claims, 45 Drawing Sheets

LARGE

TILTING ANGLE

SMALL

POLISHING SYSTEM AND METHOD WITH POLISHING PAD PRESSURE ADJUSTMENT

BACKGROUND OF THE INVENTION

The present invention relates to a polishing system capable of improving uniformity of a surface of a flat object to be polished, for example, a semiconductor substrate such as a silicon wafer, a polishing method using the polishing system, a polishing pad provided on the polishing system, and a method of forming the polishing pad.

In a process of forming LSIs, planarization for films such as an interlayer insulating film is very important.

Various means for planarizing films have been proposed, and in recent years, attention has been given to a CMP (Chemical-Mechanical Polishing) process utilizing mirror-polishing for silicon wafers, and methods for planarizing films by making use of such a CMP process have been developed.

In a related art method for planarizing a wafer utilizing the CMP process, polishing is performed in a state in which a polishing pad is pressed on a surface of a wafer by a drive means such as an air cylinder.

In the related art method, however, since loss in the mechanical transmission of a drive means and non-uniformity of a pressing force have not been examined, there has arisen non-uniformity in an effective polishing pressure applied from a polishing pad to a wafer due to both loss in the mechanical transmission of a drive means and uniformity in the pressing force. Such non-uniformity in the polishing pressure has degraded uniformity of a polished surface of a wafer after polishing. In addition, uniformity of a surface of a wafer is defined based on a variation in a residual amount over the entire surface of the wafer.

On the other hand, an effective area of a polishing surface of a polishing pad varies depending on irregularities on a surface of a wafer, so that a projecting portion on the surface of the wafer is polished in a large amount and a recessed portion in the surface of the wafer is polished in a small amount. This degrades uniformity of the polished surface of the wafer.

Further, inhomogeneity of a polishing surface of a polishing pad, which is transferred on a surface of a wafer, is one factor for degrading uniformity of a polished surface of the wafer.

A distribution of a slurry as a polishing material supplied between a wafer and a polishing pad upon polishing differs depending on a position to which the slurry is supplied or differs between inner and outer peripheral sides of the polishing pad, and non-uniformity of the distribution of the slurry degrades uniformity of the wafer surface.

It is essentially difficult to remove irregularities on a wafer surface, inhomogeneity of a polishing surface of a polishing pad, and non-uniformity of a slurry.

Incidentally, in accordance with a PRESTON's equation, an amount removed by polishing is proportional to a polishing pressure, a relative velocity between a polishing pad and an object to be polished, and a working time.

Accordingly, it may be considered that even if there exist irregularities on a wafer surface, inhomogeneity of a polishing surface of a polishing pad, and non-uniformity of a slurry, it is possible to improve uniformity of a wafer surface by positively adjusting a polishing pressure during polishing.

The present invention is intended to provide a polishing system for polishing a surface to be polished of an object to be polished by a polishing pad, which is capable of positively adjusting a polishing pressure, and improving uniformity of the surface to be polished of the object to be polished even if there exist factors degrading uniformity of the polished surface of the object to be polished, and a polishing method using the polishing system.

Further, the related art method of planarizing a wafer utilizing the CPM process is based on a lapping technique. In such a method, an area of a polishing pad is larger than that of a wafer and the polishing pad is applied on the entire surface of the wafer at a time, and also the polishing pad is rotated at a low velocity. This configuration causes problems in terms of accuracy, such as flatness of a wafer surface, uniformity in the polished amount within a wafer surface, and instability of the polishing rate expressed by a polished amount per unit time, and also causes a problem in terms of low throughput.

Specifically, when a polishing pad is applied to the entire surface of a wafer at a time, a high-level region on the wafer surface is polished in a large amount and a low-level region is polished in a small amount. Also, since a peripheral velocity of a polishing pad differs between inner and outer peripheral sides, a polished amount becomes smaller on the inner peripheral side and becomes larger on the outer peripheral side. Further, an amount of a slurry as a polishing material supplied between a polishing pad and a wafer upon polishing differs between inner and outer peripheral sides of the polishing pad.

Accordingly, when there exist non-uniformity in the polished amount and instability of the polishing rate within a wafer surface due to the above causes, it is difficult to perform accurate polishing by numerical control of the polishing system.

Meanwhile, if a size of a polishing pad is made small relative to a wafer size, a slide-contact distance between a wafer and the polishing pad per unit polishing pad area becomes larger, leading to severe wear of the polishing pad. This frequently requires exchange of the polishing pad. Further, there arises an inconvenience that a polishing pad is liable to be clogged.

Incidentally, to make finer an interconnection pattern and the like, it is required to enhance an accuracy of the exposure for preparation of the interconnection pattern and the like. This requires a technique of further enhancing the flatness of a polished surface of a semiconductor wafer. Even in the case of increasing a diameter of a semiconductor wafer, it is similarly required to further enhance the flatness of a polished surface of a semiconductor wafer.

As a result of examining polishing in view of the foregoing, it becomes apparent that any polishing method using the related art polishing system cannot ensure a highly accurate flatness required for a fabrication process after the 0.25 $\mu$m's generation.

SUMMARY OF THE INVENTION

An object of the present invention is to provide a polishing system for polishing a surface to be polished of an object to be polished by a polishing pad, which is capable of positively adjusting a polishing pressure, and improving uniformity of the surface to be polished of the object to be polished even if there exist factors degrading uniformity of the polished surface of the object to be polished, and a polishing method using the polishing system.

According to the present invention, there is provided a polishing system including: a holding means for holding an object to be polished; a polishing pad having a polishing surface for polishing a surface to be polished of the object to be polished; a rotating means for rotatably holding the polishing pad, relatively pressing the polishing surface of the polishing pad on the surface to be polished of the object to be polished, and rotating the polishing pad; a moving means for relatively moving, along a plane, the surface to be polished of the object to be polished and the polishing surface of the polishing pad in sliding-contact with each other; a pressing force detecting means for detecting a relative pressing force applied from the polishing surface of the polishing pad to the surface to be polished of the object to be polished by the rotating means; and a pressure control means for outputting a control signal to the rotating means on the basis of a detection signal supplied from the pressing force detecting means in such a manner that a polishing pressure generated at the object to be polished becomes a specific value.

According to the above polishing system, since a polishing pressure is controlled at a specific value by the pressure control means, it is possible to improve uniformity of a surface to be polished of an object to be polished due to a variation in the polishing pressure.

In the above polishing system, preferably, the rotating means includes: a main shaft for rotatably holding the polishing pad facing to the object to be polished; a main spindle for rotating the main shaft; a slider for holding the main spindle; a guide for holding the slider movably in the direction of an axial line of the main shaft; a sub-slider provided movably along the direction of the axial line of the main shaft; a driving means for moving the sub-slider along the direction of the main shaft; and a connecting member for connecting the slider to the sub-slider.

The above pressing force detecting means preferably detects a force applied to the connecting member in the direction of the axial line of the main shaft from the sub-slider to the slider.

Preferably, the axial line of the main shaft, the guide, and operating points of the connecting member to the slider are positioned within a plane perpendicular to the surface to be polished of the object to be polished.

According to the present invention, there is provided a method of polishing a surface to be polished of an object to be polished by relatively moving, along a plane, a polishing surface of a rotating polishing pad and the surface to be polished of the object to be polished in slide-contact with each other, the method including the step of: adjusting a pressing force applied from the polishing pad to the object to be polished in accordance with a polishing pressure previously set on the basis of a relative-positional relationship between the polishing surface of the polishing pad and the surface to be polished of the object to be polished, thereby polishing the surface to be polished of the object to be polished.

According to the present invention, there is provided a polishing system including: a holding means for holding an object to be polished; a polishing pad having a polishing surface for polishing a surface to be polished of the object to be polished; a rotating means for rotatably holding the polishing pad, tilting a rotational axis of the polishing pad at a specific angle relative to a surface, of the object to be polished, held by the holding means, and bringing the polishing surface of the polishing pad in slide-contact with the surface to be polished of the object to be polished and simultaneously rotating the polishing pad; and a moving means for relatively rotating, along a plane, the surface to be polished of the object to be polished and the polishing surface of the polishing pad in slide-contact with each other.

According to the above polishing system of the present invention, the polishing surface of the polishing pad is rotated in a state being tilted with respect to the surface to be polished of the object to be polished. As a result, the surface to be polished is polished in a state in which a narrow portion on the polishing surface of the polishing pad is brought in slide-contact with the surface to be polished of the object to be polished.

Further, the slide-contact portion between the surface to be polished of the rotating object to be polished and the polishing surface of the polishing pad is moved by the moving means, to thereby polish the entire surface to be polished. The polishing pad used in the present invention is represented by a polishing tool made from a porous viscoelastic material such as urethane foam or a polishing cloth such as nonwoven fabric, or a polishing tool such as a polishing stone, a polishing wheel or laminated film having fixed abrasive grains.

According to the present invention, there is provided a polishing method for rotating a polishing pad having a polishing surface facing to a surface to be polished of an object to be polished and polishing the surface to be polished of the object to be polished by means of the polishing surface of the polishing pad, the method including the steps of: tilting a rotational axis of the polishing pad a specific angle with respect to an axis perpendicular to the surface to be polished of the object to be polished; and bringing the polishing surface of the polishing pad in slide-contact with the surface to be polished of the object to be polished, rotating the object to be polished, and moving the slide-contact position between the surface to be polished and the polishing surface of the polishing pad, thereby polishing the surface to be polished.

According to the above polishing method of the present invention, a slide-contact area between the polishing surface of the polishing pad and the surface to be polished is narrowed, to stabilize a polished amount and a polishing rate within the surface to be polished.

According to the present invention, there is provided a polishing pad including: a polishing surface, brought into slide-contact with a surface to be polished of an object to be polished, for polishing the surface to be polished; wherein the polishing surface is tilted at a specific angle with respect to a plane perpendicular to a rotational axis of the polishing pad.

According to the polishing pad of the present invention, since the polishing surface is tilted with respect to a plane perpendicular to a rotational axis of the polishing pad, a narrow portion on the tilted polishing surface is brought into slide-contact with the surface to be polished of the object to be polished by holding and rotating the polishing pad with the rotational axis thereof tilted.

According to the present invention, there is provided a method of forming a polishing pad, including the steps of: rotating the polishing pad in such a state in which a rotational axis of the polishing pad is tilted at a specific angle with respect to an axis perpendicular to a holding surface for holding an object to be polished by the polishing pad; and bringing the polishing pad in contact with a facing tool which is provided on the holding surface at a specific position for finishing a polishing surface of the polishing pad, and relatively moving the polishing pad in the direction along the holding surface, thereby forming a tilted polishing surface of the polishing pad.

According to the method of forming a polishing pad of the present invention, a tilted positional relationship between the holding surface for holding the object to be polished and the rotational axis of the polishing pad is easily, accurately transferred on the polishing surface of the polishing pad.

According to the present invention, there is provided a polishing method including the steps of: forming a region to be polished at which a polishing surface of a polishing member is in contact with a surface to be processed of an object to be processed; displacing, at the region to be polished, each portion of the polishing surface relative to the surface to be processed at a specific reference velocity or more; and displacing, at the surface to be processed, the region to be polished at the reference velocity or less on the surface to be processed.

In the above polishing method, preferably, the reference velocity corresponds to a basic resonance frequency of a mechanical transmission function between the polishing member and the object to be processed; each portion of the polishing surface is displaced relative to the surface to processed at the reference velocity or more by setting a displacement velocity of the polishing surface such that a frequency of a force given from a projecting portion or a recessed portion of the surface to be processed to the polishing surface becomes the resonance frequency or more; and the region to be polished is displaced at the reference velocity or less by setting a displacement velocity such that a frequency of a pressing force given from a waviness of the surface to be processed to the polishing surface becomes the resonance frequency or less.

According to the present invention, there is provided a polishing member partially pressed on a surface to be processed of a rotating object to be processed in a state being rotated by a specific rotational shaft to thereby polish the surface to be processed, the polishing member has a hardness set such that a basic resonance frequency of a mechanical transmission function between the polishing member and the object to be processed becomes 10 times or more a rotational frequency of the object to be processed.

In the region to be polished, fine projecting portion can be effectively polished by displacing, at the region to be polished, each portion on the polishing surface relative to the surface to be processed at the specific reference velocity or more. Further, by displacing the region to be polished on the surface to be processed, polishing can be entirely performed along a waviness on the surface to be processed, to polish fine irregularities, thus flattening the surface to be processed.

More specifically, by displacing each portion on the polishing surface by means of setting a displacement velocity on the polishing surface such that a frequency of a pressing force given from a projecting portion or a recessed portion to the polishing surface becomes the resonance frequency or more, each portion on the polishing surface is displaced relative to the projecting portion or recessed portion with a phase difference of about 180°. In other words, a projecting portion is pressed in the direction reversed to the displacement direction of the pressing force generated from the projecting portion, to be thus positively polished. Further, by displacing a region to be polished at a reference velocity or less by means of setting a displacement velocity such that a frequency of a pressing force given from a waviness on the surface to be processed to the polishing surface becomes the resonance frequency or less, the polishing member is elastically deformed in accordance with the waviness, to thus form the surface to be polished substantially in accordance with the waviness.

Similarly, in a polishing member partially pressed on a surface to be processed of a rotating object to be processed in a state being rotated by a specific rotational shaft to thereby polish the surface to be processed, since the polishing member has a hardness set such that a basic resonance frequency of a mechanical transmission function between the polishing member and the object to be processed becomes 10 times or more a rotational frequency of the object to be processed, the object to be processed can be polished with fine irregularities sufficiently flattened at a practical polishing rate.

BRIEF DESCRIPTION OF THE DRAWINGS

FIGS. 2A to 2C are schematic configuration views showing a rotating mechanism section for rotating a polishing pad of the polishing system shown in FIG. 1 and a moving/holding mechanism for moving/holding a wafer, wherein FIG. 2A is a top view; FIG. 2B is a front view; and FIG. 2C is a side view;

FIGS. 16A to 16C are diagrams illustrating changes in shape of a slide-contact portion S depending on changes in magnitude of a pressing force, wherein FIG. 16A shows a case in which the pressing force is small; FIG. 16B shows a case where the pressing force is increased; and FIG. 16C shows a case in which the pressing force is further increased;

FIGS. 18A to 18C are views illustrating a method of forming a polishing pad according to the second embodiment of the present invention, wherein FIG. 18A shows a state in which a polishing pad is mounted on a main shaft;

FIG. 18B shows a state in which a facing tool is fixed on an X-axis table; and FIG. 18C shows a state in which a polishing surface is formed with the facing tool by moving the X-axis table;

DESCRIPTION OF THE PREFERRED EMBODIMENTS

Hereinafter, preferred embodiments of the present invention will be described in detail with reference to the accompanying drawings.

[Embodiment 1]

Figure 1:
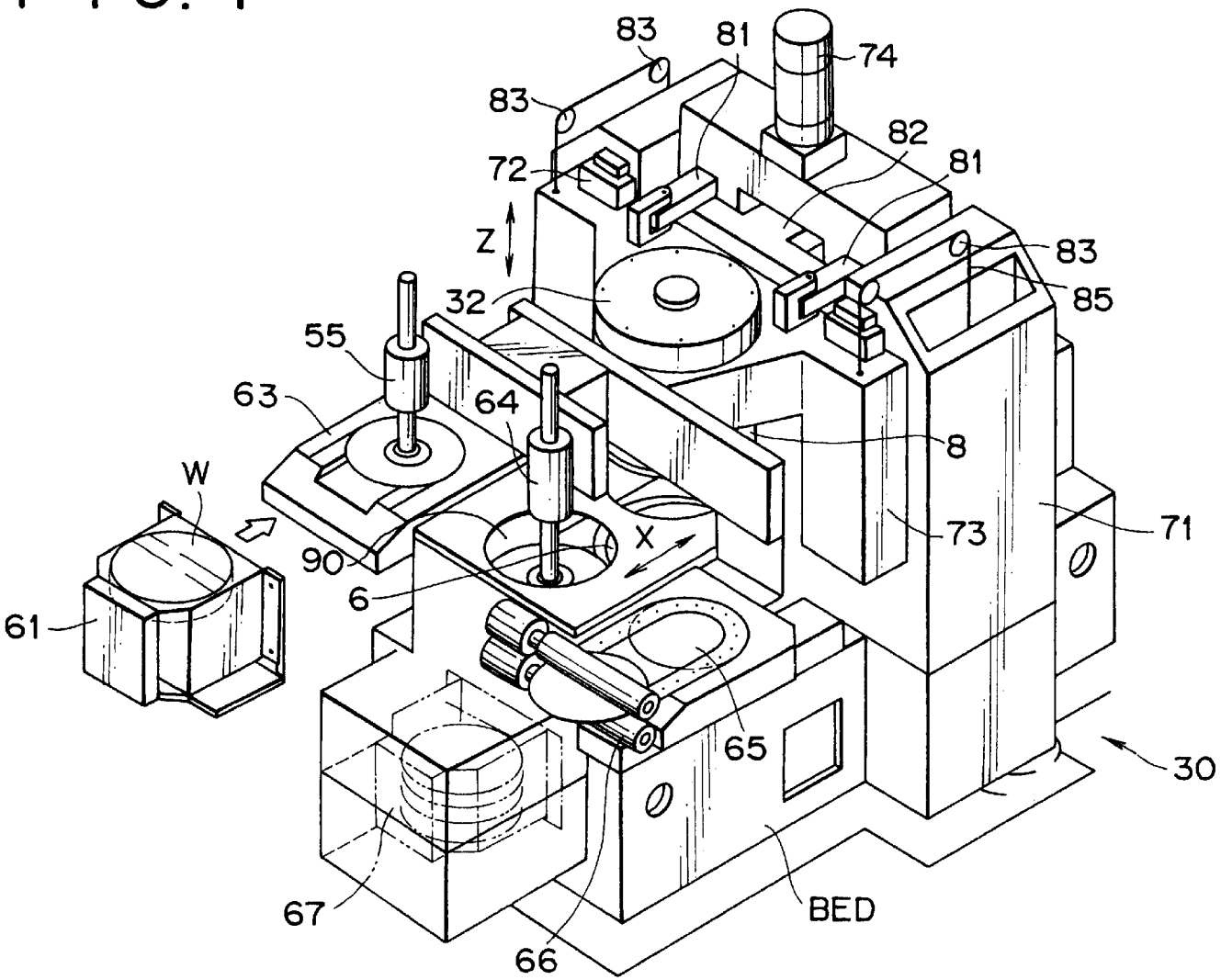
FIG. 1 is a perspective view showing the entire configuration of a polishing system according to one embodiment of the present invention.

FIG. 1 is a perspective view showing the entire configuration of a polishing system according to a first embodiment of the present invention. Referring to FIG. 1, a polishing system 30 in the first embodiment is adapted to polish a surface to be polished of a wafer as an object to be polished.

Figure 2A:
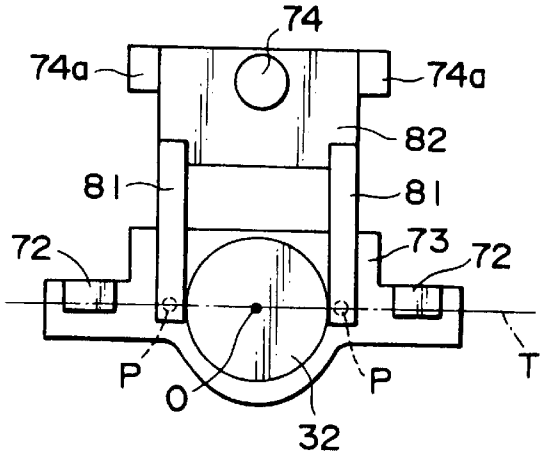
Figure 2B:
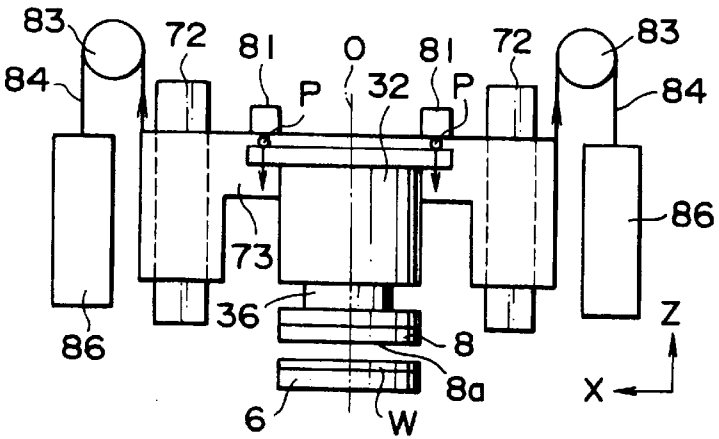
Figure 2C:
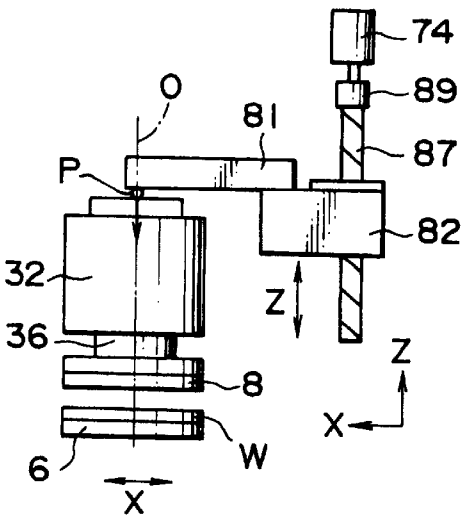
Figure 3:
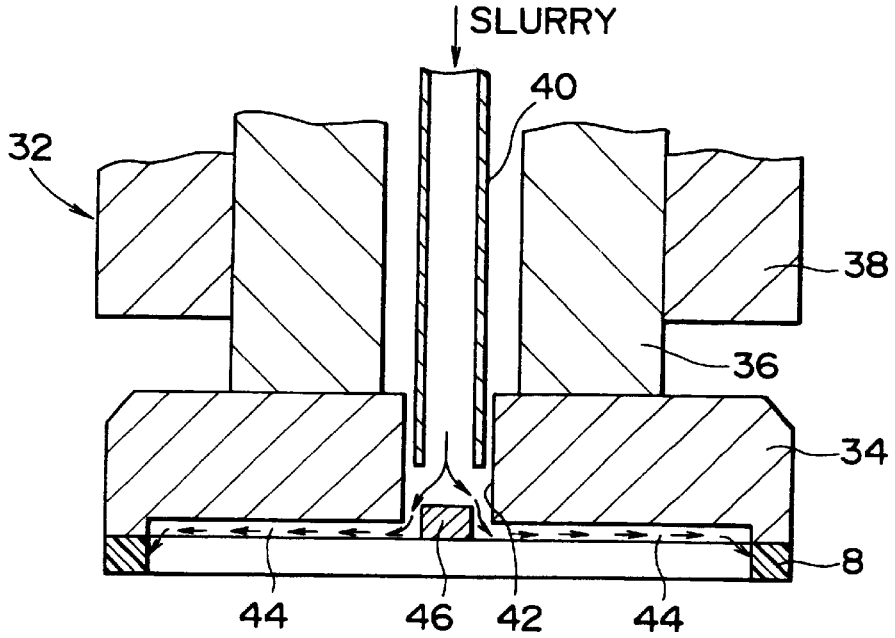
FIG. 3 is a sectional view showing an essential portion near a polishing pad.
Figure 4:
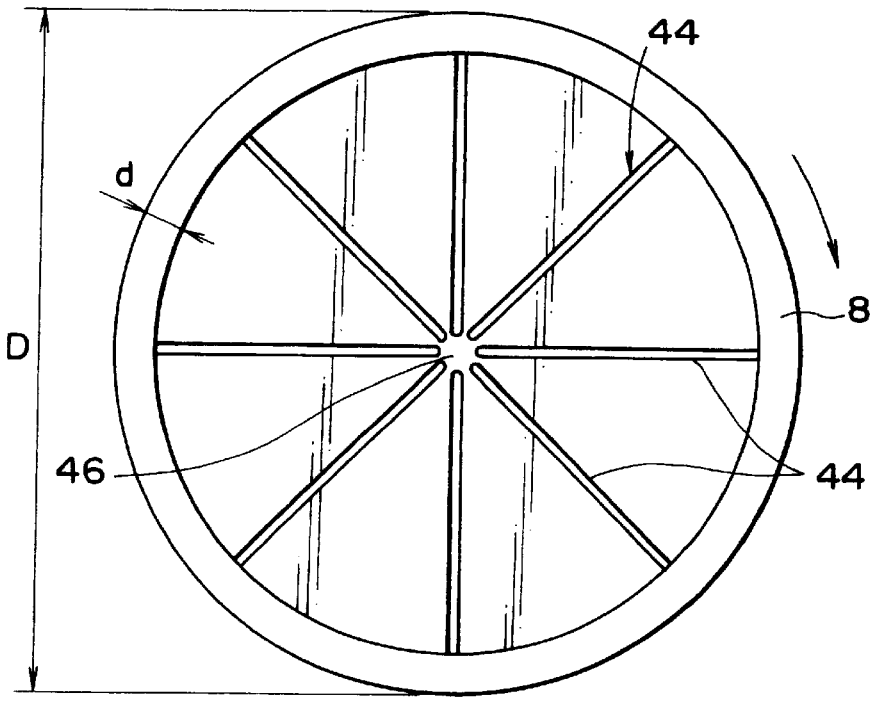
FIG. 4 is a bottom view of a polishing pad.

FIGS. 2A, 2B and 2C are schematic configuration views showing a rotating mechanism section for rotating a polishing pad of the polishing system shown in FIG. 1 and a movably holding mechanism section for movably holding a wafer, wherein FIG. 2A is a top view; FIG. 2B is a front view; and FIG. 2C is a side view. FIG. 3 is a sectional view of an essential portion near the polishing pad; and FIG. 4 is a bottom view of the polishing pad.

As shown in FIG. 1, a rotating mechanism section of the polishing system 30, which is adapted to rotate a main shaft for holding a polishing pad 8, mainly includes a main spindle 32 for rotating the polishing pad 8; a Z-axis slider 73 for holding the main spindle 32 movably in the Z-axis direction; load cells 81, whose one-ends are fixed on an upper surface of the Z-axis slider 73 at two positions, for detecting a load; a sub-slider 82 supported movably in the Z-axis direction by the other ends of the load cells 81 fixed thereto; and a Z-axis servo motor 74 for moving the sub-slider 82 in the Z-axis direction. A pressure control system (which will be described later) is applied to the rotating mechanism section in the first embodiment for controlling a pressure applied from the polishing pad 8 to a wafer W.

A wafer moving/holding mechanism section of the polishing system 30, which is adapted to hold and move the wafer W, mainly includes an X-axis table 6.

The Z-axis slider 73 is movable in the Z-axis direction along Z-axis guides 72 provided on a side surface of a column 71. The main spindle 32 is moved in the Z-axis direction by movement of the Z-axis slider 73.

The load cells 81 whose one-ends are fixed on the Z-axis slider 73 detect a load applied in the Z-axis direction. The other ends of the load cells 81 are fixed on the sub-slider 82. The sub-slider 82 is moved in the Z-axis direction together with the Z-axis slider 73 in a state being held by the load cells 81.

The load cell 81 is a measuring device for measuring a force by making use of a strain gauge. A load applied to the load cell 81 is measured on the basis of a theoretical structure in which a strain gauge adhesively bonded on a side surface of an elastic member such as a metal detects a strain generated in the elastic member. In the first embodiment, the load cell 81 is configured to detect a load in the Z-axis direction.

The load cell is advantageous in terms of miniaturized structure, high rigidity, and high natural frequency.

The load cells 81 are, as shown in FIG. 2A, fixed on the Z-axis slider 73 such that operational points P thereof to the Z-axis slider 73, an axis O of the main shaft, and the Z-axis guides 72 are aligned along a straight line T. In other words, the operational points P of the load cells 81 to the Z-axis slider 73, the axis O of the main shaft, and the Z-axis guides 72 are positioned on the same plane containing the straight line T, and such a plane is perpendicular to a wafer holding surface of the X-axis table 6.

As shown in FIG. 2A, the sub-slider 82 is movable in the Z-axis direction along sub-slider guides 74*a*. The sub-slider 82 is moved in the Z-axis direction by drive of the Z-axis servo motor 74 which is connected through a coupling 89 to a ball screw 87 screwed in the sub-slider 82 in the Z-axis direction.

One-ends of two wires 84 are, as shown in FIG. 1 and FIG. 2B, connected to both end portions of the upper surface of the Z-axis slider 73. As shown in FIG. 2B, the other end of each wire 84 is connected to a counter weight 86 suspended by way of a pulley 83. A load of the counter weights 86 is set to be substantially equal to a load of the Z-axis slider 73, to substantially cancel the load of the Z-axis slider 73 applied on the load cells 81, thus reducing a load applied to the load cells 81.

Accordingly, a difference between the load of the counter weights 86 and the load of the Z-axis slider 73 is applied to the load cells 81 as a pre-load.

The main spindle 32, which is held by the Z-axis slider 73, is movable in the Z-axis direction.

The main spindle 32 has, as shown in FIG. 3, a main shaft 36 and a main shaft housing 38. On the back side of the main shaft 36 is fixedly mounted a surface plate 34 having a central portion in which a nozzle hole 42 is formed. A lower end portion of a nozzle pipe 40 is inserted in the nozzle hole 42 in such a manner as not to be brought in contact therewith. A polishing solution as a slurry is discharged from the nozzle pipe 40. The nozzle pipe 40 is not rotated, and the surface plate 34 is rotatable by the main shaft 36. The main shaft 36 is rotated by a motor (not shown). As the slurry supplied from the nozzle pipe 40, there is used a polishing slurry suitable for chemical-mechanical polishing, for example, a water solution containing a powder of silicon oxide ($SiO_2$) and potassium hydroxide (KOH).

As shown in FIGS. 3 and 4, in the first embodiment, the nozzle hole 42 is formed in the surface plate 34 in such a manner that an end plate 46 for distribution of the slurry remains at a lower portion of the nozzle pipe 42. Further, radial grooves 44 are formed in a lower surface of the surface plate 34 and a common central portion of the radial grooves 44 is communicated to the nozzle hole 42.

The X-axis table 6 is rotatably mounted on a slider which is provided movably in the x-axis direction along rails (not shown). The X-axis table 6 is rotated at a relatively low velocity by a motor, pulley or flat belt.

The X-axis table 6 is formed into a disk shape which has, while not particularly exclusively, a diameter of about 200 mm. On an upper portion of the X-axis table 6 is mounted a chuck formed of a porous member. A rotating shaft for rotating the X-axis table 6 internally has an evacuating passage along an axis thereof, and a wafer W is vacuum-attracted on the surface of the X-axis table 6 by evacuation through the evacuating passage.

As shown in FIGS. 3 and 4, the polishing pad 8 formed into a ring-shape is mounted on an outer peripheral portion of a lower surface of the surface plate 34 by adhesive bonding or the like.

The rotational center of the ring-shaped polishing pad 8 corresponds to the common axis O of the main spindle 32 and the main shaft 36.

The polishing pad 8 is made from a porous viscoelastic material such as urethane foam. An outside diameter D of the polishing pad 8 is substantially equal to or smaller than an outside diameter of the wafer W.

The radial groove 44 is formed in such a manner as to extend up to an inner peripheral surface of the polishing pad 8.

In the first embodiment, the outside diameter D of the ring-shaped polishing pad 8 is set at 200 mm, and a radial width d thereof is set at 20 mm.

The polishing system 30 also includes, as shown in FIG. 1, a loader chuck 55, an unloader chuck 64, and a wafer cleaning brush 66. The loader chuck 55 holds by vacuum-attraction an unpolished wafer W contained in a wafer cassette 61 having been carried by a carrier (not shown), carrying it to a load buffer 63 and waiting for completion of polishing and unloading of the wafer W on the X-axis table 6, and loads the wafer W on the load buffer 63 on the X-axis table 6 through an opening portion 90. The unloader chuck 64 holds by vacuum-attraction the wafer W having been polished on the X-axis table 6 through the opening portion 90 and carries it to an unload buffer 65. The wafer cleaning brush 66 cleans a surface of the wafer W placed on the unload buffer 65 and inserts it into a wafer cassette 67.

An operation of the polishing system 30 in the first embodiment will be described below.

An unpolished wafer W contained in the wafer cassette 61 is placed on the load buffer 63 by the loader chuck 55.

When a wafer W on the X-axis table 6 is unloaded by the unloader chuck 64 after completion of polishing, the wafer W placed on the load buffer 63 is carried to the X-axis table 6 and is placed thereon with a surface to be polished of the wafer W directed upward by the loader chuck 55.

The wafer W placed on the X-axis table 6 is attracted thereon with a vacuum-attraction force generated on the surface of the X-axis table 6 by evacuation through the evacuating passage formed in the X-axis table 6.

The surface plate 34 is rotated at a high rotational velocity of, for example, 1,000 to 3,000 rpm by drive of the main spindle 32, and the X-axis table 6 on which the wafer W is mounted is rotated at a low rotational velocity of, for example, several tens rpm by drive of a motor.

Then, the slider provided movably in the X-axis direction along the rails (not shown) is moved in the X-axis direction along the rails (not shown) such that the polishing pad 8 is positioned over the wafer W.

At this time, a slurry fed from a slurry feeder through the nozzle pipe 40 shown in FIG. 3 is discharged from the nozzle hole 42 and is supplied, by a centrifugal force due to rotation, on the inner peripheral side of the polishing pad 8 through the radial groove 44.

The sub-slider 82 is lowered in the Z-axis direction by drive of the Z-axis servo motor 74. The lowering of the sub-slider 82 in the Z-axis direction causes the Z-axis slider 73 connected to the sub-slider 82 through the load cells 81 to be lowered in the Z-axis direction. At this time, only a difference between the load of the counter weights 86 and the load of the Z-axis slider 73 is detected by the load cells 81.

Figure 5:
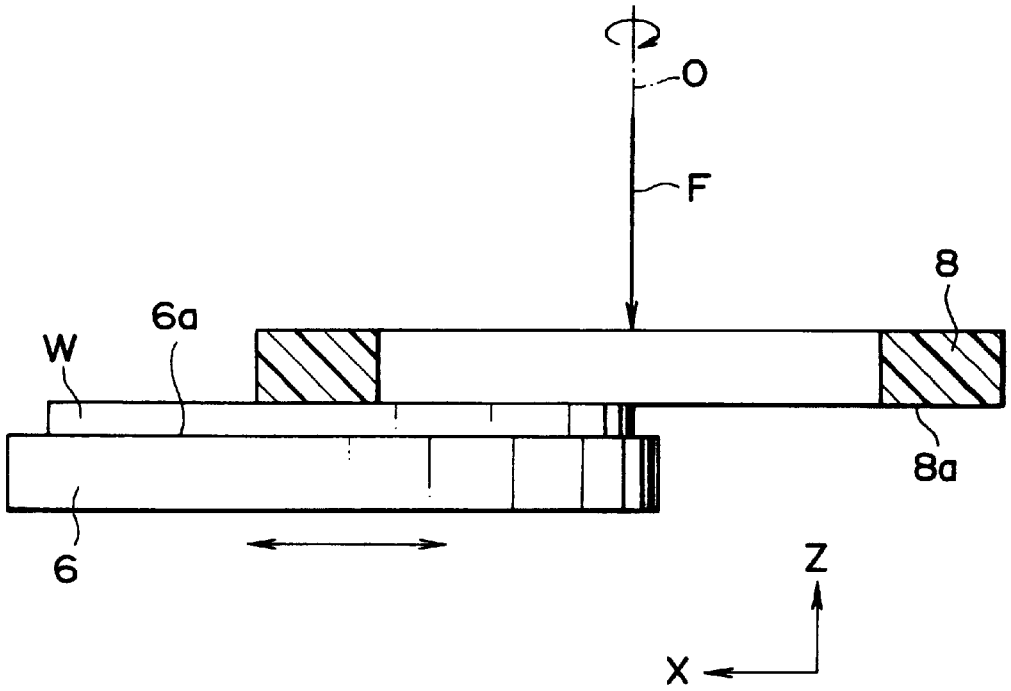
FIG. 5 is a sectional view showing a state in which a surface to be polished of a wafer is polished using a polishing surface of a polishing pad which in slide-contact with the surface to be polished of the wafer.

FIG. 5 shows a state in which the main spindle 32 held by the Z-axis slider 73 is lowered to a specific position in the Z-axis direction and a polishing surface 8*a* of the polishing pad 8 is brought in contact with a surface to be polished of the wafer W.

The polishing surface 8*a* of the polishing pad 8 is in slide-contact with the surface to be polished of the wafer W held by a wafer holding surface 6*a* of the X-axis table 6. The X-axis table 6 is moved by a drive force applied from a drive unit (not shown), which causes the wafer W to be moved (in the direction of the rotational radius) with respect to the polishing pad 8, whereby the wafer W is polished. The moving velocity of the X-axis table 6 is set at a value of, for example, 5 to 400 mm/min. Upon such a movement of the wafer W to the polishing pad 8, the polishing pad 8 and the wafer W are both rotated.

In the above polishing, a pressing force F in the Z-axis direction is applied to the polishing pad 8 through the main shaft 36. The magnitude of the pressing force F is dependent on a drive position of the sub-slider 82 in the Z-axis direction.

As described with reference to FIG. 2A, the operating points P of the load cells 81 to the Z-axis slider 73, the axis O of the main shaft, and the Z-axis guides 72 are positioned on the same plane containing the straight line T, and such a plane is perpendicular to the wafer holding surface 6*a* of the X-axis table 6.

The pressing force F can be thus applied to the polishing pad 8 in the Z-axis direction and on the axis O of the main shaft 36.

This allows mechanical deformation of the main shaft 36 due to the reaction against the pressing force F applied to the polishing pad 8 to occur substantially only in the Z-axis direction.

To be more specific, when the polishing pad 8 is applied with a load in the X-axis direction during polishing, the load cells 81 and the sub-slider 82 are mechanically deformed in the X-axis direction; however, with the above-described configuration, the mechanical deformation of the load cells 81 and the sub-slider 82 in the X-axis direction does not exert any effect to the pressing force F, with a result that the main shaft 36 is only substantially mechanically deformed in the direction of the Z-axis without any relation to the load in the direction of the X-axis during the polishing.

As a result, it is possible to keep constant, during polishing, the perpendicularity between the axis O of the main shaft 36 and the wafer holding surface of the X-axis table 6, and hence to improve the polishing accuracy.

Further, since the operational points P of the load cells 81 to the Z-axis slider 73, the axis O of the main shaft, and the Z-axis guides 72 are positioned on the same plane containing the straight line T and such a plane is perpendicular to the wafer holding surface 6*a* of the X-axis table 6, the load cells 81 can detect the force in the Z-axis direction without occurrence of any geometrical error based on the Abbe's principle. In other words, the pressing force F applied to the polishing pad 8 can be thus accurately detected by the load cells 81.

Accordingly, when the pressure control system according to the first embodiment (which will be described later) is applied to the polishing system 30, an accurate polishing pressure is allowed to be generated between the polishing surface 8*a* of the polishing pad 8 and the surface to be polished of the wafer W.

After having been polished by the polishing system 30, the wafer W is carried to the unload buffer 65 through the opening portion 90 shown in FIG. 1 by the unloader chuck 64, being cleaned by the wafer cleaning brush 66, and is inserted into the wafer cassette 67.

Figure 6:
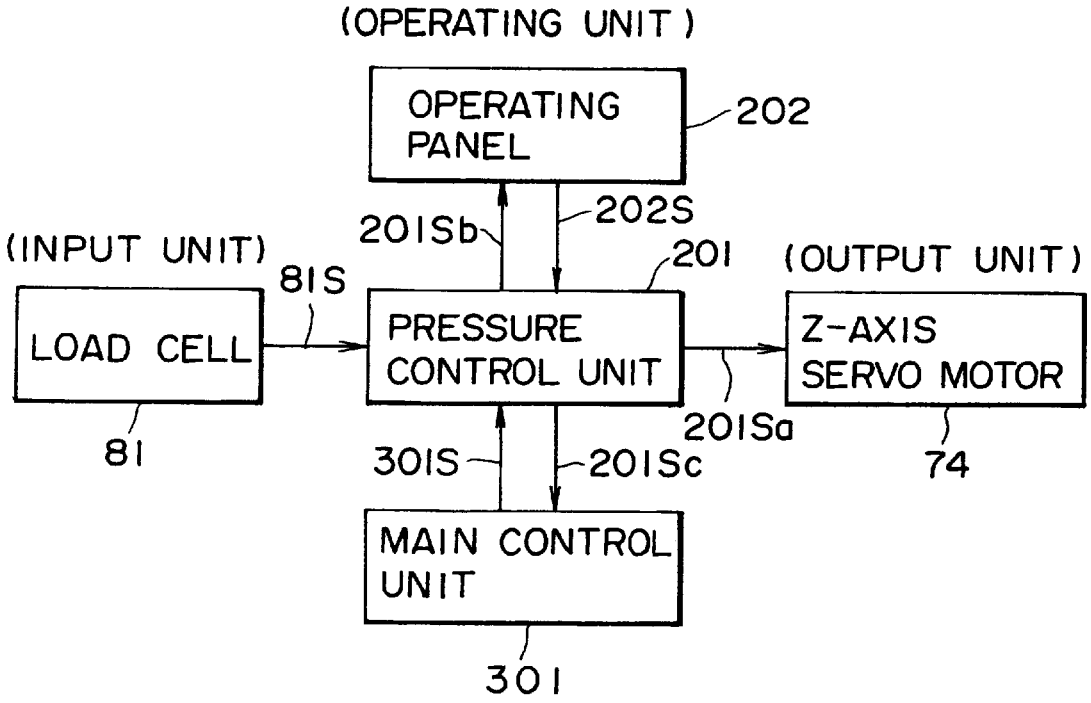
FIG. 6 is a diagram showing one example of a pressure control system applied to the rotating mechanism section of the polishing system of the present invention.

FIG. 6 is a configuration diagram showing one example of the pressure control system applied to the rotating mechanism section of the polishing system 30 according to the first embodiment.

The pressure control system according to the first embodiment includes a pressure control unit 201 and an operating panel 202.

A detection signal 81S from the load cells 81 is inputted into the pressure control unit 201.

The operating panel 202 displays various control information signal 201S*b* outputted from the pressure control unit 201 and also inputs a data signal 202S into the pressure control unit 201.

The pressure control unit 201 outputs a position command signal 201S*a* into the Z-axis servo motor 74.

A main control unit 301 for controlling the entire operation of the polishing system 30 according to the first embodiment outputs various control signals 301S into the pressure control unit 201, and the pressure control unit 201 outputs various control signals 201S*c* into the main control unit 301.

Figure 7:
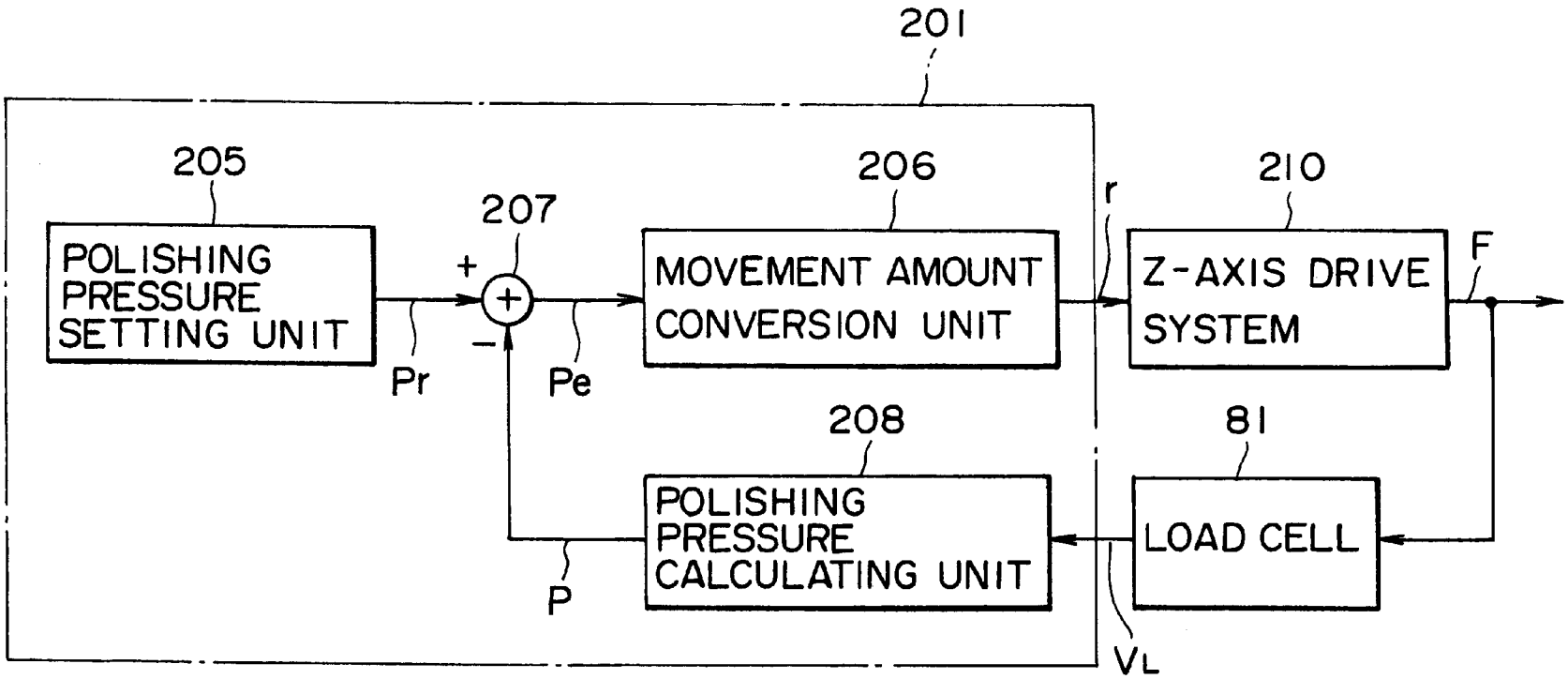
FIG. 7 is a control block diagram of the pressure control system shown in FIG. 6.

FIG. 7 is a control block diagram of the pressure control system according to the first embodiment.

Referring to FIG. 7, the pressure control unit 201 includes a polishing pressure setting unit 205, a comparatively calculating unit 207, a movement amount conversion unit 206, and a polishing pressure calculating unit 208. A detection signal $V_L$ from the load cells 81 is inputted into the pressure control unit 201, and a movement signal r is outputted from the pressure control unit 201 into a Z-axis drive system 210 including the Z-axis servo motor 74 and the like.

The detection signal $V_L$ from the load cells 81 is inputted into the polishing pressure calculating unit 208 of the pressure control unit 201. The polishing pressure calculating unit 208 calculates a present polishing pressure P on the basis of the detection signal $V_L$.

The polishing pressure setting unit 205 holds a setting polishing pressure Pr which has been previously set. The comparatively calculating unit 207 compares the polishing pressure P calculated at the polishing pressure calculating unit 208 with the setting polishing pressure Pr, and outputs a pressure difference signal Pe into the movement amount conversion unit 206.

The movement amount conversion unit 206 calculates, on the basis of the pressure difference signal Pe, an amount r to be rotated (movement amount) of the Z-axis servo motor 74 in such a manner that the pressure difference signal Pe becomes zero, and outputs the signal concerning the movement amount r into the Z-axis drive system 210. The Z-axis drive system 210 generates a pressing force F for pressing the polishing pad 8 by drive of the Z-axis servo motor 74. The pressing force F is detected by the load cells 81.

The polishing pressure setting unit 205, movement amount conversion unit 206, and polishing pressure calculating unit 208 shown in the control block diagram of FIG. 7 can be realized by means of hardware; however, in the first embodiment, description is made by way of the case where they are realized by means of software.

Figure 8:
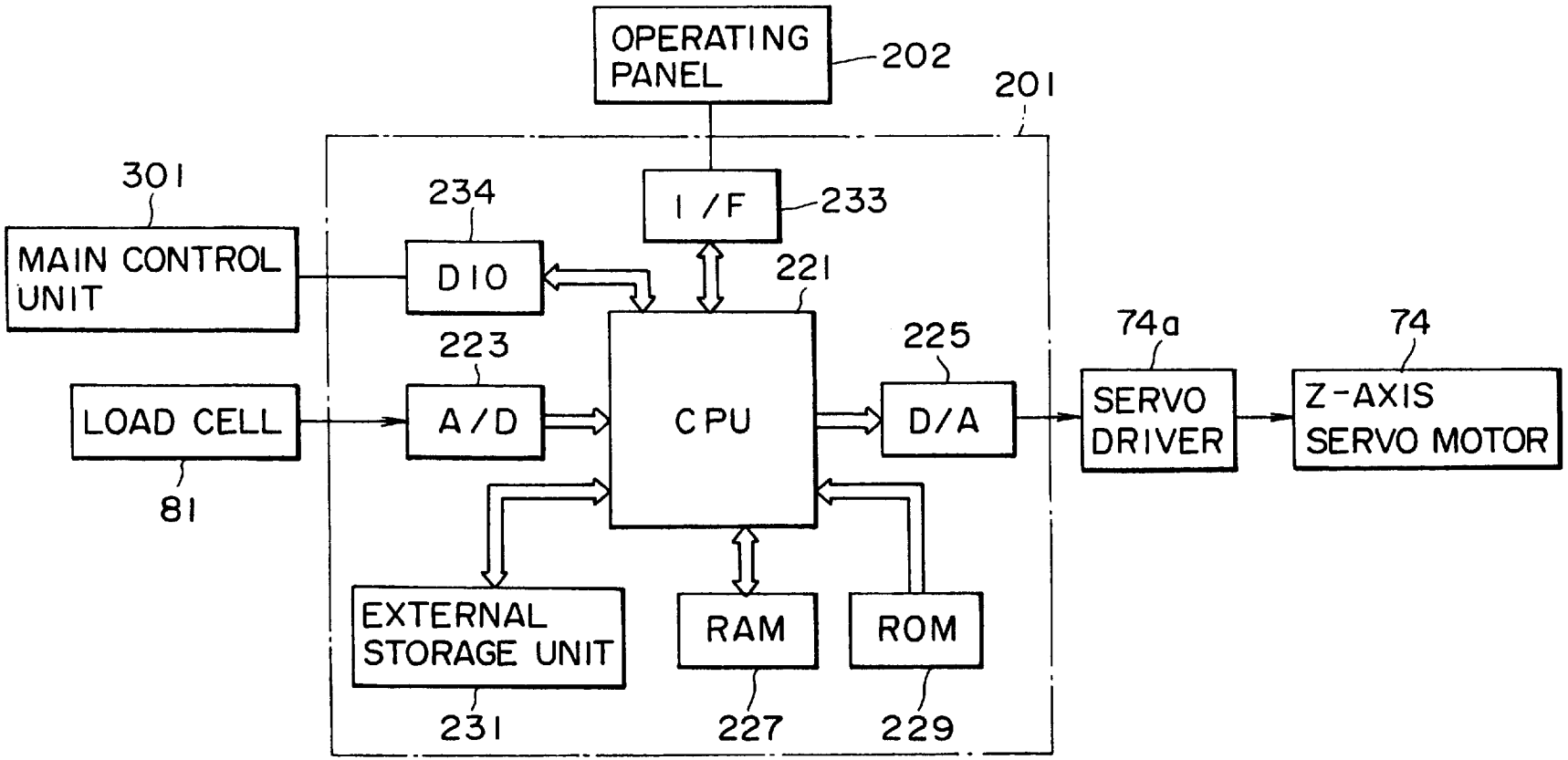
FIG. 8 is a configuration diagram showing one hardware example of the pressure control unit shown in FIG. 6.

FIG. 8 is a diagram showing one hardware configuration example of the pressure control unit 201 according to the first embodiment.

Referring to FIG. 8, the pressure control unit 201 includes a computer 221, an A/D converter 223, a D/A converter 225, a RAM 227, a ROM 229, I/F and DIO interfaces 233 and 234, and an external storage unit 231.

The computer 221 performs various kinds of calculation.

The A/D converter 223 converts a detection signal (analog signal) from the load cells 81 into a digital signal, and inputs it into the computer 211.

The D/A converter 225 converts a positional command (digital signal) to the Z-axis servo motor 74 calculated at the computer 221 into an analog signal, and outputs it to a servo driver 74*a* of the Z-axis servo motor 74.

The RAM 227 is a memory for storing and holding a program and data for operating the computer 221.

The ROM 229 is a memory for storing a program for starting the computer 221.

The I/F 233 is a circuit for making interface between the operating panel 202 and the computer 221.

The DIO 234 is a circuit for making interface between the main control unit 301 and the computer 221.

The external storage unit 231 is adapted to store various data, which is represented by a floppy disk device or a hard disk device.

In the pressure control system according to the first embodiment, the setting polishing pressure Pr to be held in the polishing pressure setting unit 205 shown in FIG. 7 is previously set by the following simulation.

A polished amount of the wafer W polished by the polishing pad 8 is related to various status factors on the basis of the following equation (1) called the PRESTON's equation:

$$H=Kp\times P\times V\times t \quad (1)$$

where H indicates a polished amount; Kp is a proportional constant; P is a polishing pressure; V is a polishing rate; and t is a working time.

Further, when the pressing force F is applied to the polishing pad 8, the polishing pressure P is expressed by the following equation (2):

$$P=F/A \quad (2)$$

where A indicates a contact (slide-contact) area between the polishing pad 8 and the wafer W.

When the polishing pad 8 is moved relative to the wafer W. the contact area A between the polishing pad 8 and the wafer W is changed. That is, it becomes apparent from the equations (1) and (2) that even if the pressing force F is kept constant, the polishing pressure P varies depending on a change in contact area A. The variation in polishing pressure P degrades uniformity in polished amount within a surface to be polished of the wafer W.

Figure 9:
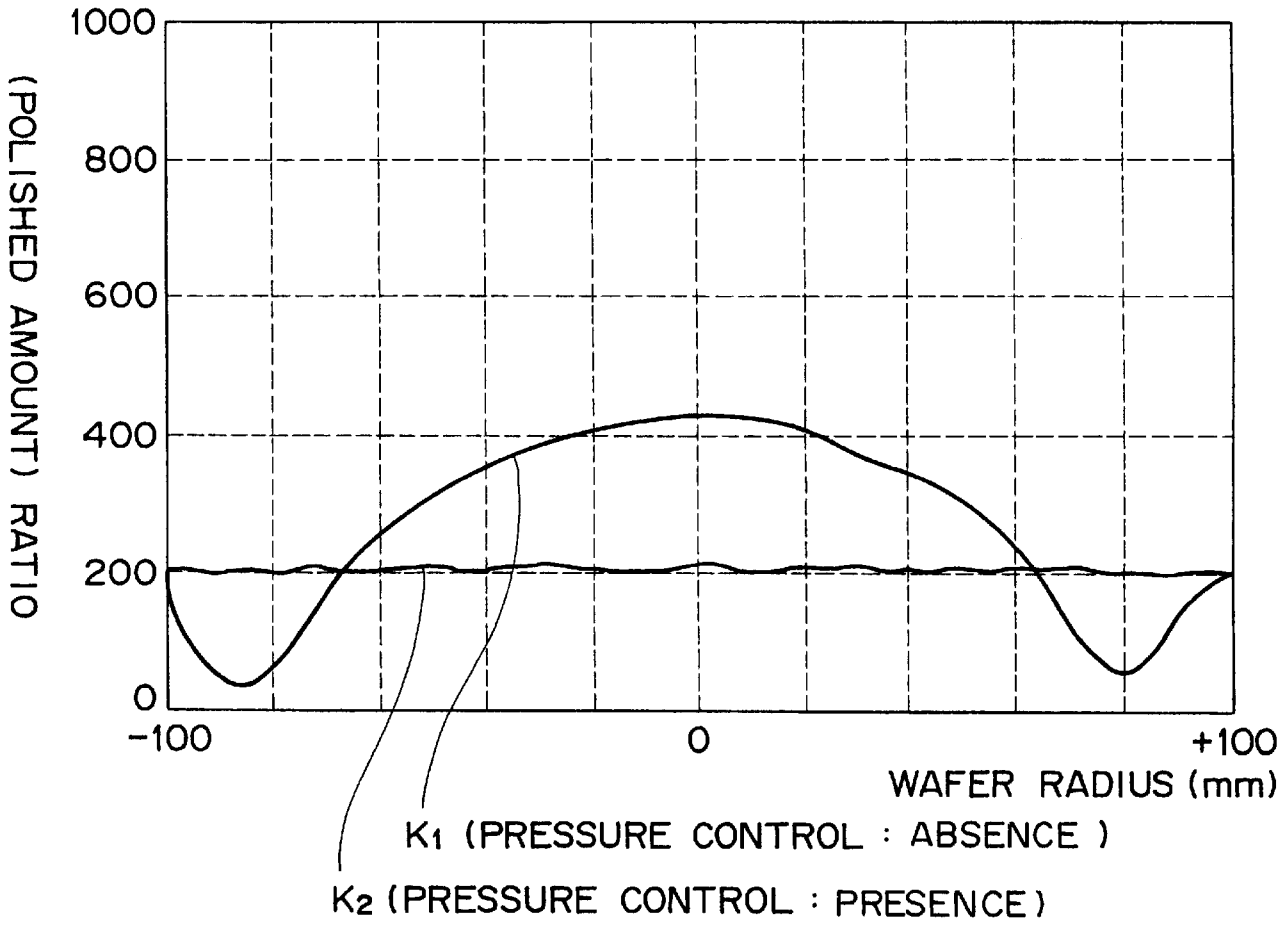
FIG. 9 is a graph showing a result of simulation of polishing.

In the case of polishing with the pressing force F kept constant, a distribution of polished amounts within a surface to be polished of the wafer F is, for example, expressed by a solid line $K_1$ of FIG. 9.

Here, a distribution of polishing pressures P capable of making uniform the distribution of polished amounts shown by the solid line $K_1$ of FIG. 9 is obtained by simulation on the basis of the equations (1) and (2).

One example of the distribution of the polishing pressures P to make uniform polished amounts within a surface to be polished, which is obtained by simulation, is shown in Table 1.

TABLE 1

| polishing pad: 1,500 rpm<br>wafer: 50 rpm | |
|---|---|
| wafer position (mm) | polishing pressure (magnification based on reference value) |
| 0–10 | 2.3 |
| 10–20 | 2.4 |
| 20–30 | 3.74 |
| 30–40 | 2 |
| 40–60 | 1.39 |
| 60–80 | 1.77 |
| 80–100 | 1.8 |
| 100–120 | 1.27 |
| 120–140 | 0.79 |
| 140–160 | 0.8 |
| 160–180 | 0.77 |
| 180–200 | 0 |

In Table 1, the polishing pressure P depending on the wafer position is expressed in magnification to a reference polishing pressure which is, for example, in the order of 100 to 300 gf/cm$^2$.

The polishing condition upon simulation is, for example, set such that the relative moving velocity (working time) between the polishing pad 8 and the wafer W is made constant by rotating the polishing pad 8 at 1,500 rpm and rotating the wafer W at 50 rpm.

The polishing in accordance with the distribution of the polishing pressures P shown in Table 1 exhibits a distribution of polished amounts shown by a solid line $K_2$ of FIG. 9. From this diagram, it becomes apparent that the polishing under pressure control significantly improves uniformity in polished amount within a surface to be polished of the wafer W as compared with the polishing under no pressure control.

In the pressure control system according to the first embodiment, a setting polishing pressure is determined on the basis of polishing pressure data depending on relative positions between the wafer W and the polishing pad 8 as shown in Table 1, and the Z-axis servo motor 74 is driven on the basis of the setting polishing pressure thus determined, to thus adjust the pressing force F applied to the polishing pad 8.

Next, one processing example of the pressure control unit 201 shown in FIG. 8 will be described with reference to a flow chart shown in FIGS. 10, 11 and 12.

Figure 10:
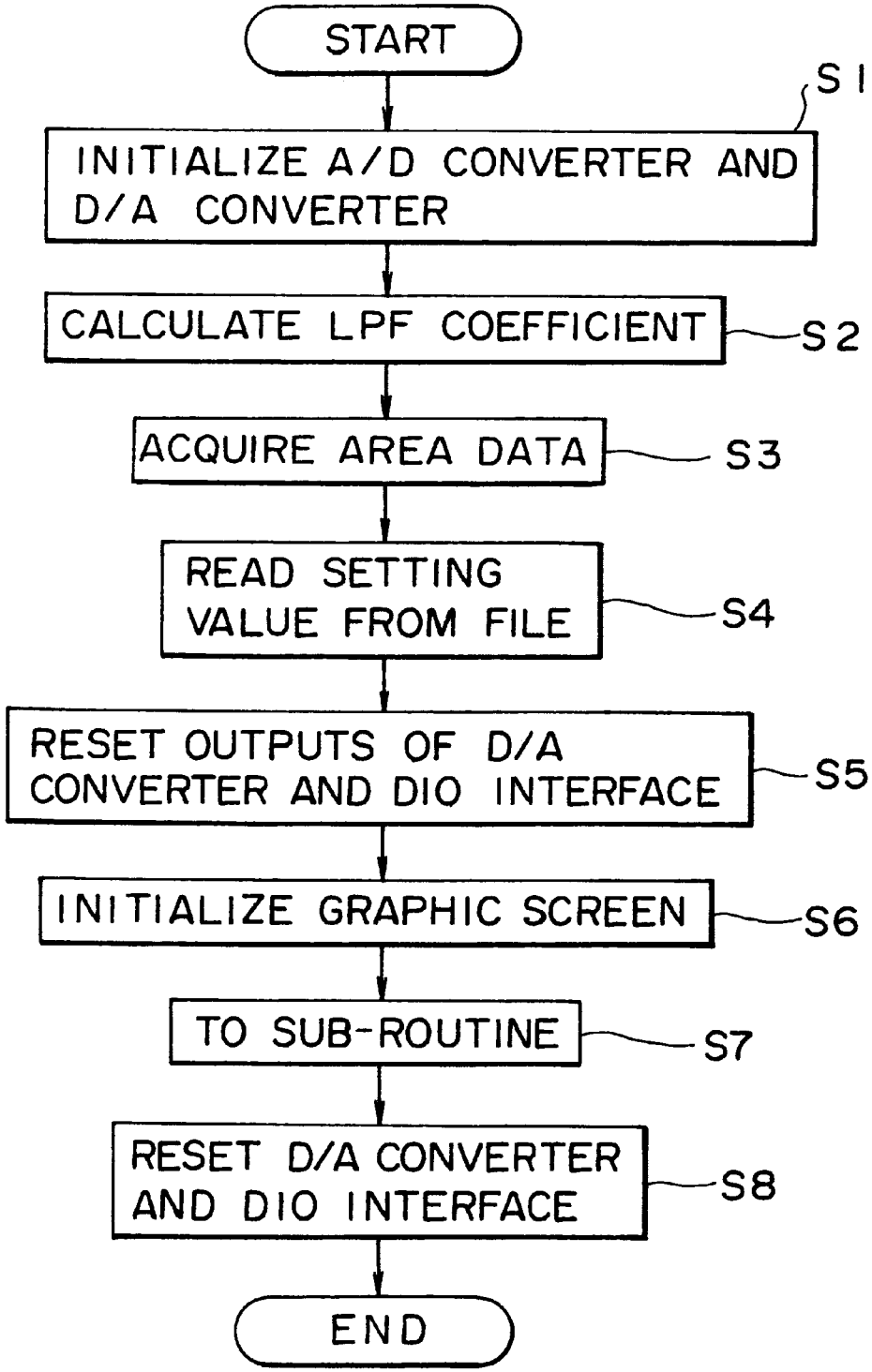
FIG. 10 is a flow chart showing a processing example of the pressure control unit shown in FIG. 8.

Referring to FIG. 10, in the pressure control unit 201, the A/D converter 223 and the D/A converter 225 are first initialized (step S1).

A filter coefficient of a low pass filter for removing a high frequency component of a detection signal from the load cells 81, which signal has been subjected to A/D conversion, is calculated (step S2). The low pass filter is represented by a secondary FIR filter.

Then, a data file concerning a contact area between the polishing surface 8*a* of the polishing pad 8 and the surface to be polished of the wafer W depending on an X-coordinate position of the wafer W, which has been previously stored in the external storage unit 231, is read out (step S3), and is stored and held in the RAM 227.

Accordingly, by sequentially taking the position of the wafer W in the X-axis direction, the pressure control unit 201 can acquire the contact area between the polishing surface 8*a* of the polishing pad 8 and the surface to be polished of the wafer w at such a position.

A data file of the setting polishing pressure value Pr obtained by the above-described simulation, which has been previously stored in the external storage unit 231, is read out (step S4). The data file of the setting polishing pressure value can be selected from a plurality of recipe files.

The pressure control unit 201 can acquire, out of the data file of the setting polishing pressure Pr, a polishing pressure to be set at an arbitrary position of the wafer W in the X-axis direction.

Then, outputs of the D/A converter 225 and the DIO interfaces 233 and 234 are reset (step S5). Further, a graphic image of the operating panel 202 is initialized (step S6), and setting information containing the content of the data file of the setting polishing pressure Pr read out at step S4 and the like is displayed on the screen of the operating panel 202.

Figure 13:
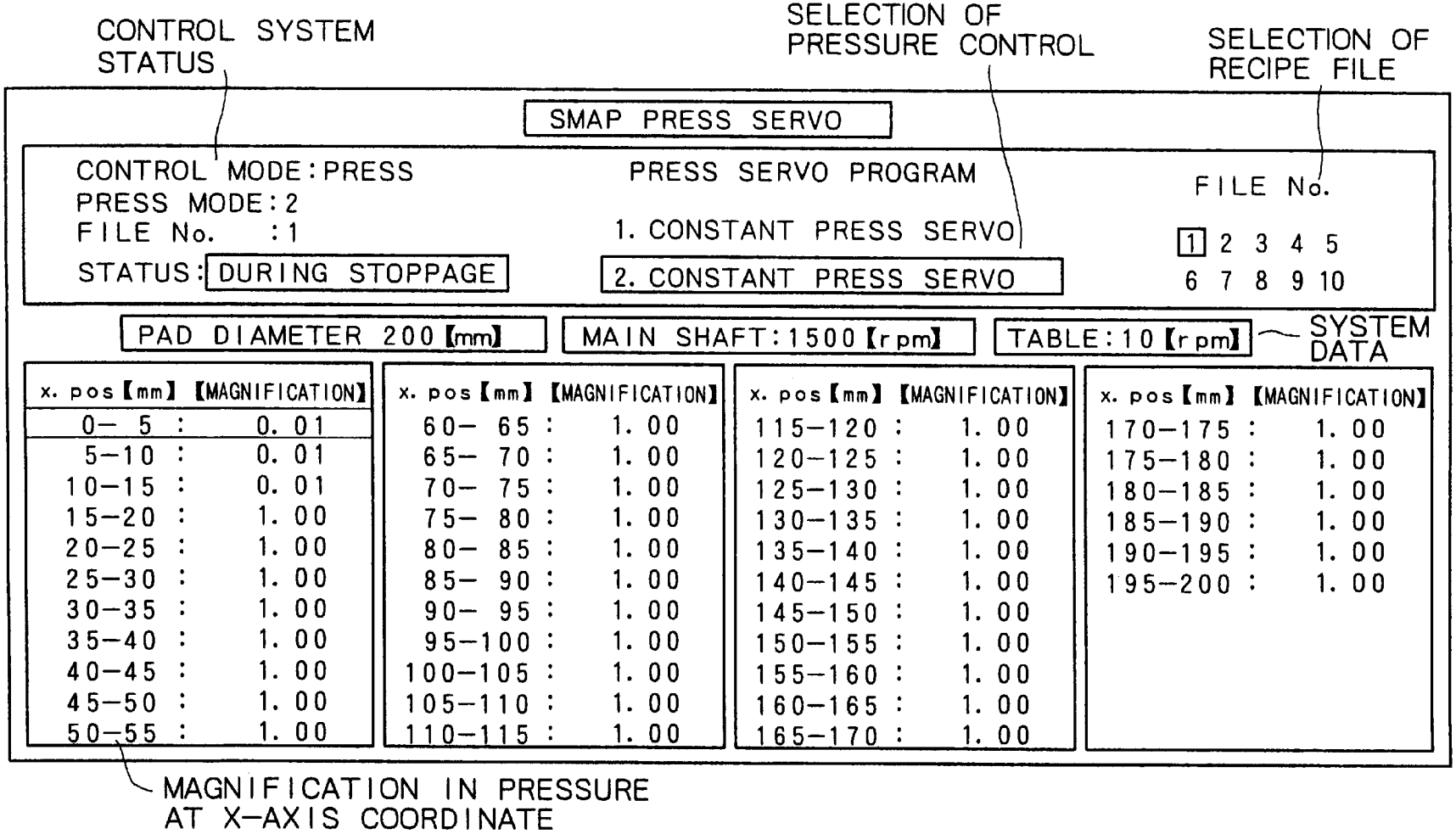
FIG. 13 is a diagram showing one example of a setting image displayed on a screen of an operating panel.

FIG. 13 shows one example of the setting information displayed on the screen of the operating panel 202.

Sub-routine

The process goes on to a sub-routine (step S7).

Figure 11:
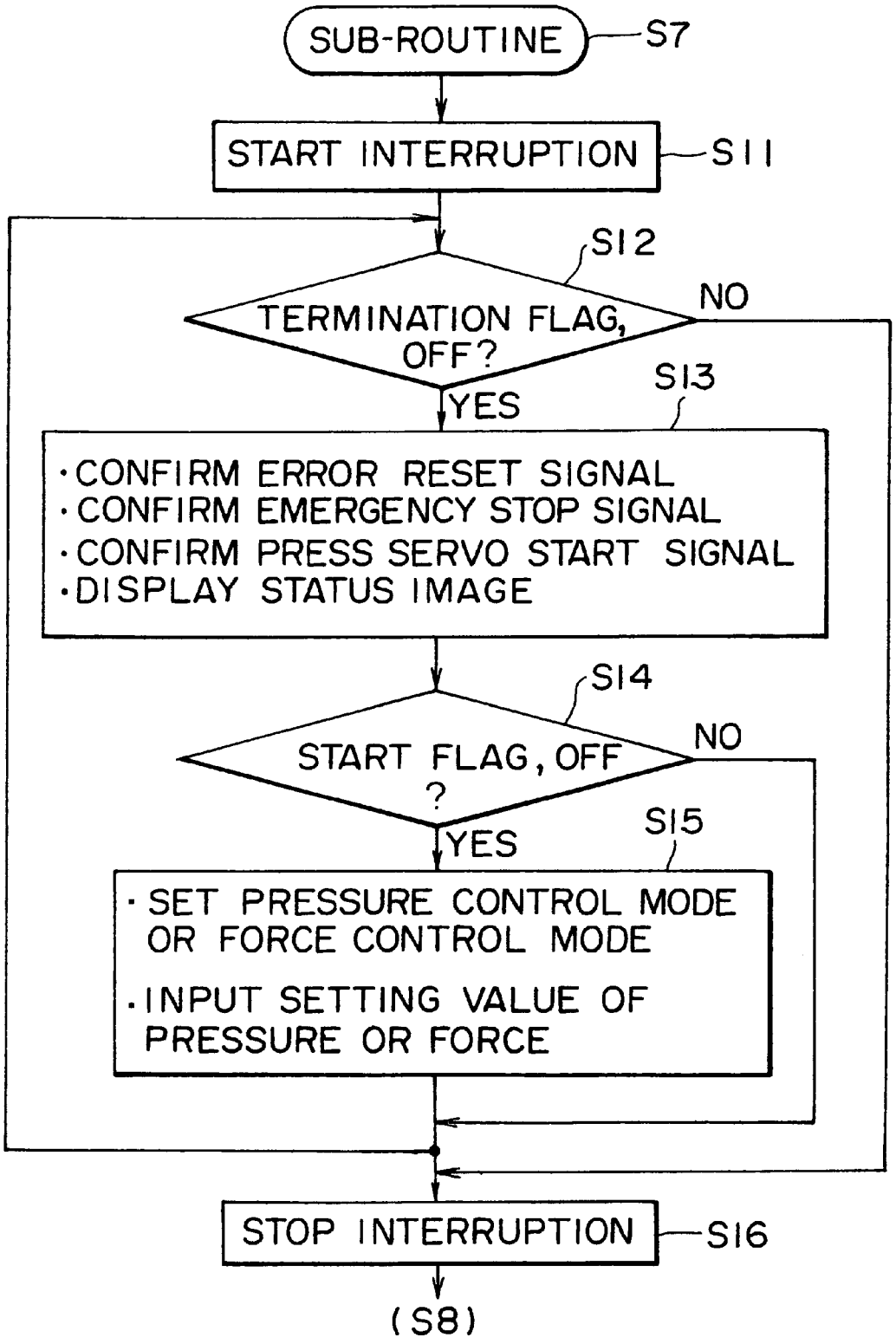
FIG. 11 is a flow chart showing a processing example of the pressure control unit shown in FIG. 8.

In the sub-routine shown in FIG. 11, interruption processing is performed at intervals of a specific sampling time (step S11). The processing at the interruption routine will be described later.

Then, it is confirmed whether or not a termination flag for terminating the operation of the pressure control unit 201 is in the ON state (step S12). If the termination flag is in the OFF state, it is confirmed whether or not an error reset signal upon occurrence of an error in the pressure control unit 201, an emergency stop signal and a pressure control start signal (press servo start signal) for starting pressure control are inputted from the main control unit 301 into the pressure control unit 201 through the DIO 234 (step S13).

If the reset signal is inputted into the pressure control unit 201, an emergency stop flag and an error rest flag in the pressure control unit 201 are turned off.

If the emergency stop signal is inputted into the pressure control unit 201, a pressure control start flag in the pressure control unit 201 is turned off, and the emergency stop flag is turned on.

If the pressure control start signal is inputted in the pressure control unit 201, the pressure control start flag is turned on depending on the status of the emergency stop flag and the error reset flag.

In addition, the start or stop of the operation of the pressure control system according to the first embodiment is performed on the basis of an operational signal supplied from the main control unit 301.

The status confirmed at step S13 is displayed as "during stoppage" or the like on the setting image shown in FIG. 13.

If the termination flag is in the ON state at step S12, the above-described interruption processing is stopped (step S16), and the process goes on to step S8 shown in FIG. 10 at which outputs of the D/A converter 225 and the DIO 234 are reset.

Then, it is confirmed whether or not the pressure control start flag is in the OFF state (step S14). If the start flag is in the OFF state and pressure control does not start yet, selection of the control mode is performed (step S15).

The pressure control unit 201 according to the first embodiment has a pressure control mode for controlling the polishing pressure P at a specific value and a force control mode for controlling the pressing force F of the polishing pad 8 such that the pressing force F is kept constant. Accordingly, at step S15, either of the two control modes is selected. It should be noted that only the case of selecting the pressure control mode is described in the first embodiment. The result of selecting the control mode is displayed on the setting image shown in FIG. 13.

The selection of the control mode is followed by input of a setting value of the polishing pressure P or the pressing force F in the pressure control mode or the force control mode.

The content of the data file of the setting polishing pressure described above is, as shown in FIG. 13, expressed by a magnification in pressure at each X-coordinate position of the wafer W, and accordingly, the reference polishing pressure is inputted at step S15.

Interruption Routine

During execution of each step of the above-described sub-routine, the interruption processing is executed at intervals of a specific sampling time.

Figure 12:
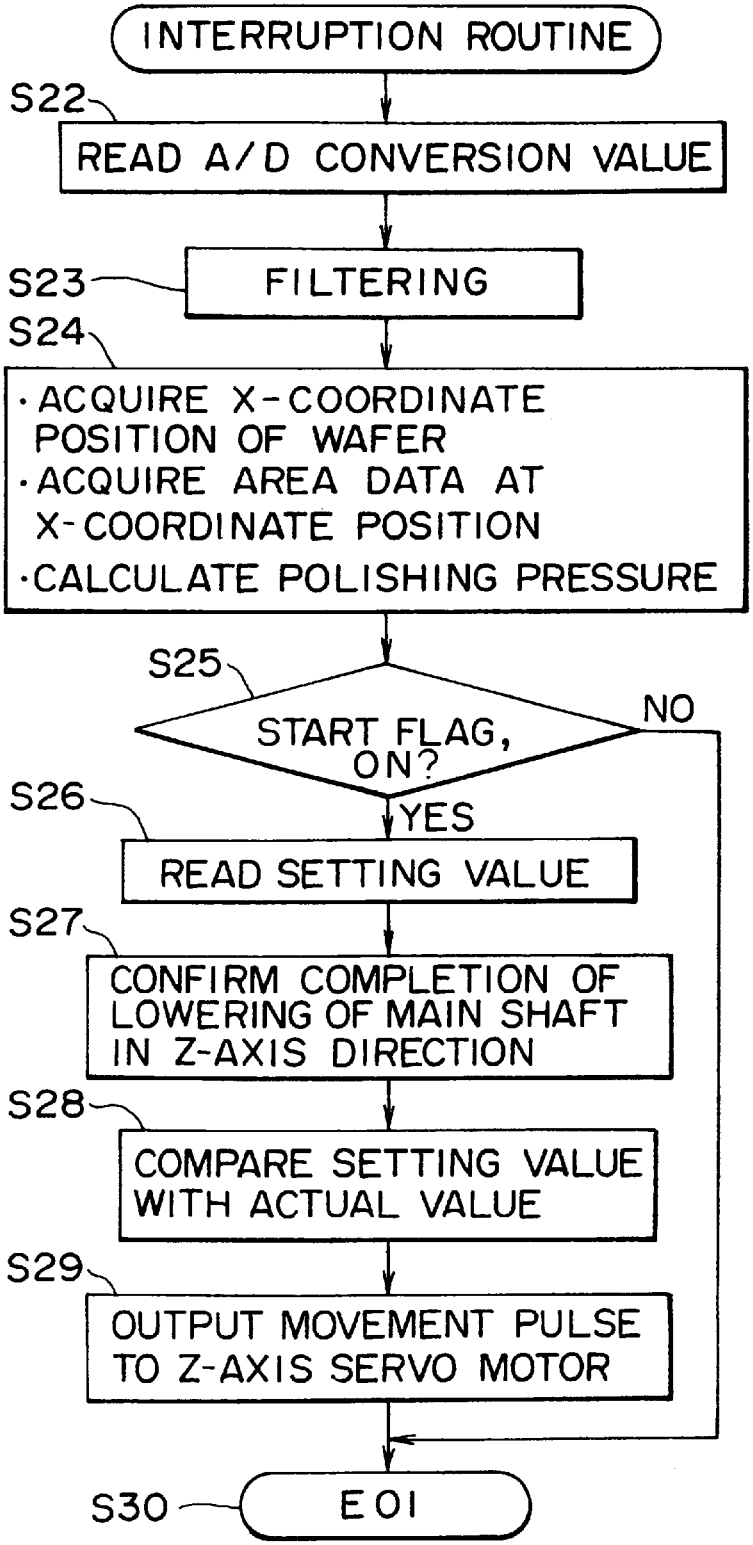
FIG. 12 is a flow chart showing a processing example of the pressure control unit shown in FIG. 8.

In the interruption routine, as shown in FIG. 12, the conversion value of the detection signal of the load cells 81, that is, the detection digital signal converted by the A/D converter 223, is read out (step S22).

Then, the conversion value of the A/D converter 223 thus read out is subjected to filtering by the low pass filter used at step S2, to remove a high frequency component such as noise (step S23). The conversion value of the A/D converter 223, from which the high frequency component is thus removed, is multiplied by a specific coefficient, to be converted into the force detected by the load cells 81.

Further, since a force detected by the load cells 81 when the polishing pad 8 is not in contact with the wafer W is an offset value not necessary for pressure control, the offset value is subtracted from the above force obtained from the detection signal of the load cells 81, to obtain the pressing force F for pressing the polishing pad 8 detected by the load cells 81.

Accordingly, when the polishing pad 8 is not in contact with the wafer W, the pressing force F becomes zero; while when the polishing pad 8 is in contact with the wafer W, the pressing force F becomes a value corresponding to mechanical deformation of the main shaft 36 in the Z-axis direction.

The X-axis coordinate position of the wafer W is taken by a position detector provided on the X-axis table 6 (step S24), to thereby detect a position of the wafer W relative to that of the polishing pad 8.

At step S24, further, data of the contact area A between the polishing surface 8*a* of the polishing pad 8 and the surface to be polished of the wafer W at the X-axis coordinate position of the wafer W thus obtained are acquired. The contact area data are, as described above, held in the RAM 227.

Additionally, at step S24, the polishing pressure P is calculated from the area data A and the pressing force F on the basis of the above-described equation (2).

Then, it is judged whether or not the pressure control flag is in the ON state, that is, pressure control starts (step S25).

If pressure control starts, data of the setting polishing pressure Pr at the obtained X-axis coordinate position of the wafer W are read out from the RAM 227 (step S26).

Next, it is judged whether or not lowering of the main shaft 36 in the Z-axis direction is completed (step S27).

In the pressure control system according to the first embodiment, when pressure control starts, the main shaft 36 is moved in the Z-axis direction, causing the wafer W and the polishing pad 8 separated from each other to be brought in contact with each other. Incidentally, as described above, in the state in which the wafer W and the polishing pad 8 are separated from each other, the pressing force F detected by the load cells 81 becomes zero; while when the wafer W and the polishing pad 8 are brought in contact with each other, the pressing force F becomes a value corresponding to mechanical deformation of the main shaft 36 in the Z-axis direction. Consequently, it can be judged whether or not the wafer W and the polishing pad 8 are brought in contact with each other, depending on whether or not the pressing force F is more than a specific value.

Thus it is judged whether or not lowering of the main shaft 36 in the Z-axis direction is completed, on the basis of a magnitude of the pressing force F calculated at step S24. If lowering of the main shaft 36 is completed, rotation of the Z-axis servo motor 74 is stopped; while if lowering of the main shaft 36 in the Z-axis direction is not completed within a specific time, an error flag is turned on to stop pressure control.

The polishing pressure P calculated at step S24 is then compared with the setting polishing pressure Pr read out at step S26 to obtain a pressure difference Pe between the polishing pressure P and the setting polishing pressure Pr (step S28).

Then, a moving pulse to be supplied to the Z-axis servo motor 74 for making zero the above pressure difference Pe is calculated (step S29).

For example, if the pressure difference Pe is zero, the moving pulse to be supplied to the Z-axis servo motor 74 is zero; while if the pressure difference Pe is not zero, the moving pulse corresponding to a magnitude of the pressure difference Pe is calculated and is inputted into the D/A converter 225.

Thus, a moving command r is outputted from the D/A converter 225 into the servo driver 74*a* of the Z-axis servo motor 74. The Z-axis servo motor 74 is rotated on the basis of the moving command r, to lift or lower the sub-slider 82 in the Z-axis direction.

In this way, the pressing force F applied to the polishing pad 8 through the load cells 81 is adjusted so that the polishing pressure P is controlled to be equal to the setting polishing pressure Pr.

As a result, the polishing pressure P generated between the polishing surface 8*a* of the polishing pad 8 and the surface to be polished of the wafer W during polishing is controlled to be usually equal to the setting polishing pressure Pr.

When the moving command r to the Z-axis servo motor 74 is outputted, the process is returned from the interruption routine to the above-described sub-routine (step S30).

As described above, according to the pressure control system in the first embodiment, the polishing pressure P generated between the polishing surface 8*a* of the polishing pad 8 and the surface to be polished of the wafer w during polishing can be controlled to be usually equal to the setting polishing pressure Pr.

Accordingly, like the simulation result shown in FIG. 9, uniformity in polished amount within a surface to be polished of the wafer W can be significantly improved.

To be more specific, in the case where a wafer W having a diameter of 8 inch is polished by the polishing system 30 under a condition in which the pressing force F of the polishing pad 8 is kept constant, an in-plane uniformity M (which will be described later) of a surface to be polished of the wafer W is about 10%. On the contrary, in the case where the same wafer W is polished by the polishing system 30 to which the pressure control system in the first embodiment is applied under a condition in which the polishing pressure P is controlled, the in-plane uniformity M of the surface to be polished of the wafer W is improved up to about 3%.

The in-plane uniformity M is calculated by the following equation (3):

$$\text{in-plane uniformity } M = \text{standard deviation } \sigma \text{ of variations in polished amount/average value } Me \text{ of polished amounts} \quad (3)$$

Further, since the polishing system 30 according to the first embodiment can accurately detect the pressing force F applied to the polishing pad 8 by the load cells 81, the polishing pressure P can be calculated on the basis of the accurate value of the pressing force F in the pressure control system according to the first embodiment, so that it is possible to suppress an error between the polishing pressure P and the setting polishing pressure Pr, and hence to execute polishing at a higher accuracy.

In the pressure control system according to the first embodiment, since uniformity in polished amount within a surface to be polished of the wafer W can be improved by adjusting the polishing pressure P with the feed velocity of the wafer W in the X-axis direction kept constant, it is possible to eliminate the need of adjusting the feed velocity of the wafer W in the X-axis direction, and hence to make easy the polishing work.

Additionally, since uniformity in polished amount within a surface to be polished of the wafer W can be improved by executing the polishing using the pressure control system according to the first embodiment, it is possible to improve the yield and hence to extend the process margin.

[Embodiment 2]

Next, a second embodiment of the present invention will be described.

Referring to FIG. 2, an axis O of a main spindle 32 is tilted at a specific angle with respect to a table axis perpendicular to a wafer holding surface of an X-axis table 6. To tilt the axis O of the main spindle 32, for example, the main spindle 32 is fixed on a Z-axis slider 73 in such a manner as to be tilted at a specific angle in the Z-axis direction.

The tilting angle can be adjusted when the Z-axis slider 73 is mounted on Z-axis guides 72, for example, by adjusting a force of fastening the main spindle 32 to the Z-axis slider 73 with fastening bolts.

The tilting angle is a micro-angle formed by, for example, a gradient of about several $\mu$m in the direction perpendicular to the Z-axis direction per 100 mm in the Z-axis direction.

Referring to FIGS. 3 and 4, even in the second embodiment, a rotational center of a ring-shaped polishing pad 8 corresponds to the common axis O of the main spindle 32 and a main shaft 36. A polishing surface 8*a* of the polishing pad 8 is, as will be described in detail later, tilted at a specific angle with respect to a plane of the main spindle 32 perpendicular to the axis O. The tilting angle of the polishing surface 8*a* is equal to the tilting angle of the axis O of the main spindle 32.

In the second embodiment, when the main spindle 32 is lowered to a specific position in the Z-axis direction by drive of a Z-axis drive motor 74, a portion of the polishing surface 8*a* of the polishing pad 8 is brought in contact with a surface to be polished of the wafer W. In such a state, a slider (not shown) reciprocates the X-axis table 6 at both a specific cycle and a specific amplitude along rails by a drive force of a drive unit (not shown), so that the wafer W performs a traverse motion (reciprocating movement in the direction of rotational radius) with respect to the polishing pad 8.

In addition, a velocity of the traverse motion is, for example, in a range of 5 to 400 mm/min. Upon this traverse motion, the polishing pad 8 and the wafer W are both rotated.

FIG. 5 shows a state in which polishing is performed with a portion of the polishing surface 8*a* of the polishing pad 8 being in contact with the surface to be polished of the wafer W.

Figure 14:
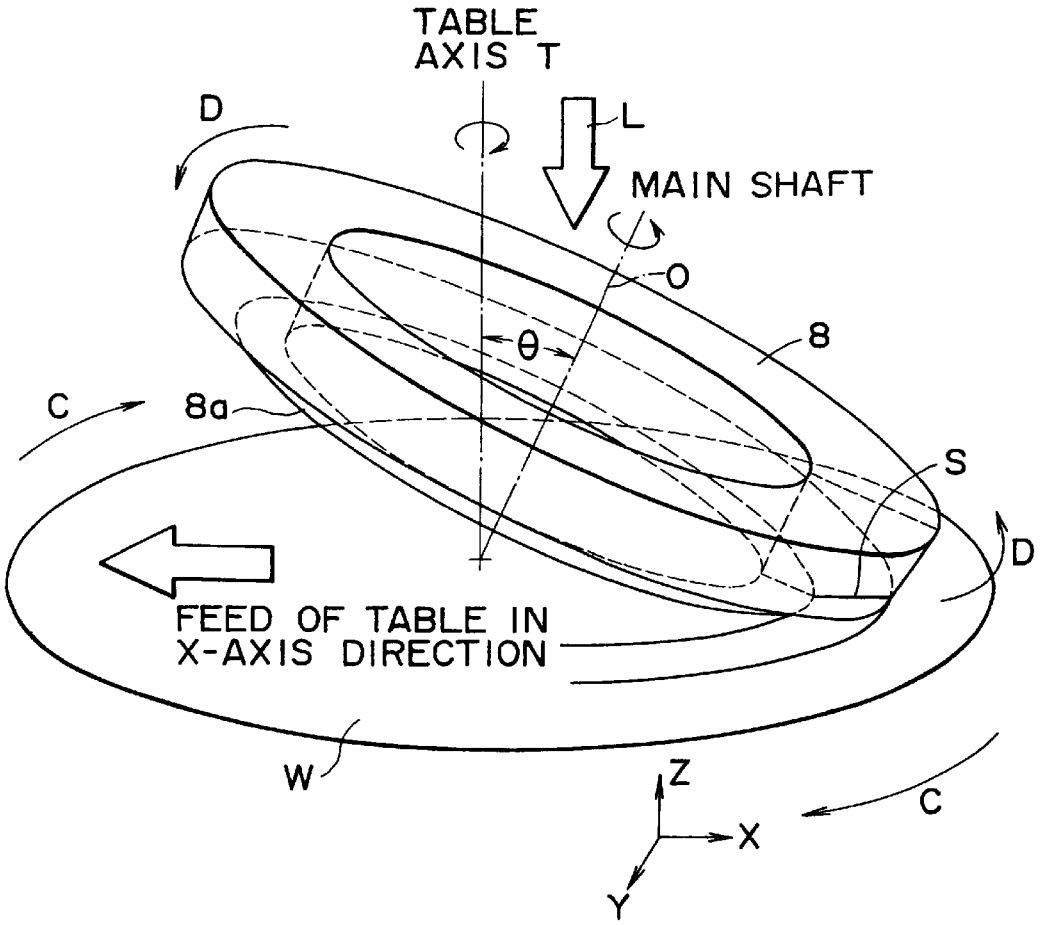
FIG. 14 is a perspective view showing a state in which a surface top be polished of a wafer is polished in a state being in contact with part of a polishing surface of a polishing pad.

As show in FIG. 14, the axis O of the main spindle 32, which is the rotational center of the polishing pad 8, is tilted at a micro-tilting angle θ with respect to a table axis T perpendicular to a wafer holding surface of the X-axis table 6.

Meanwhile, the polishing surface 8*a* of the polishing pad 8 is also tilted at the same tilting angle θ with respect to a plane perpendicular to the axis O of the main spindle 32. In addition, a facing work for the polishing surface 8*a* of the polishing pad 8 will be described later.

Although the tilting angle θ is depicted on a large scale in the figure for an easy understanding, it is actually a micro-angle formed by a gradient of the main shaft 36 which is in the order of about several μm per 100 mm.

Referring to FIG. 14, the polishing pad 8 is rotated at a high velocity in the direction indicated by an arrow D, and the wafer W is rotated at a low velocity in the direction indicated by an arrow C. The polishing surface 8*a* of the polishing pad 8 is in slide-contact with a surface to be polished of the wafer W at a slide-contact portion S. The surface to be polished of the wafer W is polished by the slide-contact portion S of the polishing surface 8*a*.

Further, the polishing pad 8 is pressed on the surface to be polished of the wafer W with a working force L.

The working force L applied from the polishing pad 8 to the surface to be polished of the wafer W is adjusted by drive of the Z-axis drive motor 74.

To be more specific, when the Z-axis drive motor 74 is driven, a force corresponding to the working force L applied from the polishing pad 8 to the surface to be polished of the wafer W is detected by load cells 81.

Thus, by controlling the drive of the Z-axis drive motor 74 on the basis of a detection signal of the load cells 81, the working force L can be adjusted.

Figure 15:
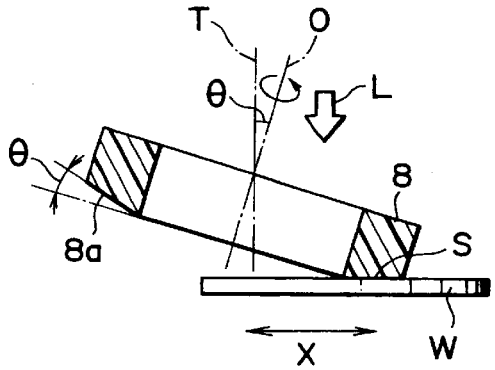
FIG. 15 is a sectional view showing a positional relationship between the wafer and the polishing pad shown in FIG. 14.

The polishing surface 8*a* of the polishing pad 8 shown in FIG. 14 is, as shown in FIG. 15, tilted at the same angle as the tilting angle θ of the axis O of the main shaft 36 with respect to the table axis T.

Figures 16A, 16B, 16C:
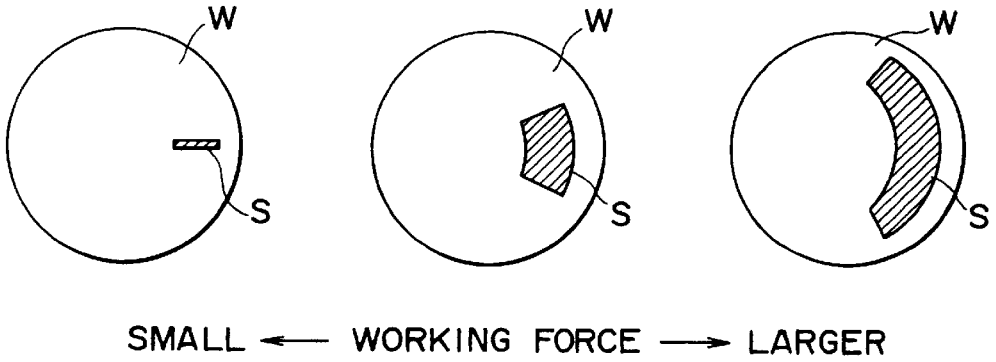

Accordingly, the shape of the slide-contact portion S shown in FIG. 14 varies as shown in FIGS. 16A to 16C by changing a magnitude of the working force L.

When the working force L is small, as shown in FIGS. 16A, the slide-contact portion S is formed into a tangential contact shape having a very small area as compared with the area of the polishing surface 8*a*.

As the working force L becomes larger, as shown in FIG. 16B, the slide-contact portion S is extended into a fan shape. This is because the polishing surface 8*a* of the polishing pad 8 is elastically deformed by the working force L.

As the working force L becomes even larger, as shown in FIG. 16C, the slide-contact portion S in the fan shape becomes further extended.

In other words, as the working force L becomes larger, the slide-contact state comes closer to a slide-contact state in which the axis O of the ring-shaped polishing pad 8 is not tilted with respect to the table axis T and the polishing surface 8*a* is parallel to the surface to be polished of the wafer W.

Accordingly, in the second embodiment, by adjusting the working force L, the area of the slide-contact portion S of the polishing surface 8*a* with the surface to be polished of the wafer W can be narrowed in a suitable range.

Further, a polished amount of the surface to be polished of the wafer W polished by the polishing surface 8*a* of the polishing pad 8 is dependent on the area of the slide-contact portion S. That is, the smaller the area of the slide-contact portion S, the smaller the polished amount; and the larger the area of the slide-contact portion S, the larger the polished amount.

Thus, the polished amount can be controlled by adjusting the area of the slide-contact portion S by means of changing the working pressure L.

The area of the slide-contact portion S can be changed not only by adjusting the working force L but also by adjusting the tilting angle θ of the main shaft 36 and the tilting angle θ of the polishing surface 8*a* of the polishing pad 8.

To be more specific, for a constant working force L, the shape of the slide-contact portion S comes closer to the tangential contact shape as the tilting angle θ of each of the main shaft 36 and the polishing pad 8 becomes larger, and the shape of the slide-contact portion S comes closer to the fan shape as the tilting angle θ becomes smaller.

Accordingly, the polished amount can be controlled by previously adjusting the tilting angle θ when the Z-axis slider 73 of the polishing system 30 is mounted on the Z-axis guides 72. In addition, a tilting mechanism capable of changing the tilting angle of the Z-axis slider 73 in rear time can be provided on the polishing system 30. In this case, the area of the slide-contact portion S can be changed in real time.

In this way, by tilting the axis O of the main shaft 36 and the polishing surface 8*a* of the polishing pad 8 so as to bring only a portion of the polishing surface 8*a* in slide-contact with a surface to be polished of the wafer W, the surface to be polished of the wafer W can be preferably subjected to mechanical-chemical polishing (CMP) by a chemical polishing effect of an alkali component in a slurry supplied from a nozzle pipe 40, a mechanical polishing effect of abrasive grains of silica or the like having a diameter of about 0.1 μm, and a synergistic polishing effect thereof.

In this case, the slide-contact portion S having a micro-area is less affected by irregularities of the surface to be polished of the wafer W, so that the area of the slide-contact portion S is stable during polishing, to thereby significantly improve uniformity in polished amount.

Since a distribution of a slurry is stable within the slide-contact portion S having a micro-area, it is possible to make very small a variation in polishing rate, that is, a polished amount per unit time, and hence to significantly improve uniformity in polishing rate.

In the case of polishing using the ring-shaped polishing pad 8, since the length of the polishing surface 8*a* in the radial direction is shortened, there little occurs a difference in peripheral velocity within the slide-contact portion S. This is effective to suppress a variation in polished amount at minimum.

The slide-contact portion S having a micro-area can be also imparted with a sufficiently large pressure per unit area only by applying a very small absolute value of the working force L thereto.

As described above, according to the second embodiment, a polished amount and a polishing rate at the slide-contact portion S are stable and also a sufficiently large pressure is imparted to the slide-contact portion S only by applying a very small absolute value of the working force L thereto, and consequently, the polished amount can be very easily controlled.

For example, when a polished amount within a surface to be polished of the wafer W is controlled by adjusting an area of the slide-contact portion S by means of changing the working force L or the tilting angle θ of the axis O of the main shaft 36 or a polished amount is controlled by adjusting a feed velocity of the X-axis table for holding the wafer W, there little occurs a variation in polished amount an d polishing rate at the slide-contact portion S. As a result, even if the working force L, tilting angle θ of the axis O, and feed velocity of the X-axis table are numerically controlled, a desired polishing accuracy can be obtained.

In the second embodiment, since only a portion of the polishing surface 8*a* of the polishing pad 8 is brought in slide-contact with the surface to be polished of the wafer W, it is possible to significantly reduce wear of the polishing pad 8 and hence to prolong the service life of the polishing pad 8.

The slide-contact of only a portion of the polishing surface 8*a* of the polishing pad 8 with the surface to be polished of the wafer W is also effective to significantly reduce a degree of clogging of the polishing surface 8*a* of the polishing pad 8.

Figure 17A:
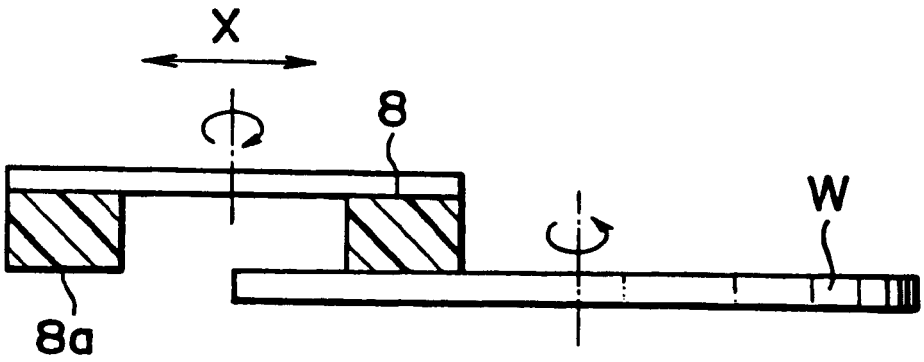
FIG. 17A is a view illustrating a basic polishing manner according to a second embodiment of the present invention.

As shown in FIG. 17A, the polishing pad 8 according to the second embodiment is basically configured that it has a rotational axis substantially perpendicular to a surface to be polished of the wafer W, and polishes the surface to be polished of the wafer W by the polishing surface 8*a* facing to the surface to be polished of the wafer W.

In this case, since the slide-contact portion of the polishing surface 8*a* with the surface to be polished of the wafer W has a circular-arc (fan) shape, even if the polishing surface 8*a* has irregularities, irregularities are formed at random on the surface to be polished of the wafer W. As a result, according to the second embodiment, it is possible to enhance smoothness of the surface to be polished of the wafer W after polishing.

Figure 17B:
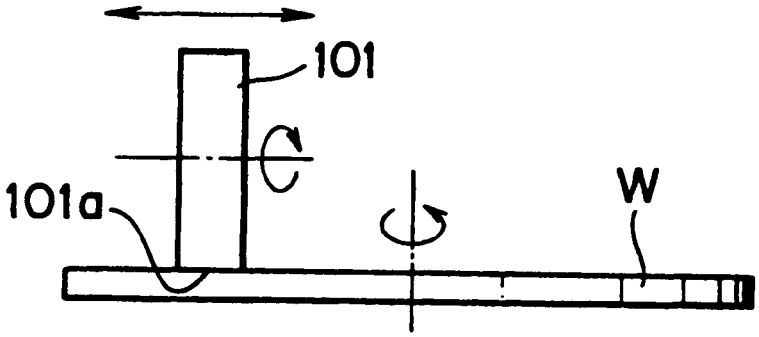
FIG. 17B is a view illustrating a different polishing manner.

On the other hand, as shown in FIG. 17B, in the polishing type in which the rotational axis of a polishing pad 101 is parallel to a surface to be polished of the wafer W and the surface to be polished of the wafer W is polished by a polishing surface 101*a* which is an outer peripheral surface of the polishing pad 101, irregularities of the polishing surface 101*a* are transferred on the surface to be polished of the wafer W, to thereby degrade a surface characteristic of the polished surface of the wafer W.

Further, according to the second embodiment, the use of the ring-shaped polishing pad 8 is effective to improve flatness of the surface to be polished. In the related art disk-shaped polishing pad, since a large difference in peripheral velocity occurs between inner and outer peripheral sides of the polishing pad, a large difference in frequency of excitation forces due to stepped portions to be polished occurs therebetween. As a result, if a rotational velocity of the polishing pad is selected to be preferable for polishing stepped portions on the inner peripheral side, there is a possibility that stepped portions on the outer peripheral side are not perfectly polished. On the contrary, since the ring-shaped polishing pad 8 is used in the second embodiment, a difference in peripheral velocity between inner and outer peripheral sides of the polishing pad 8 can be made small, to improve uniformity in polishing ability between the inner and outer peripheral sides, thereby enhancing flatness of the polished surface.

Next, a method of forming the polishing surface 8*a* of the above-described polishing pad 8 will be described.

First, the polishing pas 8 is mounted on a surface plate 34 of the main shaft 36 of the polishing system 30.

Figure 18A:
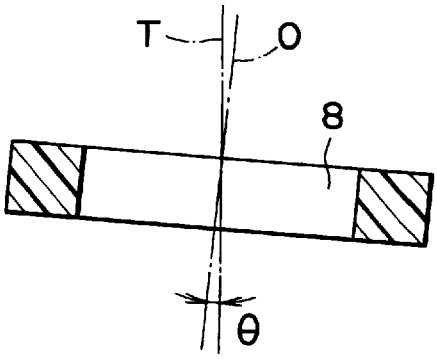

Thus, the axis O of the polishing pad 8 is, as shown in FIG. 18A, tilted at a tilting angle θ with respect to the table axis T of the X-axis table 6.

Figure 18B:
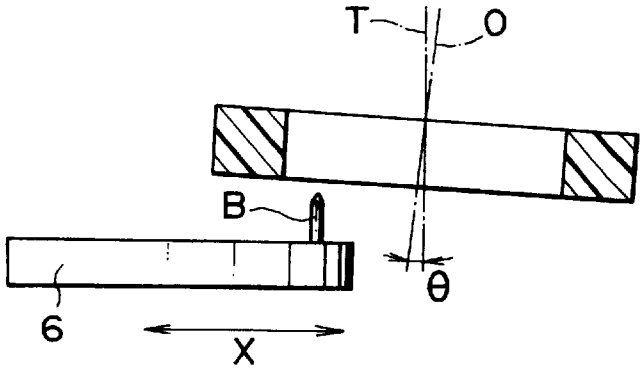

Then, as shown in FIG. 18B, a facing tool B is fixed on the X-axis table 6 at a specific position. As the facing tool B, there can be used a diamond cutting tool or the like.

Figure 18C:
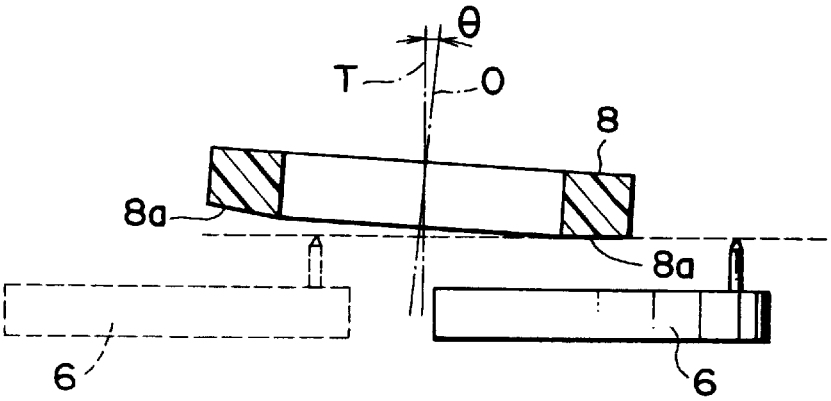

The X-axis table 6 is moved in the X-axis direction as shown in FIG. 18C, to bring the facing tool B in contact with an end surface portion of the polishing pad 8, thereby cutting the end surface portion of the polishing pad 8.

The cutting using the facing tool B thus forms a polishing surface 8*a* tiled at a tilting angle θ with respect to a plane perpendicular to the axis O of the polishing pad 8.

By mounting the polishing pad 8 on the polishing system 30 for executing actual polishing and forming the polishing surface 8*a* using the facing tool B, the tilting angle θ of the axis O with respect to the table-axis T can be accurately transferred on the polishing surface 8*a* of the polishing pad 8.

The polishing using the polishing pad 8 formed by the above-described method makes it possible to further improve uniformity in polished amount and polishing rate at the slide-contact portion S.

Further, according to the above-described method, it is possible to easily, highly accurately form the polishing surface 8*a* of the polishing pad 8 according to the second embodiment.

In addition, the above-described second embodiment is for illustrative purposes only and it is to be understood that changes and variations may be made without departing the scope of the present invention.

For example, in the second embodiment, the main shaft 36 is tilted at the tilting angle θ with respect to the table-axis T of the X-axis table 6; however, a wafer holding surface of the X-axis table 6 may be tilted at the tilting angle θ without tilting the main shaft 36.

Further, although the wafer W is moved relative to the polishing pad 8 by moving the wafer W in the X-axis direction by the X-axis table 6 in the second embodiment, the main spindle 32 for holding the polishing pad 8 may be reciprocated relative to the wafer W. From the viewpoint of rotational stability, however, reciprocating motion of the X-axis table 6 is preferable because of the main spindle 32 is rotated at a higher velocity.

[Embodiment 3]

Hereinafter, a third embodiment will be described in detail.

Polishing Principle in Embodiment 3

Figure 19:
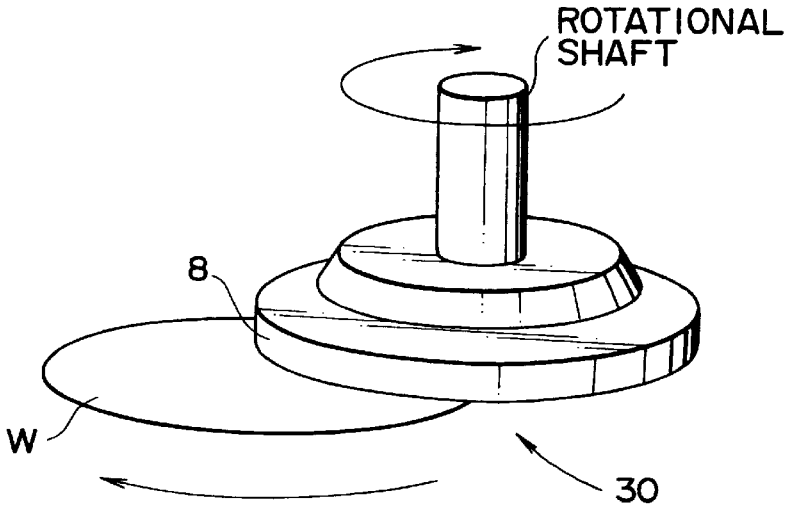
FIG. 19 is a perspective view showing a basic configuration of a polishing system according to a third embodiment.

FIG. 19 is a schematic diagram showing a basic configuration of a polishing system according to a third embodiment. In a polishing system 30 according to the third embodiment, a semiconductor wafer W is rotated at a relatively low velocity, and in such a state, a polishing pad 8 rotated at a relatively high velocity is pressed on the semiconductor wafer W. Here, the polishing pad 8 is formed in such a manner as to be brought in contact with the semiconductor wafer W at a region radially separated a specific distance from a rotational axis of the polishing pad 8 (hereinafter, the region on the semiconductor wafer W, being in contact with the polishing pad 8, is referred to as "a region to be polished").

In the polishing system 30, accordingly, a polishing surface of the polishing pad 8 is, at the region to be polished, displaced relative to the surface of the semiconductor wafer W at a specific velocity or more, and further such a region to be polished is displaced on the semiconductor wafer W at a specific velocity or less by rotating the semiconductor wafer W at a relatively low velocity.

The polishing pad 8 is formed by dispersing abrasive grains in a resin as a binder in such a manner as to have such a specific elasticity as to withstand a rotational velocity of the polishing pad 8 and a displacement velocity of the region to be polished. In the polishing system 30, by use of such a polishing pad 8, it is possible to significantly increase flatness of a polished surface of a semiconductor wafer as compared with that obtained by the related art polishing system.

Figure 20:
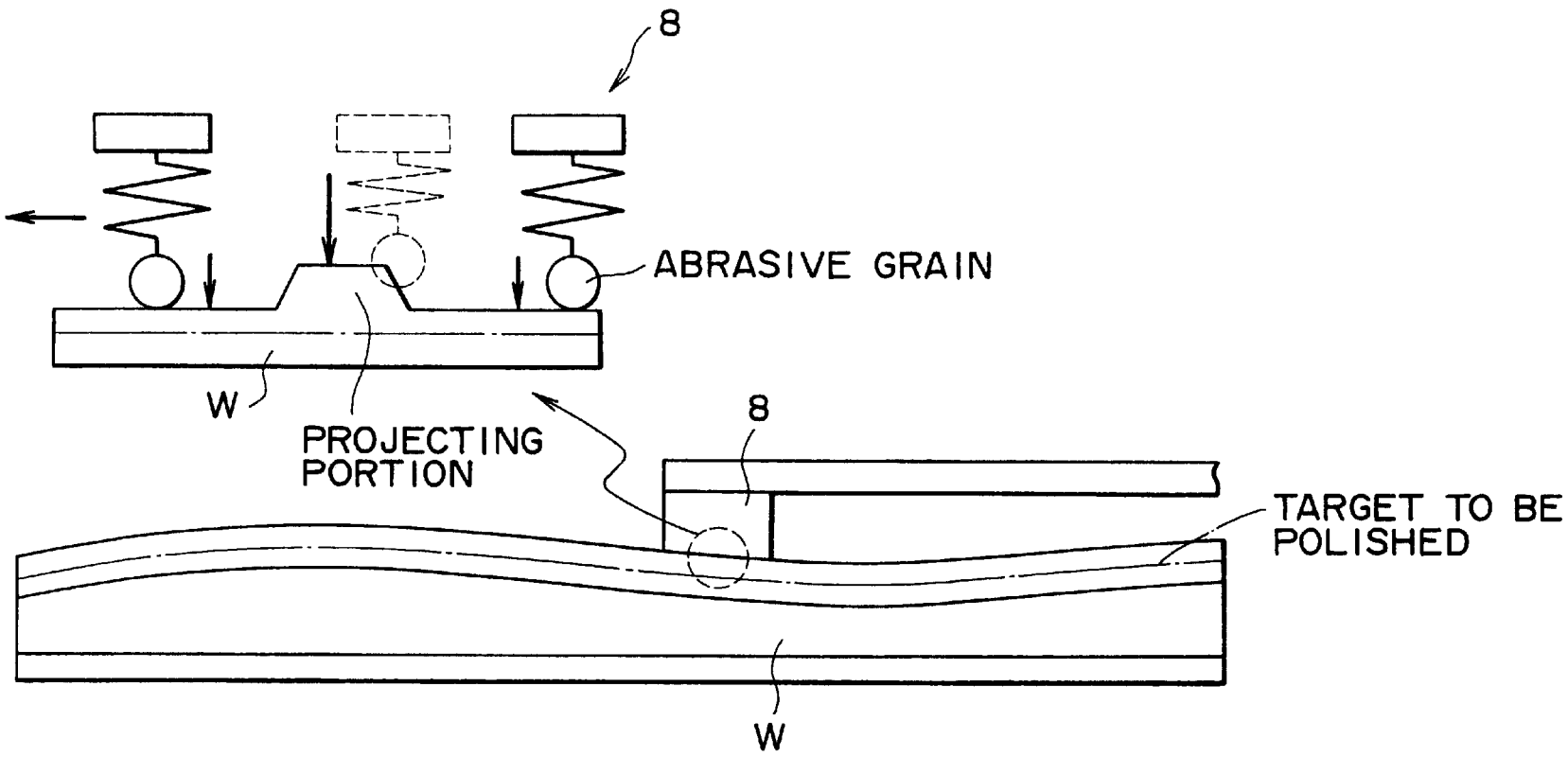
FIG. 20 is a sectional view illustrating a polishing principle of the polishing system according to the third embodiment of the present invention.

To be more specific, as shown in FIG. 20, the polishing pad 8 is displaced relative to the semiconductor wafer W. At this time, when a fine projecting portion appears on the surface of the semiconductor wafer W, it generates a pressing force for displacing abrasive grains of the polishing pad 8. If the abrasive grains are smoothly displaced by the pressing force, the polishing pad 8 is allowed to polish the projecting portion only by an elastic force of the resin changed depending on the displacement of the abrasive grains.

The displacement of the abrasive grains is due to elastic deformation of the binder, and such elastic deformation involves a specific time delay from application of an external force. Accordingly, assuming that the time delay of elastic deformation is expressed by a phase function, by setting a condition in which a phase delay of elastic deformation from generation of an external force by the projecting portion becomes about 180°, the abrasive grains press the projecting portion in such a manner that the projecting portion is displaced in the direction reversed to the direction of the pressing force, to thereby polish the projecting portion. In other words, by displacing the polishing surface of the polishing pad 8 relative to the surface of the semiconductor wafer W at a specific linear velocity or more, the heights of projecting portions can be significantly effectively reduced as compared with the related art polishing process.

On the contrary, the surface of the semiconductor wafer W is largely waved, and accordingly, by setting a condition in which a change in the phase delay which is due to a time delay of displacement of the abrasive grains caused by waviness of the surface of the semiconductor wafer W becomes small, it is possible to displace the abrasive grains along the waviness of the surface of the semiconductor wafer W, and hence to polish the entire surface of the semiconductor wafer W along the waviness of the surface thereof. Concretely, the entire surface of the semiconductor wafer W can be polished along the waviness of the surface thereof by rotating the semiconductor wafer W at a relatively low velocity in such a manner that the region to be polished is displaced on the semiconductor wafer W at a specific velocity or less.

Figure 21A:
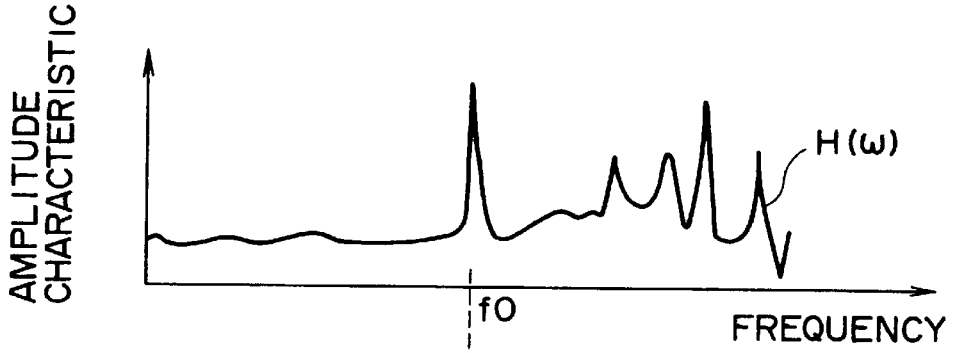
FIGS. 21A and 21B are characteristic curve diagrams each showing a mechanical transmission function.
Figure 21B:
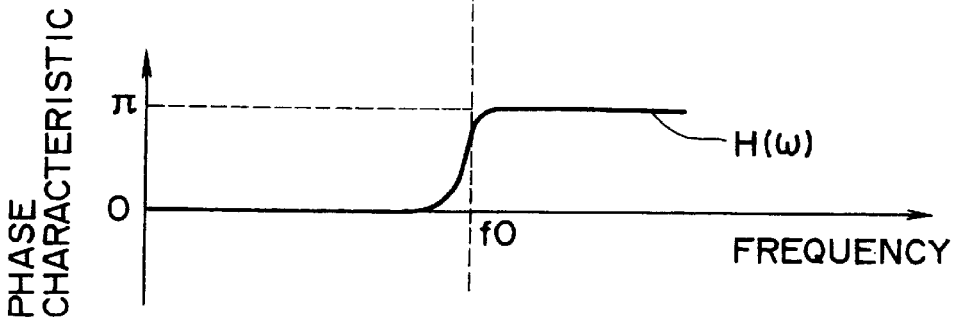

Such a time delay is estimated by a mechanical transfer function between the polishing pad 8 and the semiconductor wafer W. In the third embodiment, an amplitude characteristic of the mechanical transfer function as shown in FIG. 21A is obtained by detecting transmission of vibration generated from an excitation source disposed on the polishing pad 8 side using a pickup disposed on the semiconductor wafer W side. According to such an amplitude characteristic, for a frequency more than the basic resonance frequency of the polishing pad, the phase characteristic is changed about 180°. Thus, by analyzing such an amplitude characteristic, the polishing conditions are set such that the frequency due to the waviness of the surface of the semiconductor wafer W is less than the basic resonance frequency and also the frequency due to fine projecting portions on the surface of the semiconductor wafer W is more than the basic resonance frequency.

Specifically, since one or two large projecting portions due to such waviness are formed on the surface of the semiconductor wafer W, letting N (Hz) be a rotational velocity of the semiconductor wafer W, the frequency due to the waviness becomes about 2N at maximum. In view of the foregoing, in the third embodiment, the elasticity of the polishing pad 8 is set such that the basic resonance frequency $f_0$ becomes about 200 Hz, so that the frequency due to the waviness is set to be less than the basic resonance frequency $f_0$. Further, the frequency due to fine projecting portions on the semiconductor wafer W depending on the rotational velocity of the polishing pad 8 is set to be more than the basic resonance frequency $f_0$. In addition, for the polishing pad 8, the frequency due to the projecting portions is set to be sufficiently high for improving the polishing rate.

The basic resonance frequency $f_0$ is changed depending on wear, a pressing force, a degree of contact, and the like of the polishing pad 8. Further, a polishing rate for the semiconductor wafer W is largely changed depending on a rotational frequency of the semiconductor wafer W (which will be described later). Accordingly, in the third embodiment, a rotational velocity of the semiconductor wafer W is set at 30 r/min (0.5 Hz), so that the basic resonance frequency $f_0$ is set at a value being 200 times or more a frequency of 0.5 to 1 Hz due to waviness of the semiconductor wafer W. With this configuration, even if the polishing condition is variously changed, the semiconductor wafer W can be polished while sufficiently keeping a relationship between the basic resonance frequency $f_0$ and the waviness of the semiconductor wafer W. As an experimental result, it becomes apparent that by setting the basic resonance frequency $f_0$ to be about 10 times the rotational frequency of the semiconductor wafer, the surface of the semiconductor wafer W can be polished along the waviness of the surface and also fine irregularities on the surface can be flattened even if the polishing condition is variously changed, and thereby the surface of the semiconductor wafer W can be practically polished.

In the third embodiment, the polishing pad 8 is formed of a base made from an urethane resin or melamine resin in which abrasive grains of $CeO_2$ are dispersed in such a manner as to form pores therein at a specific ratio. In the polishing pad thus formed, a mixing ratio of a resin or the like is selected in such a manner as to obtain the above-described elastic modulus. For example, the polishing pad 8 formed by suitably selecting the above conditions such as a mixing ratio of a resin exhibits a surface hardness sufficiently higher than that of an urethane foam based polishing pad.

In the polishing pad 8, the porosity is set at 37.4% and the average grain size of abrasive grains is set at about 3.5 $\mu$m.

As a slurry, there is used a water solution in which abrasive grains of $CeO_2$ as a filler are dispersed in an amount of 24.5 wt %. The average grain size of the filler is practically in a range of ⅙ to ⅓ of that of the abrasive grains contained in the polishing pad 8. In the third embodiment, the average grain size of the filler is selected at 0.5 $\mu$m.

Figure 22:
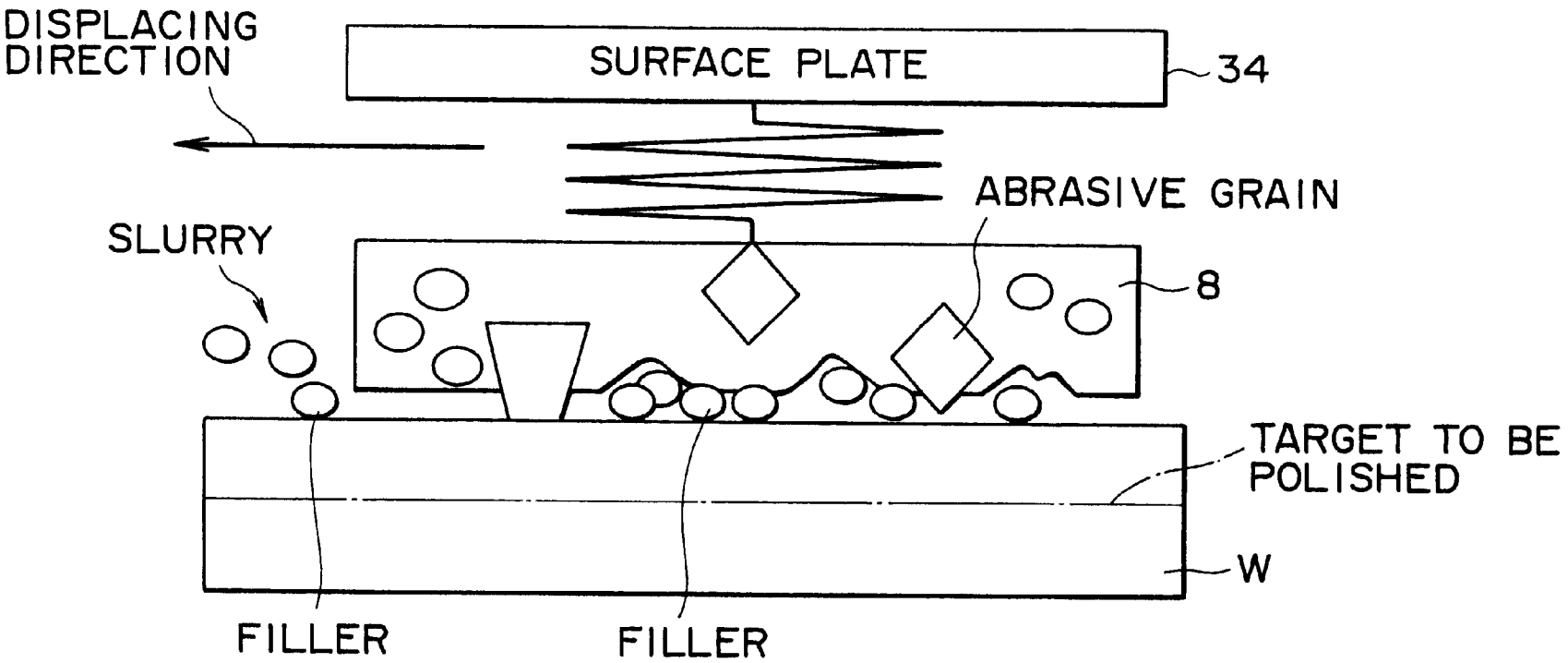
FIG. 22 is a sectional view illustrating polishing using a polishing pad.

As shown in FIG. 22, the polishing pad 8 polishes the semiconductor wafer W using fixed abrasive grains held by the polishing pad 8 and free abrasive grains contained in a slurry supplied to the wafer W. The polishing pad 8, which is polishing the surface of the semiconductor wafer W, allows fixed abrasive grains having fallen by polishing and polished waste having arisen from the wafer W to be escaped in the pores formed in the polishing pad 8. This makes it possible to effectively avoid lowering of the polishing ability. Further, free abrasive grains prevent the pores from being clogged with the polished waste thus escaped in the pores, to thereby effectively avoid lowering the polishing ability.

Figure 23:
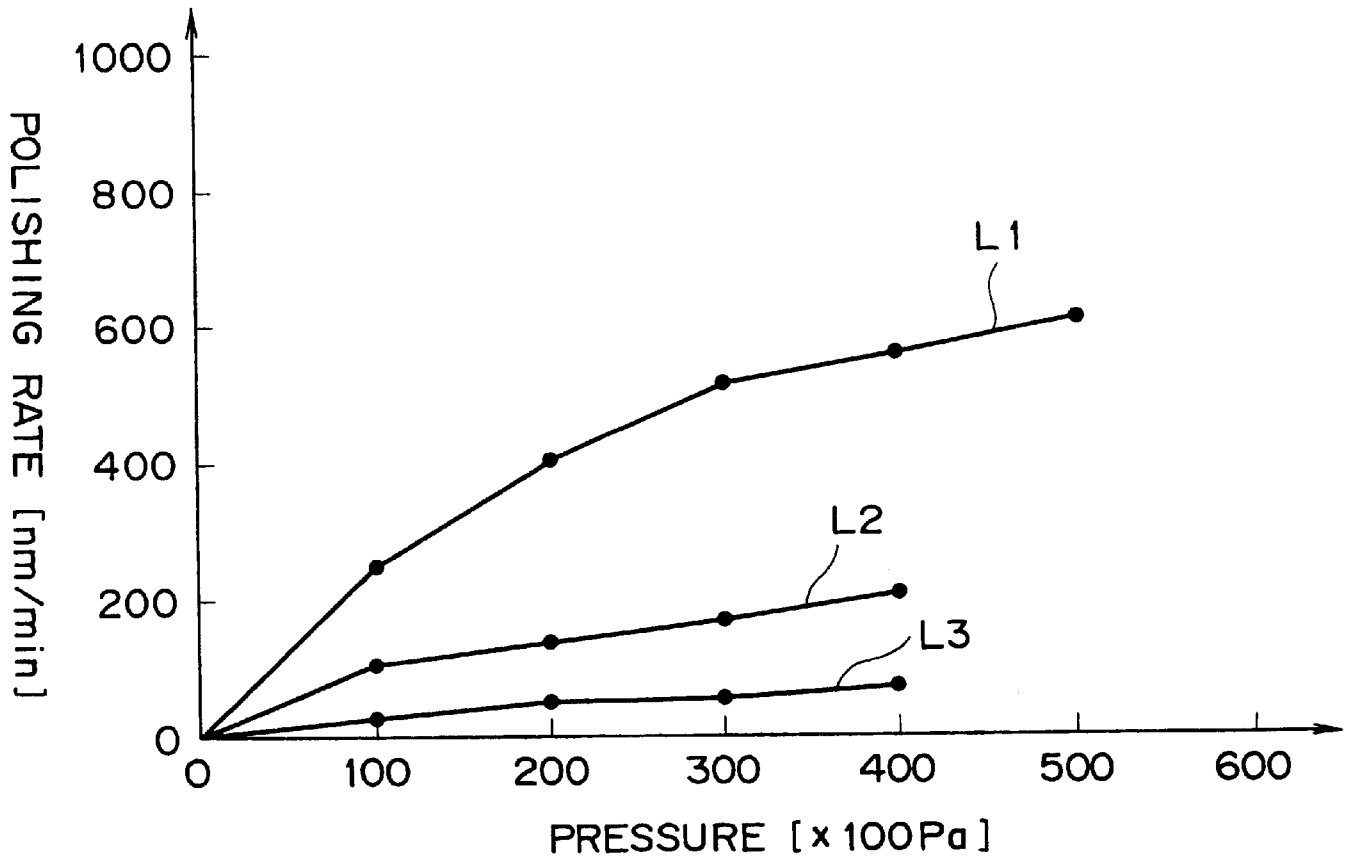
FIG. 23 is a characteristic curve diagram showing a polishing rate.

FIG. 23 is a characteristic curve diagram showing a result of actually polishing test pieces of semiconductor wafers. A curve $L_1$ shows a polishing rate in the case where polishing is performed by the polishing pad 8 with the slurry supplied. A curve $L_2$ shows a polishing rate in the case where polishing is performed only by the polishing pad 8. A curve $L_3$ shows a polishing rate in the case where polishing is performed by a polishing pad containing fixed abrasive grains of $SiO_2$ in place of the fixed abrasive grains of $CeO_2$. From this measured result, it becomes apparent that the polishing pad 8 in combination of the slurry according to the third embodiment can polish the semiconductor wafer at a sufficiently large polishing rate.

Figure 24:
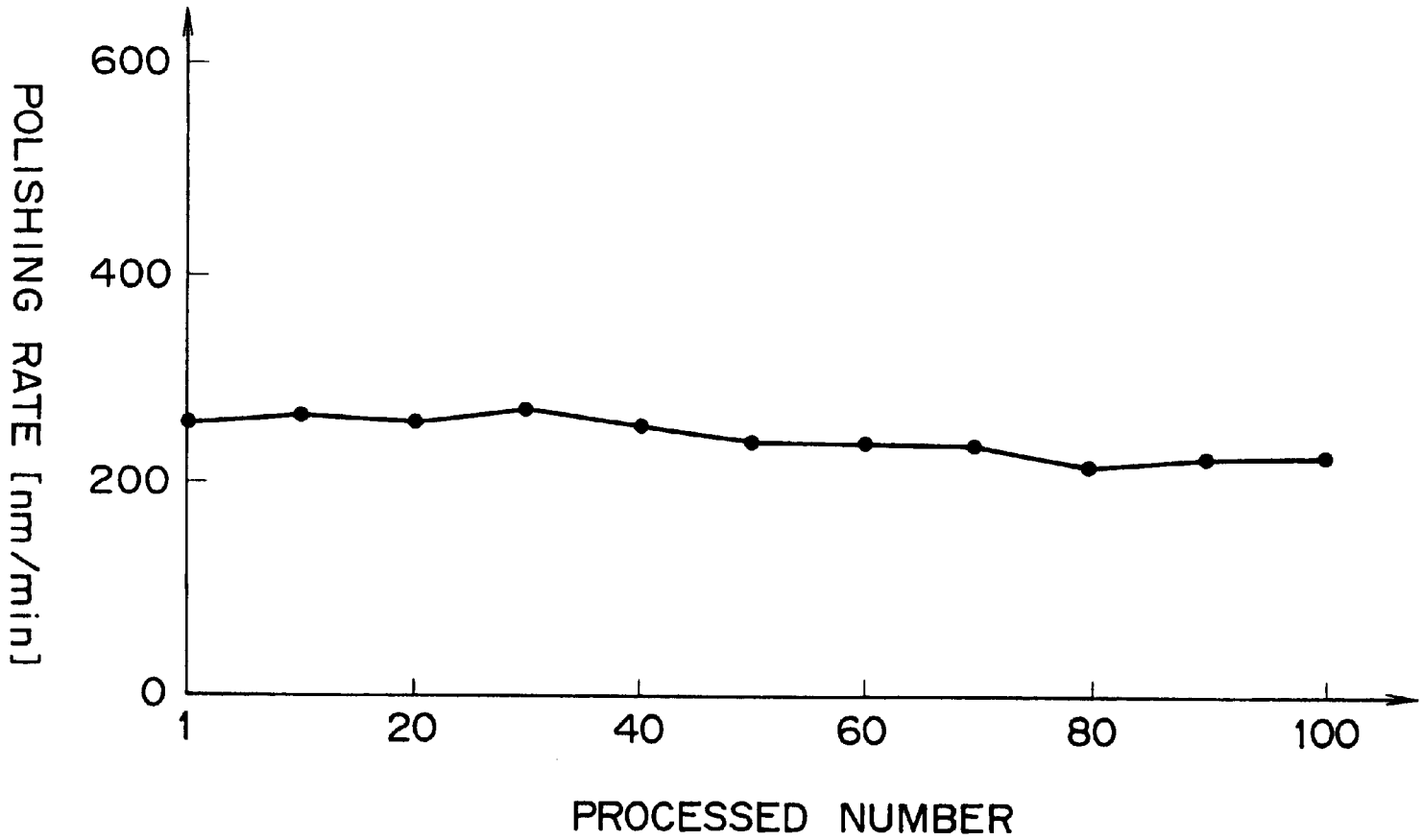
FIG. 24 is a characteristic curve diagram showing a relationship between the number of wafers and a polishing rate.

FIG. 24 is a characteristic curve diagram showing a result of examining a change in polishing rate in the case where a number of semiconductor wafers are polished by the polishing pad 8 in combination of the slurry according to the third embodiment. In this test, each wafer is polished about 120 $\mu$m. From this measured result, it becomes apparent that the polishing pad in combination of the slurry according to the third embodiment can sufficiently suppress the change in polishing rate at a small value. The polishing manner according to the third embodiment, therefore, can be preferably applied to mass-production for semiconductor devices.

Figure 25:
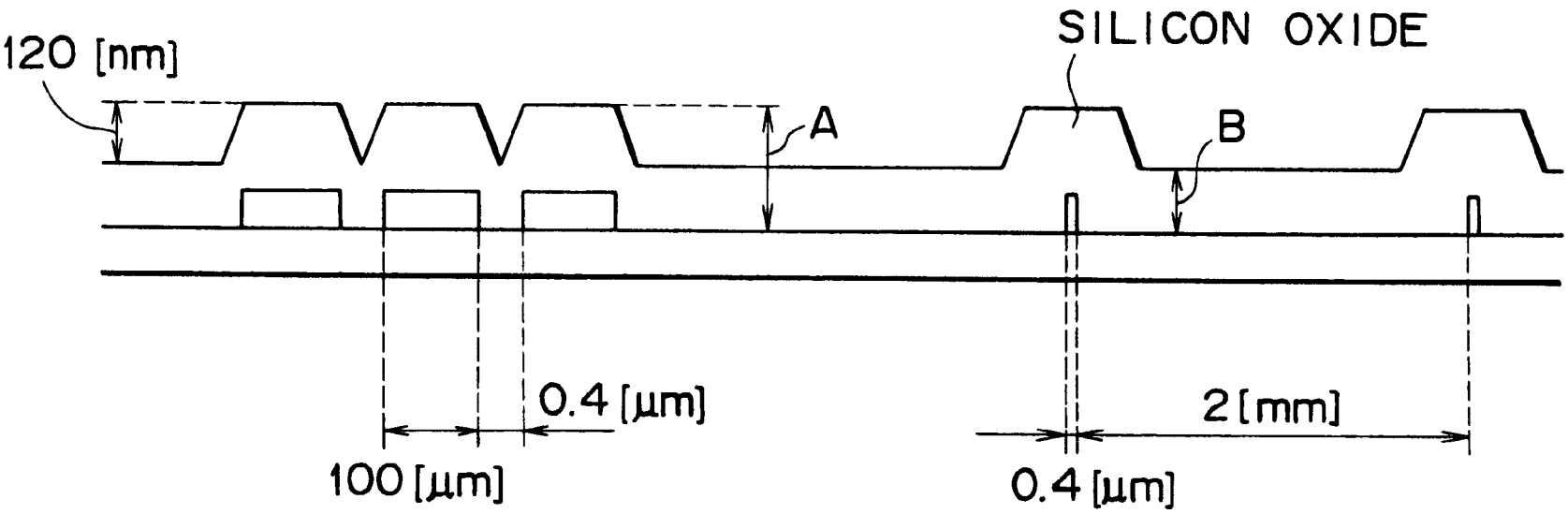
FIG. 25 is a sectional view showing a semiconductor wafer used for a polishing test.

FIG. 25 is a sectional view of a test piece of a semiconductor wafer used for examination of a flattening ability of the polishing system 30. In this test piece of the semiconductor wafer, patterns each having a width of 100 $\mu$m are formed in such a manner as to be spaced at intervals of 0.4 $\mu$m and also patterns each having a width of 0.4 $\mu$m are formed in such a manner as to be spaced at an interval of 2 mm; and an insulating film made from silicon oxide is formed on these pattern. In this test, a step (A-B) on the surface of the semiconductor wafer is measured, where character A indicates a highest portion of the insulating film used as a reference value, and character B is a lowest portion of the insulating film.

Figure 26:
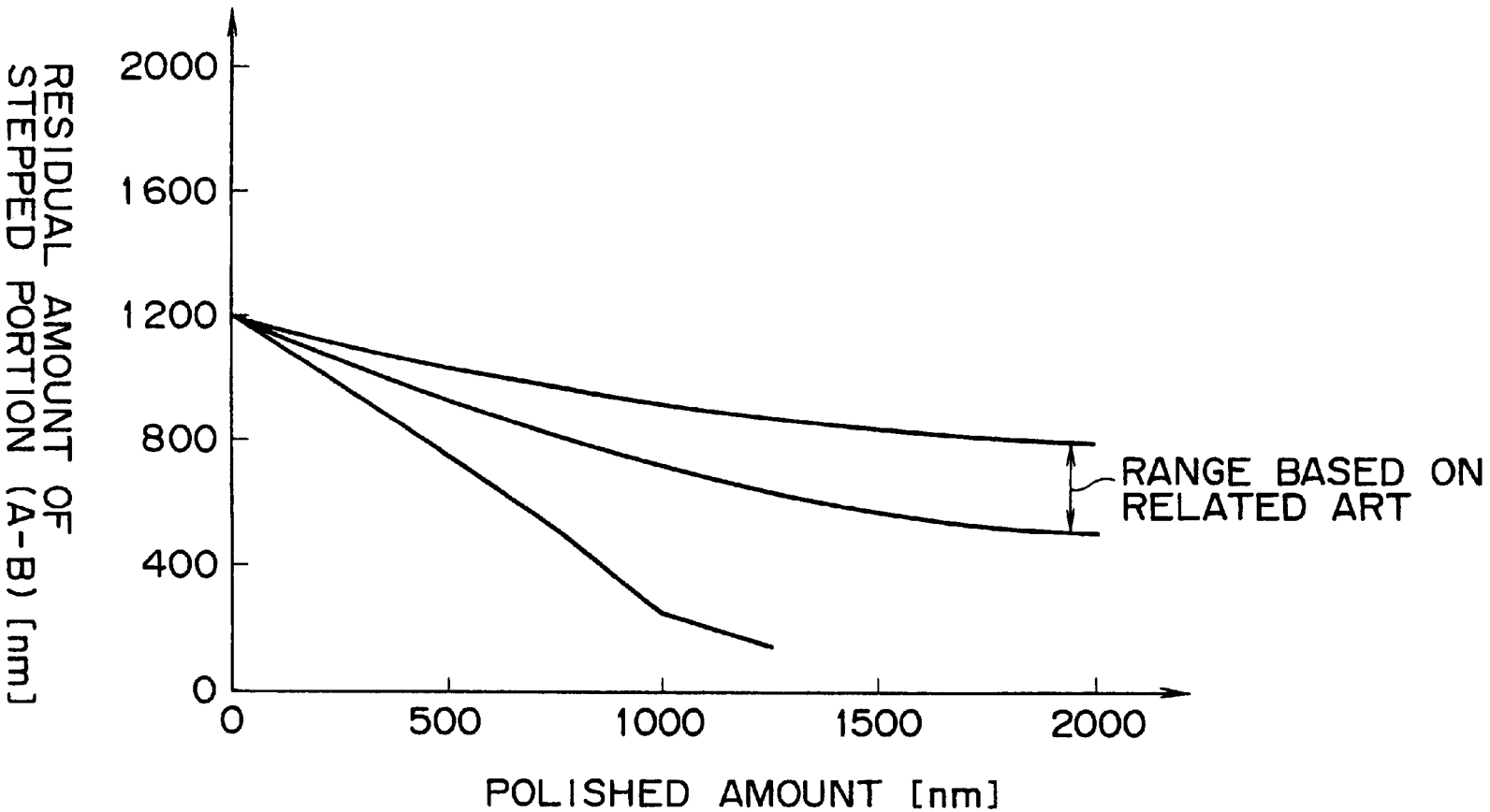
FIG. 26 is a characteristic curve diagram illustrating a polishing ability for a projecting portion.

The step (A-B) is 120 $\mu$m before start of polishing. If only projecting portions of the semiconductor wafer are ideally polished, the step (A-B) should be zero. FIG. 26 is a characteristic curve diagram showing a result of measuring the step (A-B) using the polishing system 30 according to the third embodiment and the related art polishing system. As a result of polishing the test piece to a thickness of 120 $\mu$m using the polishing system 30, a residual amount of the step (A-B) becomes 200 nm or less. Meanwhile, as a result of polishing the test piece in the same manner using the related art polishing system, a residual amount of the step (A-B) is not lowered from a value in a range of 500 to 700 nm. Accordingly, it becomes apparent that in the case of using the polishing system 30, the residual amount of the step on the surface of the semiconductor wafer becomes one-third or less that in the case of using the related art polishing system. In other words, the polishing system 30 can significantly improve the flatness of the surface of the semiconductor wafer as compared with the related art polishing system. In this test, a polished amount is measured by detecting a film thickness through an optical means using a laser beam.

Figure 27A:
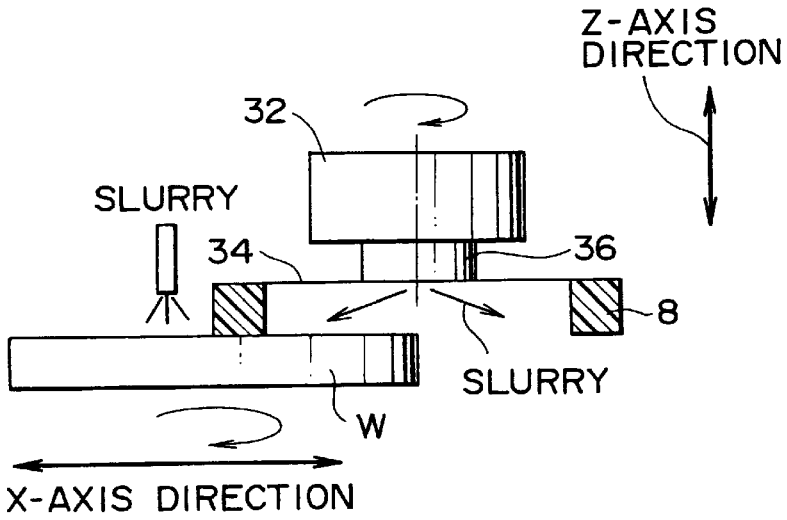
FIGS. 27A and 27B are sectional views showing a relationship between a semiconductor wafer and a polishing pad.
Figure 27B:
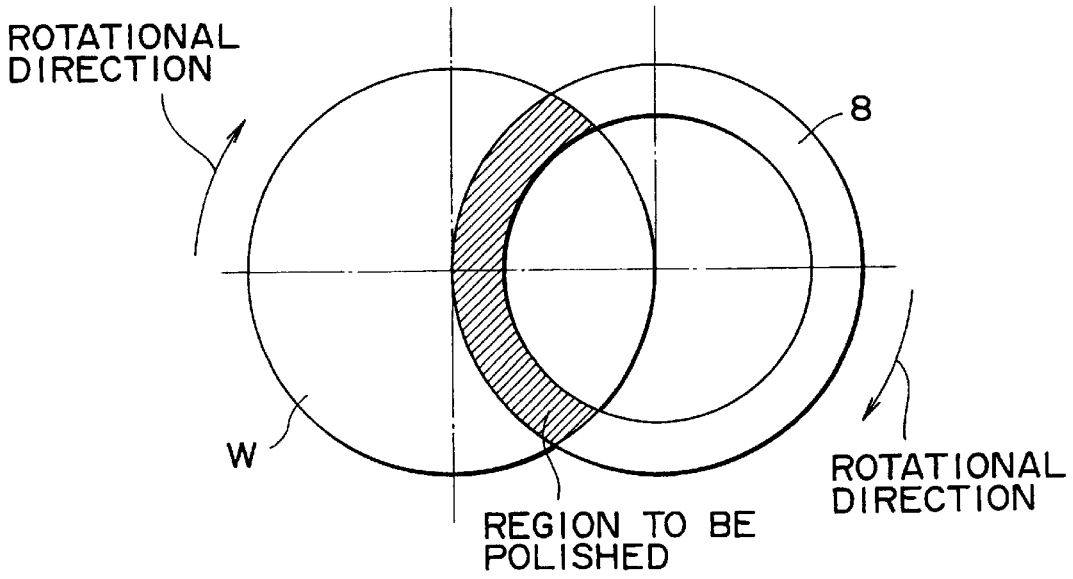

FIGS. 27A and 27B are a sectional view and a plan view showing a relationship between the polishing pad 8 and the semiconductor wafer W, respectively. The polishing pad 8 forms, on the surface of the semiconductor wafer W, an approximately circular-arc region to be polished, and polishes the surface of the semiconductor wafer W at such a region to be polished.

Figure 28A:
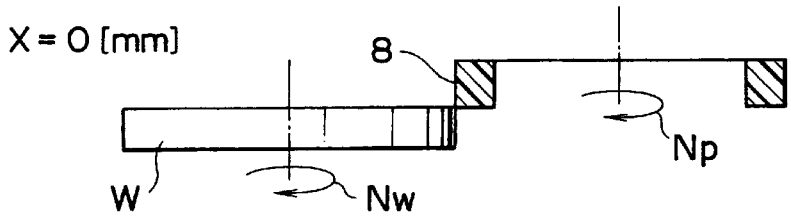
FIGS. 28A to 28D are schematic diagrams each showing displacement of a region to be polished of a semiconductor wafer.
Figure 28B:
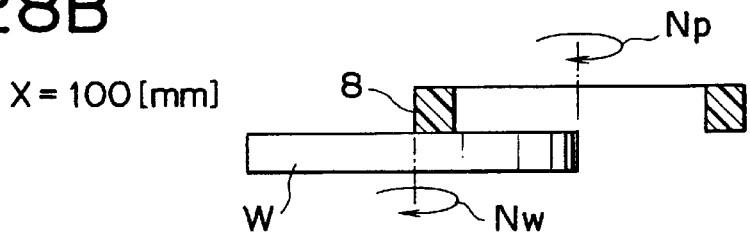
Figure 28C:
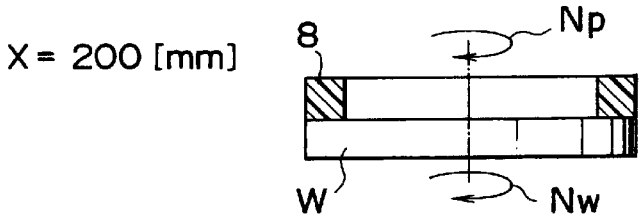
Figure 28D:
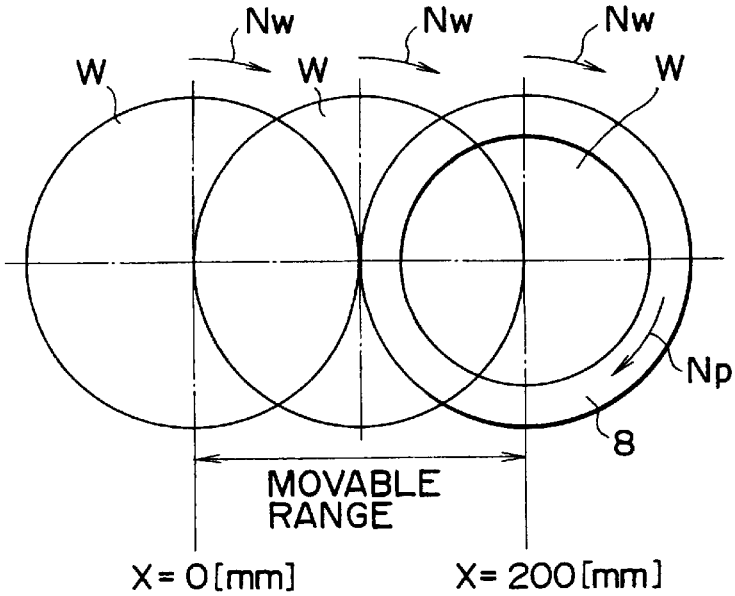

In the third embodiment, as shown in FIGS. 28A to 28D, a region to be polished is changed at a relatively low velocity by reciprocating motion of the X-axis table and rotation of the semiconductor wafer W. Here, a moving velocity of the X-axis table 6 is set at a value in a range of 60 to 140 mm/min, and the reciprocating range of the X-axis table 6 is set at 200 mm. Additionally, in the following description, a point in the X-axis direction at which an outermost periphery of the polishing pad 8 is started to be brought in contact with the surface of the semiconductor wafer W as shown in FIG. 28A is taken as a position of X=0 mm, and a point at which the outermost periphery of the polishing pad 8 substantially corresponds to an outer periphery of the semiconductor wafer W as shown in FIG. 28C is taken as a position of X=200 mm.

In the third embodiment, the polishing pad 8 is rotated at a rotational velocity Np of 300 r/min, and the semiconductor wafer W is rotated at a rotational velocity Nw of 30 r/min.

Mechanism for Adjusting Tilting Angle of Main Shaft

Figure 29:
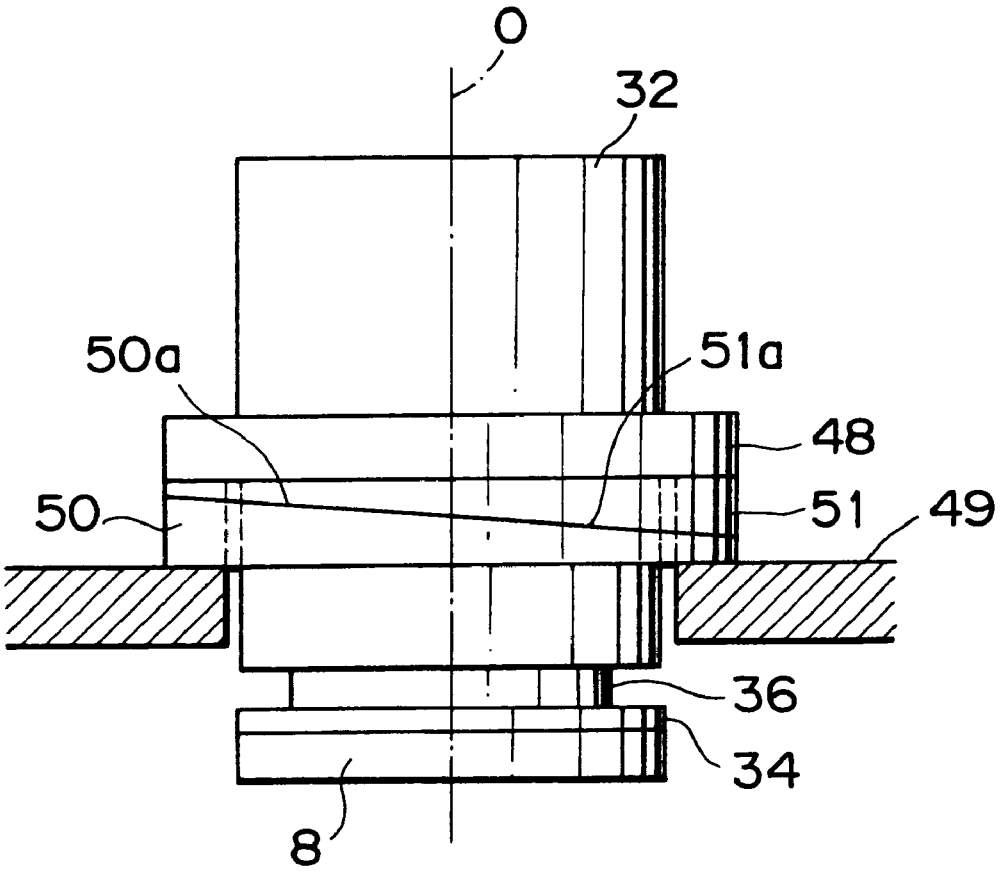
FIG. 29 is a side view showing a mechanism for adjusting tilting of a main shaft.

FIG. 29 is a front view showing a mechanism for holding a main spindle 32. The main spindle 32 is held on a Z-axis slider 73 (see FIGS. 2A to 2C) through a main shaft mounting seat 49, to be thus movable in the Z-axis direction together with the Z-axis slider 73 by a Z-axis servo motor 74 (see FIGS. 2A to 2C). Also, tilting of a rotational axis of the main spindle 32 can be adjusted in a micro-angle range by a mechanism for adjusting a tilting angle of the main shaft, to thereby set a polishing condition most suitable for the polishing system 30 by adjusting the tilting of the rotational axis of the main spindle 32.

The main spindle 32 is fixed on the main shaft mounting seat 49 through a main shaft flange 48 and taper rings 50 and 51. The taper rings 50 and 51, each of which is formed into a ring shape, are laminated on the main shaft mounting seat 49, and the main shaft flange 48 is disposed on the laminated taper rings 50 and 51. The taper rings 50 and 51 are disposed substantially coaxially with the rotational center axis of the main spindle 32, and are pressed and held on the main shaft mounting seat 49 by the main shaft flange 48 in such a manner as to be turnable around the rotational axis of the main spindle 32. That is, the main spindle 32 is fixed on the main shaft mounting seat 49 through the main shaft flange 48, with the taper rings 50 and 51 turnably disposed between the main shaft flange 48 and the main shaft mounting seat 49.

Figure 30A:
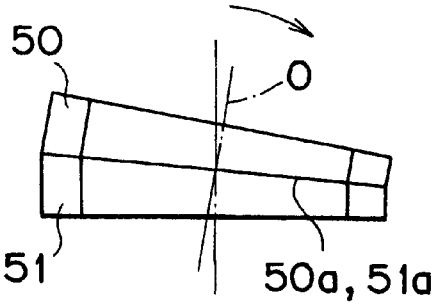
FIGS. 30A to 30C are schematic diagrams illustrating operation of the tilting adjusting mechanism.
Figure 30B:
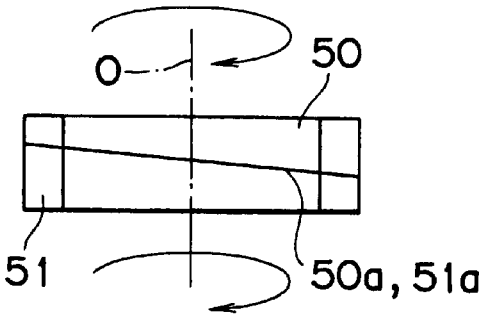
Figure 30C:
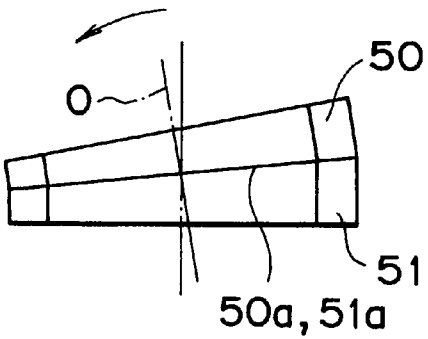

The taper rings 50 and 51, when seen in the transverse direction, have taper surfaces 50*a* and 51*a* tilted with respect to the rotational center axis O of the main spindle 32, respectively. With this configuration, as shown in FIG. 30, the rotational center axis O of the main spindle 32 can be tilted in various directions.

The taper rings 50 and 51 are configured that the thickness thereof, seen in the transverse direction, is changed 5 $\mu$m at maximum by adjustment of the taper surfaces 50*a* and 51*a*. Thus, in the third embodiment, the rotational center axis P can be adjusted in a micro-angle range. Further, the rotational center axis O can be tilted only in the X-axis direction, and consequently, even when the rotational center axis O is tilted, the rotational center axis O, and operating points P of load cells 81 (see FIGS. 2A to 2C) can be held on the same plane, to thereby effectively avoid lowering of a detection accuracy of the load cells 81.

In the polishing system 30, since the taper rings 50 and 51 are in contact with each other at the taper surfaces 50*a* and 51*a*, even in a state in which the taper rings 50 and 51 are interposed between the main spindle 32 and the main shaft mounting seat 49, lowering of a mechanism rigidity between the main spindle 32 and the main shaft mounting seat 49 can be effectively avoided. As a result, in the polishing system 30, it is possible to effectively avoid lowering of a natural frequency of a mechanical system between the main spindle 32 and the main shaft mounting seat 49 and hence to rotate a main shaft 36 at a relatively high velocity.

Figure 31:
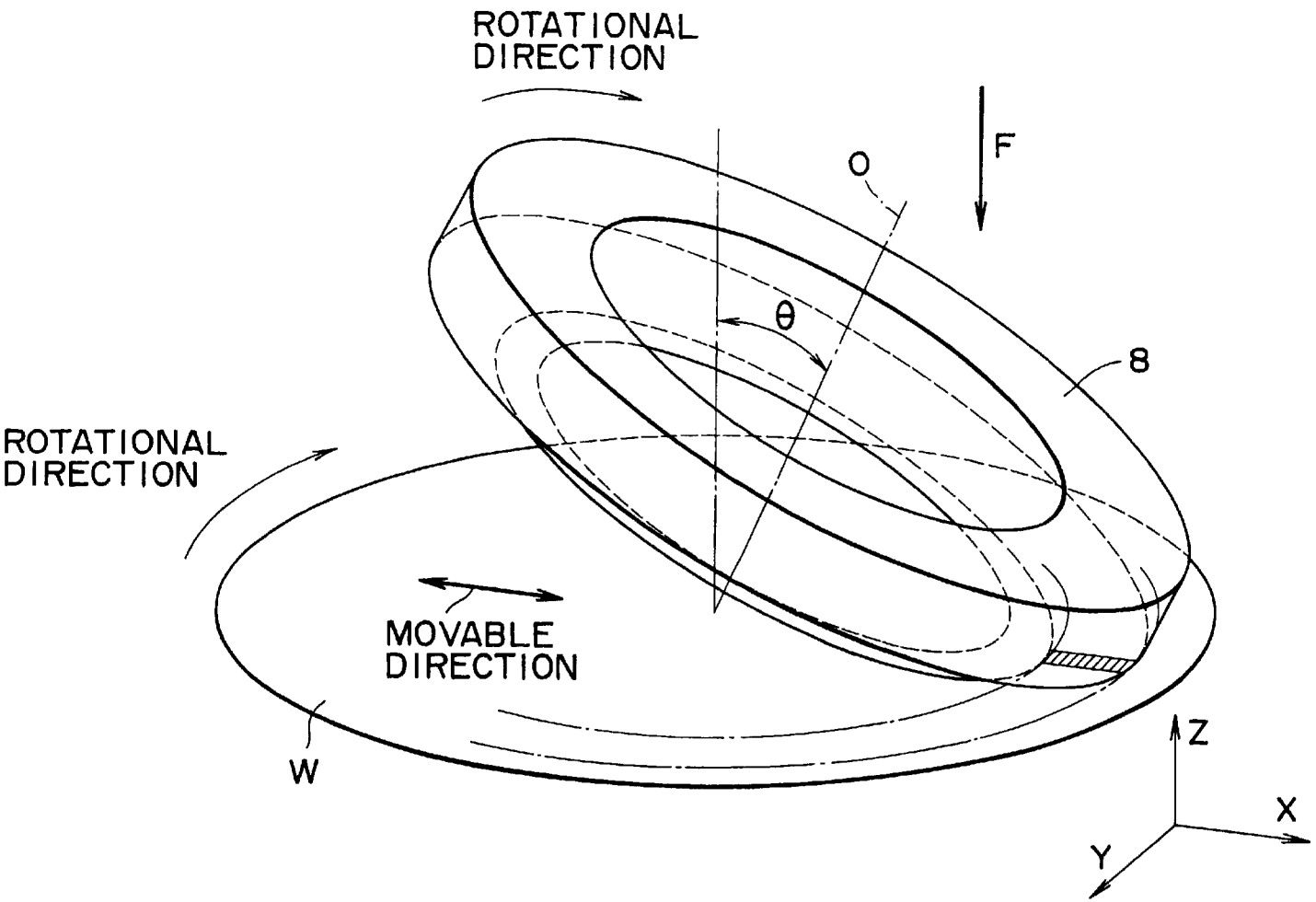
FIG. 31 is a schematic diagram showing tilting of a polishing pad tilted by the tilting adjusting mechanism.
Figure 32:
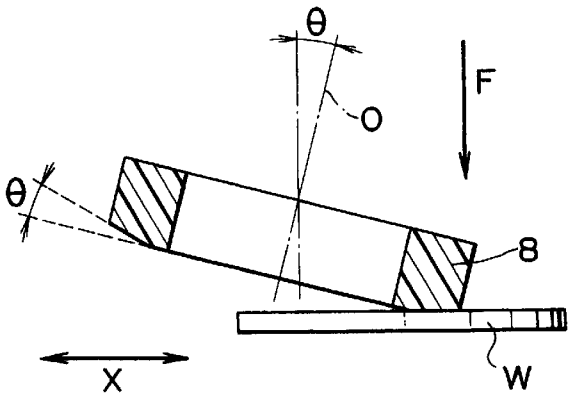
FIG. 32 is a sectional view of FIG. 31.
Figure 33A:
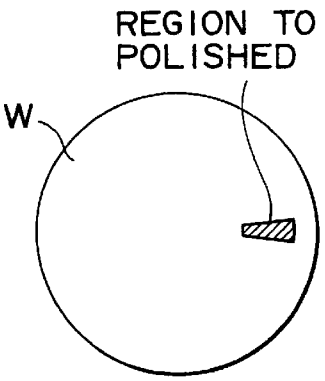
FIGS. 33A to 33C are schematic views showing a relationship between tilting of a polishing pad and a region to be polished.
Figure 33B:
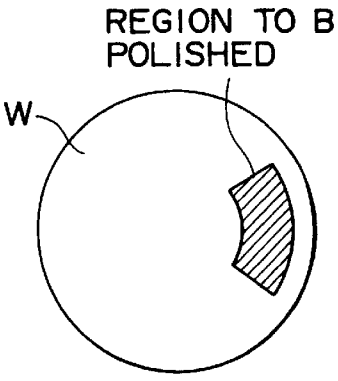
Figure 33C:
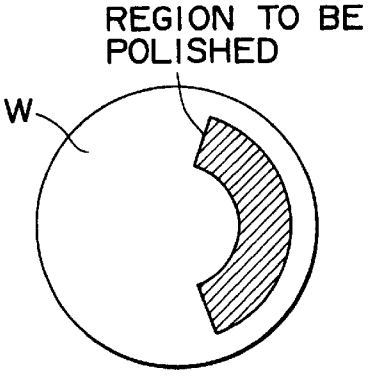

FIGS. 31, 32 and 33 are diagrams each showing a relationship between the polishing pad 8 and the semiconductor wafer W depending on tilting the rotational center axis O. A shape of the polishing pad 8 elastically deformed by a pressing force F is changed depending on tilting of the rotational center axis O, so that an area of a region to be polished formed on the semiconductor wafer W is variously changed. That is, the larger the tilting of the rotational center axis O, the smaller the area of the region to be polished; and the smaller the tilting of the rotational center axis O, the larger the area of the region to be polished. In the third embodiment, the polishing condition can be thus optimized by adjusting the area of the region to be polished by means of suitably selecting the tilting of the rotational center axis O.

To be more specific, a mechanical transmission function between the polishing pad 8 and the semiconductor wafer W is changed not only depending on the elasticity of the polishing pad 8 but also depending on a wafer diameter of the semiconductor wafer W and the area of the region to be polished. Accordingly, by adjusting the tilting angle θ of the rotational center axis, a condition necessary for selectively polishing fine projecting portions of the semiconductor wafer W can be finely adjusted.

The area of the region to be polished also exerts a large effect on a polishing time required for polishing of one piece of semiconductor wafer W. Accordingly, a polished amount per unit time can be finely adjusted by changing the area of the region to be polished. Further, a distribution of a slurry can be equalized by adjustment of the polished amount per unit time, and thereby a variation in polishing rate can be reduced.

In the case where the rotational center axis is tilted a micro-angle θ, a polishing surface of the polishing pad 8 is required to be obliquely cut in accordance with the tilting angle θ using a facing tool.

Mechanism for Correcting Offset of Polishing Pressure

In the third embodiment, as described with reference to FIGS. 2A to 2C, the rotational center axis O and the operating points P of the load cells 81 are held on the same plane, and consequently, if the X-axis table 6 is only reciprocated relative to the polishing pad 8, a distribution of a pressing force at a region to be polished is changed depending on a position of the X-axis table 6.

Figure 34A:
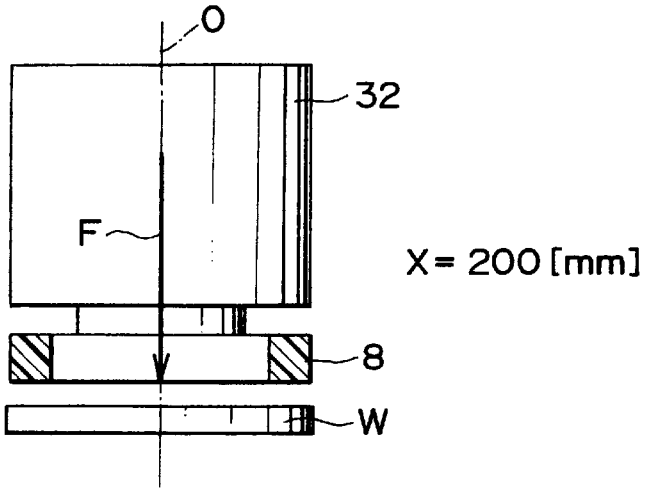
FIGS. 34A to 34C are schematic diagrams illustrating a distribution of a pressing force in the case where a polishing pad is overlapped on a semiconductor wafer.
Figure 34B:
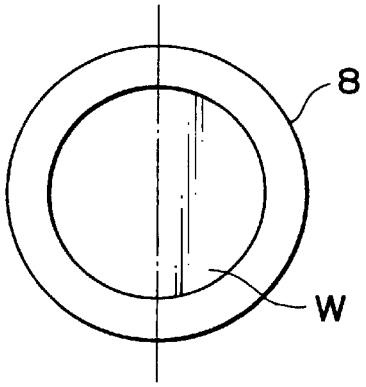
Figure 34C:
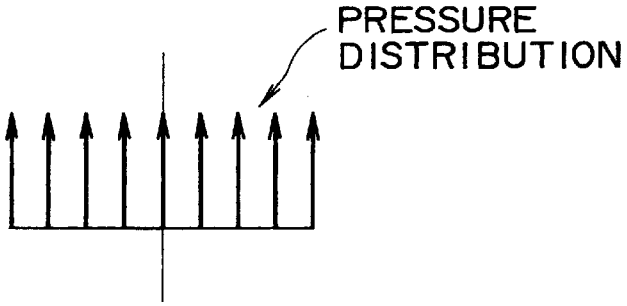
Figure 35A:
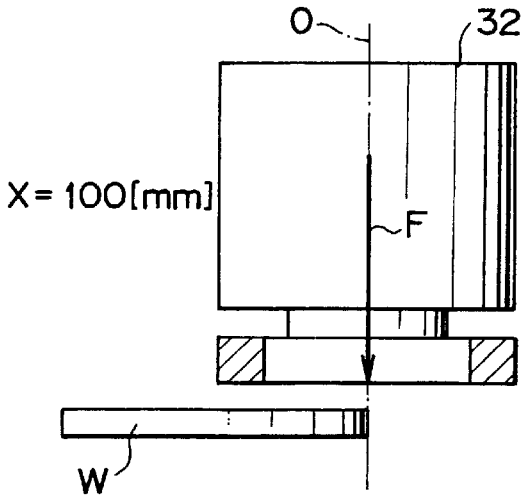
FIGS. 35A to 35C are schematic diagrams illustrating a distribution of a pressing force in the case where the semiconductor wafer from the case shown in FIGS. 34A to 34C.
Figure 35B:
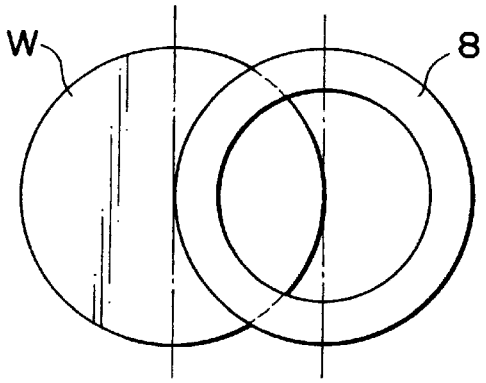
Figure 35C:
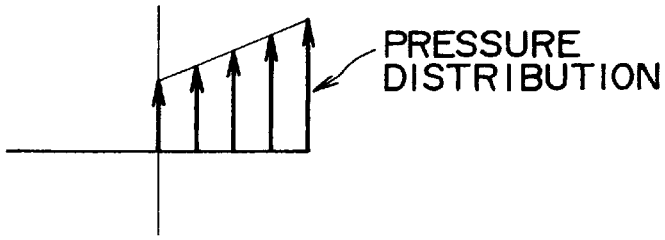
Figure 36A:
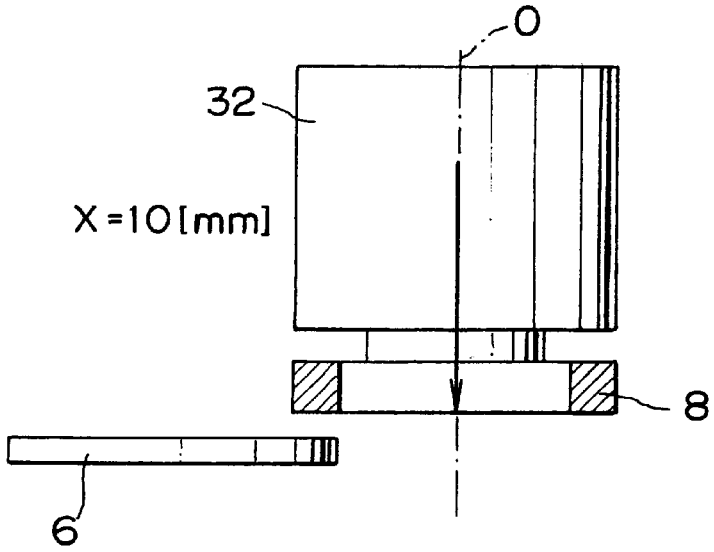
FIGS. 36A to 36C are schematic diagrams illustrating a distribution of the pressing force in the case where the semiconductor wafer is further displaced from the case shown in FIGS. 35A to 35C.
Figure 36B:
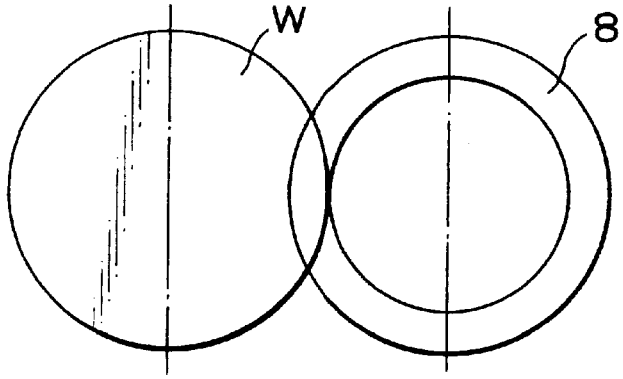
Figure 36C:
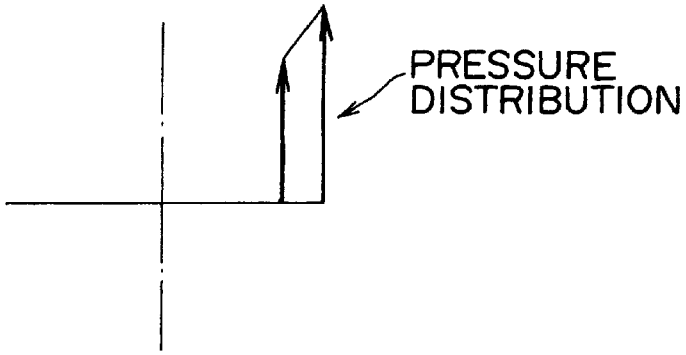

As shown in FIGS. 34A to 34C, if the rotational center axis O is not tilted, in the case where the polishing pad 8 is perfectly overlapped onto the semiconductor wafer W (see FIGS. 34A and 34B), the polishing pad 8 is pressed, at the region to be polished, on the semiconductor wafer W under a uniform pressure distribution. However, as shown in FIGS. 35A to 35C and FIGS. 36A to 36C, when the X-axis table 6 is displaced on this side of the polishing system 30, the region to be polished is correspondingly displaced on this side from the rotational center axis O, as a result of which the pressure distribution becomes uneven.

In this case, a portion of the semiconductor wafer W on the outer peripheral side near the rotational center axis O is pressed by the polishing pad 8 at a higher pressing force, so that a polishing rate at such a portion becomes larger. For such a uneven distribution of a pressing force offset on the rotational center axis O side, the semiconductor wafer W is reciprocated offset on this side from the rotational center axis O. This causes an inconvenience that polished amounts at positions on the surface of the semiconductor wafer W becomes uneven due to uniformity of non-uniformity of the pressing force.

To cope with such an inconvenience, as shown in FIGS. 37A to 37D, a dead weight 54 is disposed on this side in the X-axis direction, that is, the reciprocating direction of the semiconductor wafer W, for example, on the main spindle 40. This is effective to shift the distribution of the pressing force offset on the rotational center axis O side on this side from the rotational center axis O (see FIGS. 37A and 37D).

Figure 37A:
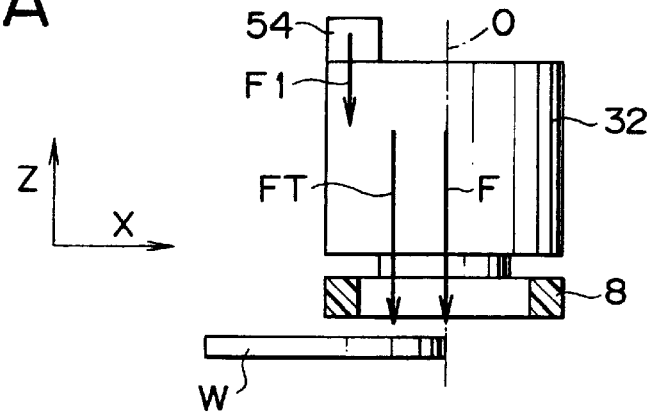
FIGS. 37A to 37D are schematic diagrams illustrating a dead weight.
Figure 37B:
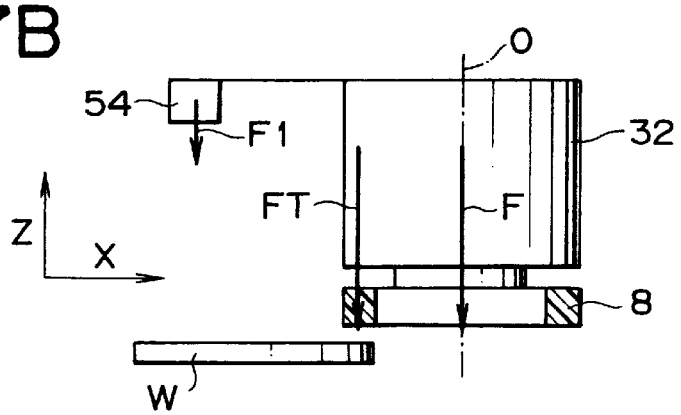
Figure 37C:
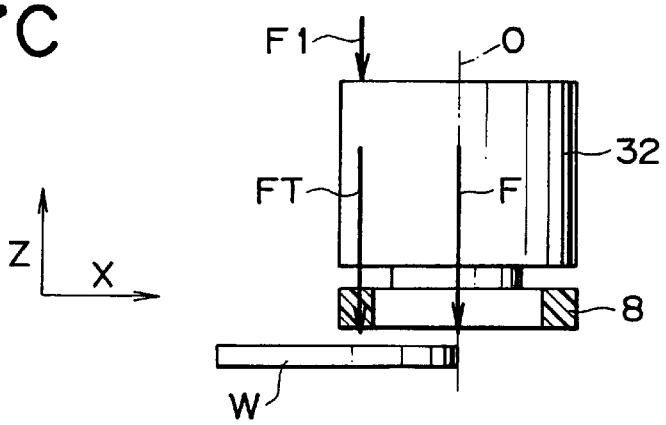
Figure 37D:
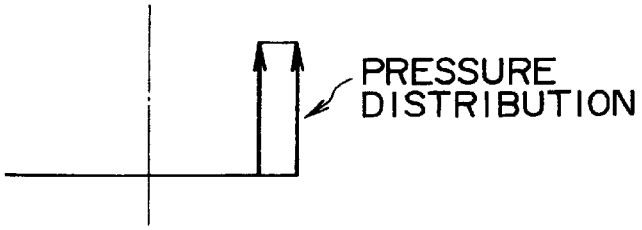

As shown in FIG. 37B, by holding the dead weight 54 by way of an arm on this side from the upper portion of the main spindle 32, the distribution of the pressing force offset on the rotational center axis O side can be shifted on this side from the rotational center axis O side (see FIGS. 37B and 37D). Further, even by shifting the main spindle 32 holding position of the Z-axis slider 73 on this side from the rotational center axis O, the distribution of the pressing force can be shifted on this side from the rotational center axis O (see FIGS. 37C and 37D).

Thus, in the polishing system 30 according to the third embodiment, the offset of the pressing force can be suitably adjusted as needed by suitably adjusting tilting of the main shaft and arrangement of the dead weight 54, thereby enabling polishing under a suitable condition.

Control of Velocity of X-axis Table

Figure 38A:
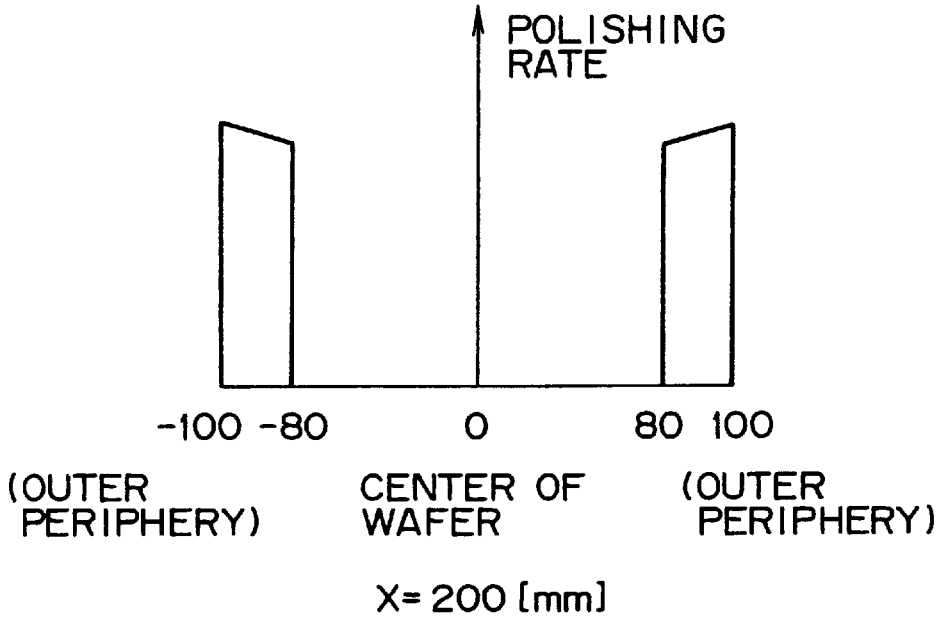
FIGS. 38A and 38B are characteristic curve diagrams showing a distribution of a polishing rate for a polishing pad.

As shown in FIG. 38A, in the case where the polishing pad 8 is perfectly overlapped on the semiconductor wafer W in the polishing system 30, only a peripheral portion of the semiconductor wafer W is polished. At this time, since a linear velocity of the polishing pad 8 relative to the semiconductor wafer W is higher on the outer peripheral side of the semiconductor wafer W, the polishing rate becomes larger on the outer peripheral side.

Figure 38B:
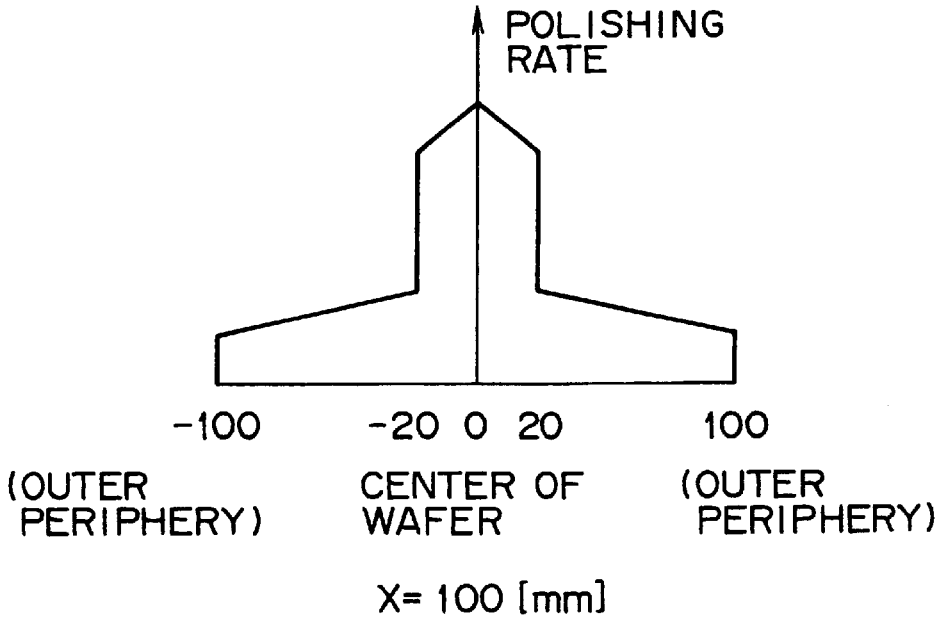

On the contrary, as shown in FIG. 38B, in a state in which the X-axis table is displaced 100 mm from the state shown in FIG. 38A, the polished amount is larger in a range of a radius ±20 mm around the center of the semiconductor wafer W. Accordingly, if the X-axis table is only reciprocated at a constant velocity; the polishing pad 8 is pressed at a specific pressing force; and each of the semiconductor wafer W and the polishing pad 8 is rotated at a specific velocity, it is difficult to uniformly polish the entire surface of the semiconductor wafer W.

Figure 39A:
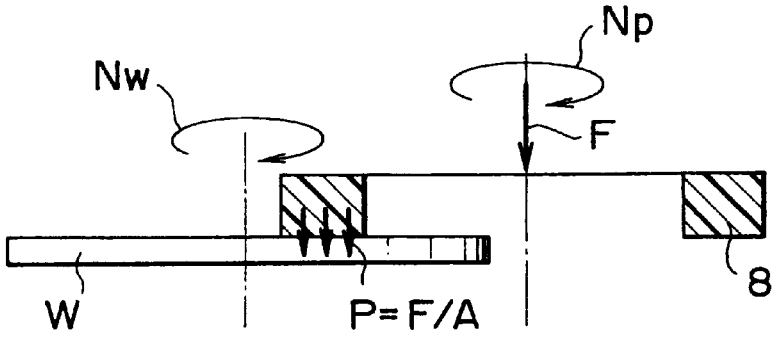
FIGS. 39A and 39B are schematic diagrams showing a relationship between a rotational velocity of a polishing pad and a rotational velocity of a semiconductor wafer.
Figure 39B:
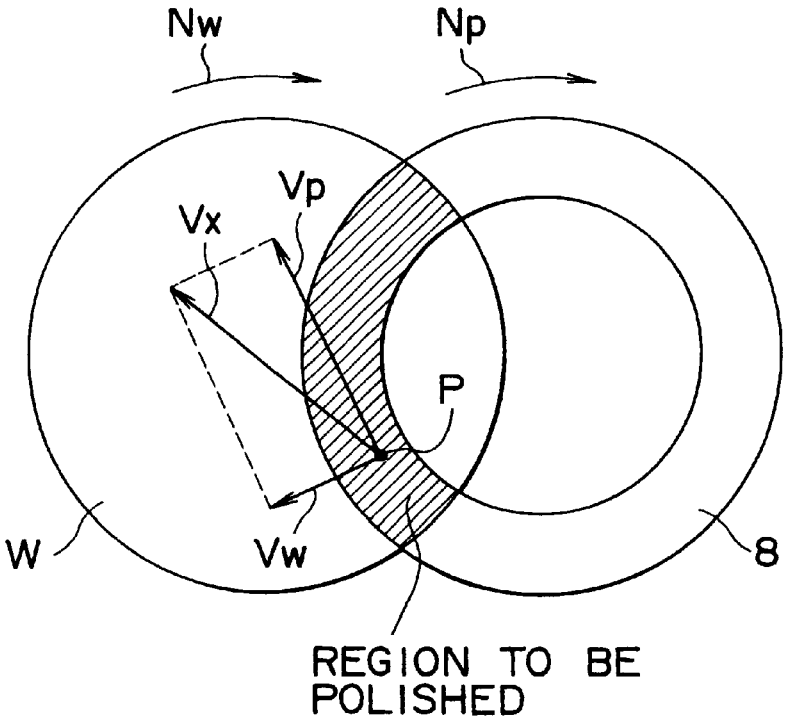

Assuming that a rotational velocity of the polishing pad 8 is taken as Np; a rotational velocity of the semiconductor wafer W is taken as Nw; and linear velocities at specific positions of the polishing pad 8 and the semiconductor wafer W corresponding to the rotational velocities Np and Nw are taken as Vp and Vw respectively, as shown in FIGS. 39A and 39B, a relative velocity Vx between the polishing pad 8 and the semiconductor wafer W at a specific position P in the region to be polished is expressed by vector synthesis of the linear velocities Vp and Vw.

Using such a relative velocity Vx, a polished amount H(x) at a time t in the case where the X-axis table is held at a specific position is given by the following equation:

$$H(x)=Kp\times Px\times Vx\times t \tag{4}$$

where Kp is a proportional constant and Px is a polishing pressure.

The polishing pressure Px is also given by the following equation:

$$Px=F/A \quad (5)$$

where F is the entire pressing force of the polishing pad 8 and A is an area of the region to be polished at which the polishing pad 8 is in contact with the semiconductor wafer W.

Accordingly, a polished amount at each portion of the semiconductor wafer W can be controlled by changing the relative velocity Vx through control of the rotational velocities Np and Nw, the pressing force F of the polishing pad 8, and the time t through control of the movement velocity of the X-axis table.

Figure 40A:
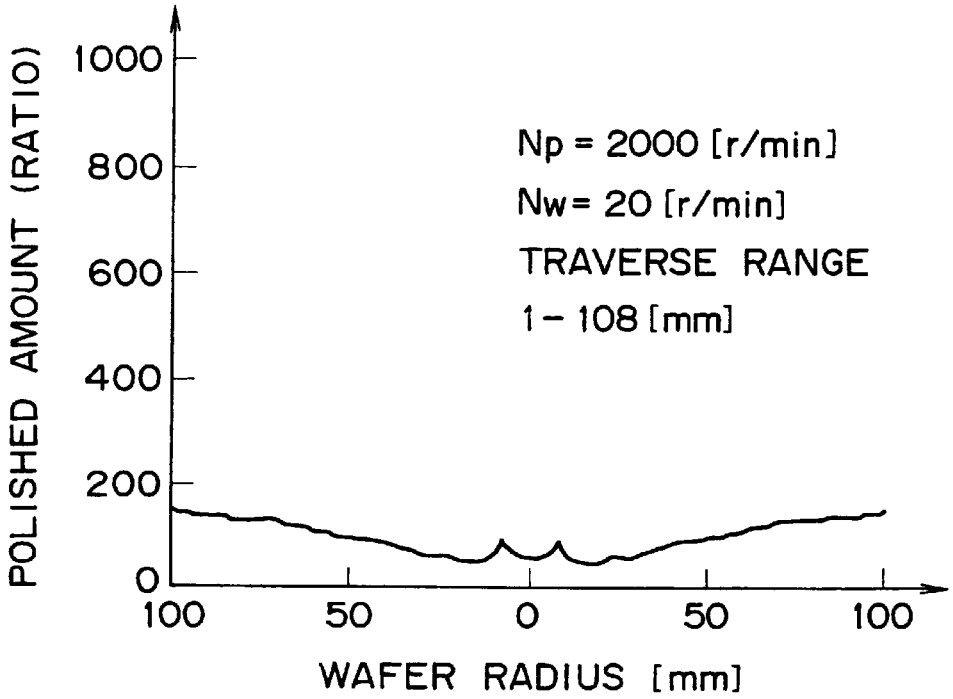
FIGS. 40A and 40B are characteristic curve diagrams showing a relationship between reciprocating motion of a semiconductor wafer and polished amount.
Figure 40B:
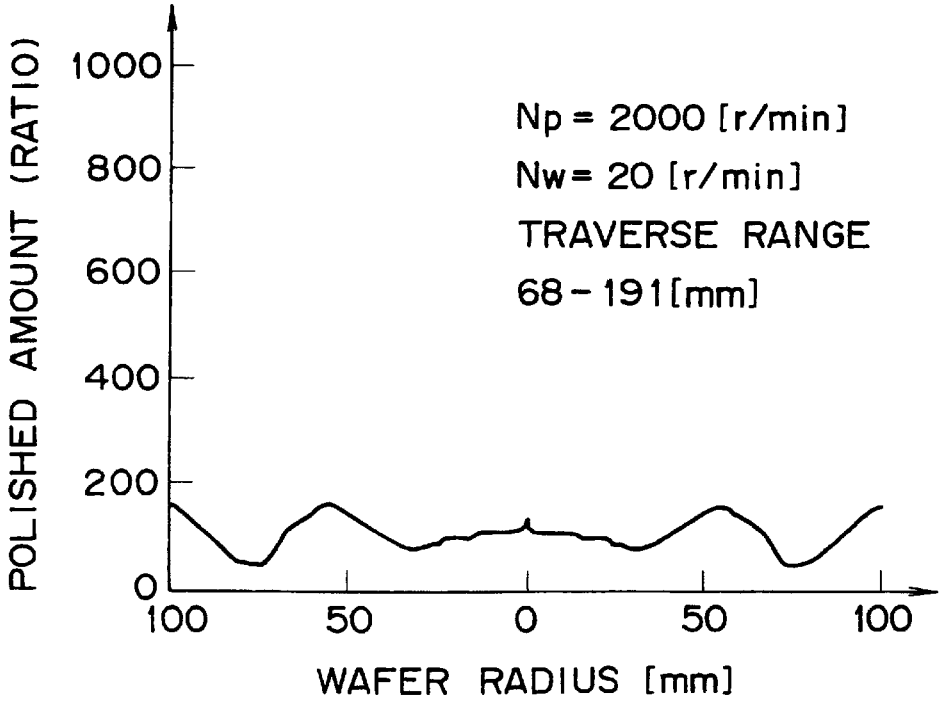

FIGS. 40A and 40B are characteristic curve diagrams each showing a result of calculating the polished amount H(x) under the above equations (3) and (4) in the case where the X-axis table is reciprocated at a constant velocity and the polishing pressure Px, rotational velocity Np of the polishing pad 8, and rotational velocity Nw of the semiconductor wafer W are kept constant. FIG. 40A shows the polished amount H(x) in the case where a movement range (traverse range) of the semiconductor wafer W is set at a range of 1 mm to 108 mm (X-coordinate position); and FIG. 40B shows the polished amount H(x) in the case where the traverse range is set at a range of 68 mm to 191 mm. In each case, it is apparent that the polished amount varies depending on the radius of the semiconductor wafer W.

On the contrary, Table 2 shows a result obtained by dividing the movable range of the X-axis table into movement units of 10 mm and calculating, under the above equations (4) and (5), a condition of setting a variation in polished amount depending on the radius of the semiconductor wafer W at a specific value or less in the movement unit of 10 mm. In this calculation, the rotational velocities of the semiconductor wafer W and the polishing pad 8 are set at the same values as those in the case described with reference to FIGS. 40A and 40B.

TABLE 2

| | polishing pad: 2,000 r/min<br>wafer: 20 r/min |
|---|---|
| X-coordinate position (mm) | polishing time rate (magnification of inverse of feed velocity based on reference value) |
| 0–10 | 2.3 |
| 10–20 | 2.4 |
| 20–30 | 3.74 |
| 30–40 | 2 |
| 40–60 | 1.39 |
| 60–80 | 1.77 |
| 80–100 | 1.8 |
| 100–120 | 1.27 |
| 120–140 | 0.79 |
| 140–160 | 0.8 |
| 160–180 | 0.77 |
| 180–200 | 0 |

Figure 41:
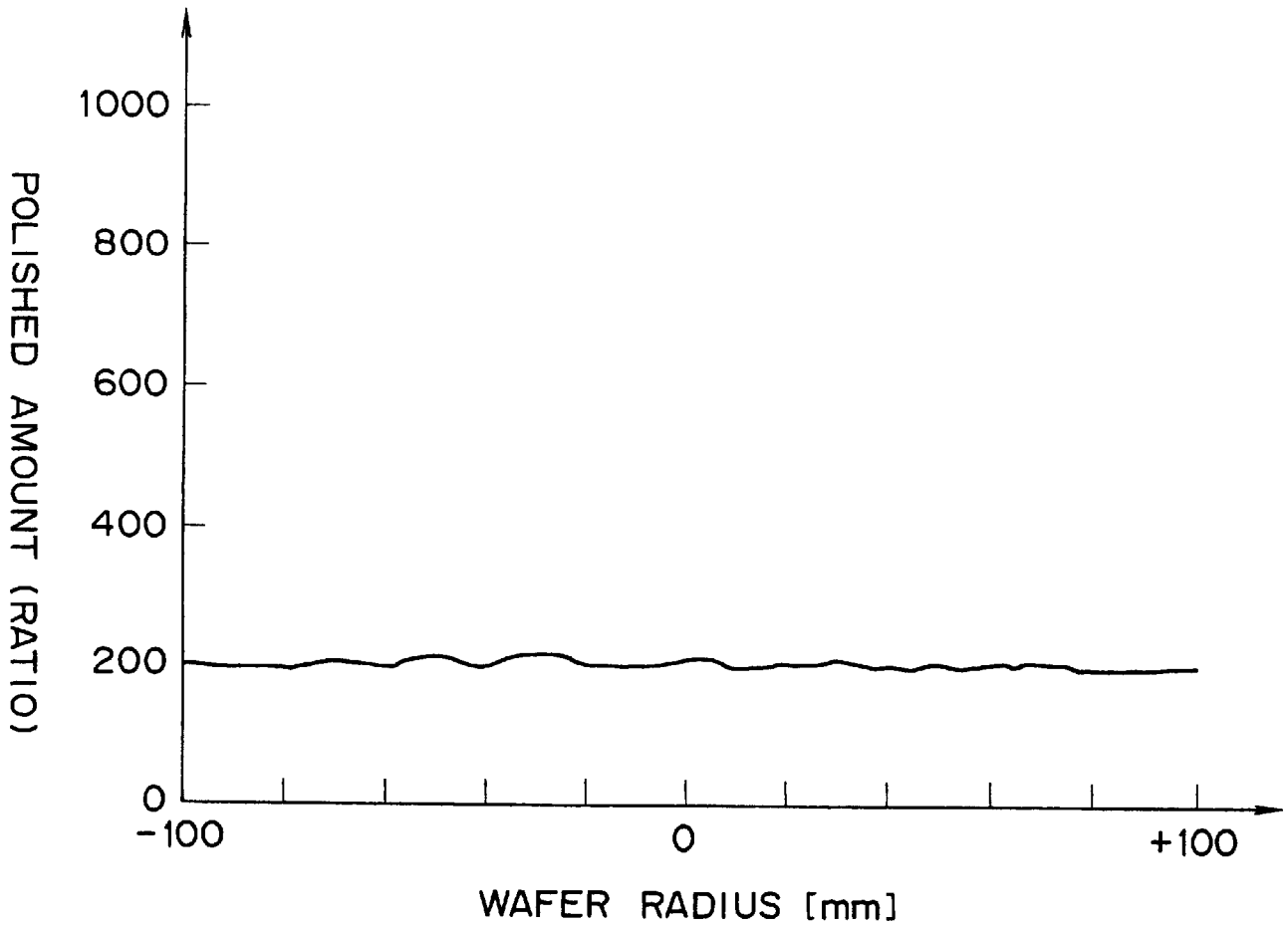
FIG. 41 is a characteristic curve diagram showing a result of correcting a feed velocity of a semiconductor wafer.

FIG. 41 is a characteristic curve diagram showing a result of calculating a distribution of polished amounts based on the condition shown in Table 2. The result shows the significantly improved uniformity in polished amount as compared with the distribution of polished amounts shown in FIGS. 40A and 40B.

Figure 42A:
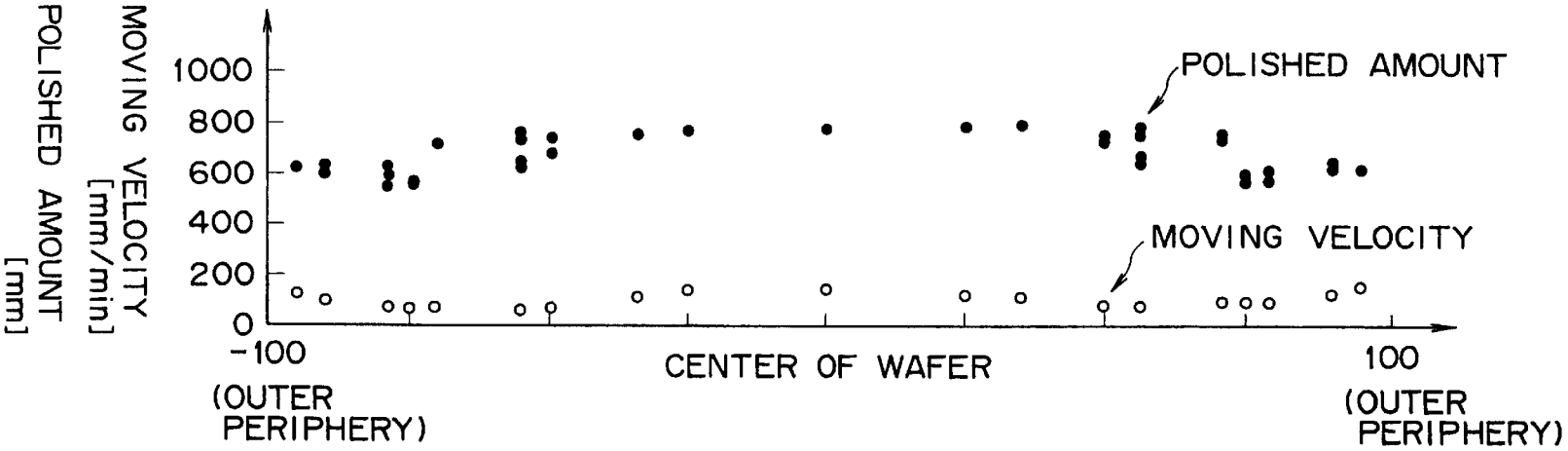
FIGS. 42A and 42B are characteristic curve diagrams illustrating correction of a feed velocity of a semiconductor wafer according to the embodiment.
Figure 42B:
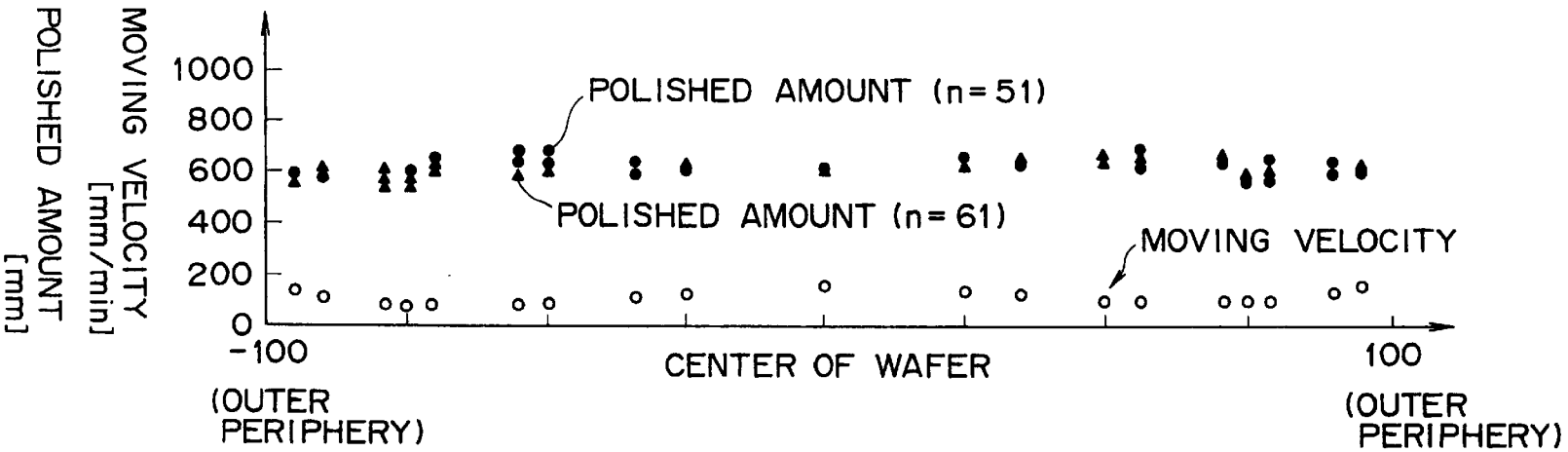

According to the third embodiment, in the actual polishing, as described above, the rotational velocity of the semiconductor wafer W is set at 30 r/min and the rotational velocity of the polishing pad 8 is set at 300 r/min to adjust a region to be polished, and the feed velocity of the X-axis table is suitably selected. FIG. 42A is a characteristic curve diagram showing a variation in polished amount in the case where the X-axis table is moved at a constant velocity. FIG. 42B is a characteristic curve diagram showing a variation in polished amount in the case where the feed velocity of the X-axis table is 20% reduced upon polishing only a portion on the outer peripheral side from the radius of about 50 mm (X-axis position=150 mm or more). From the measured results shown in FIGS. 42A and 42B, the variation in polished amount (expressed by a standard deviation δ) in the case shown in FIG. 42A where the X-axis table is moved at the constant velocity is as high as 11.7%; however, the variation in polished amount in the case shown in FIG. 42B in which the feed velocity is reduced only on the outer peripheral side is as low as 4.3%. In the above measurement, of 100 pieces of semiconductor wafers continuously polished, the 51th wafer (n=51) and the 61th wafer are sampled.

Figure 43:
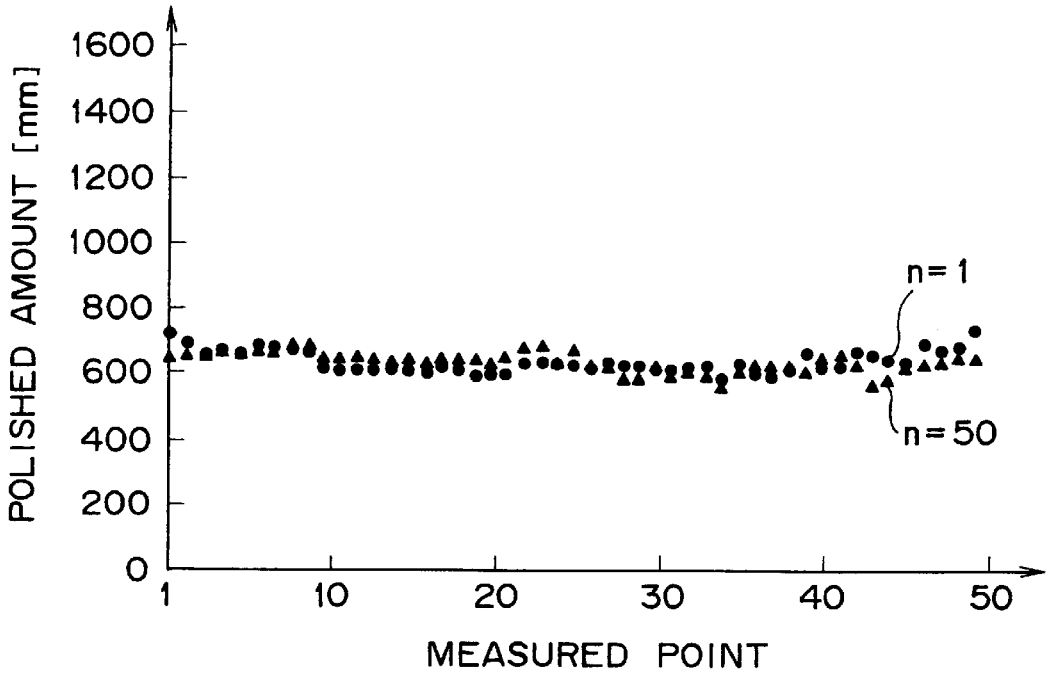
FIG. 43 is a characteristic curve diagram showing a measured result of a polished amount in one semiconductor wafer.
Figure 44:
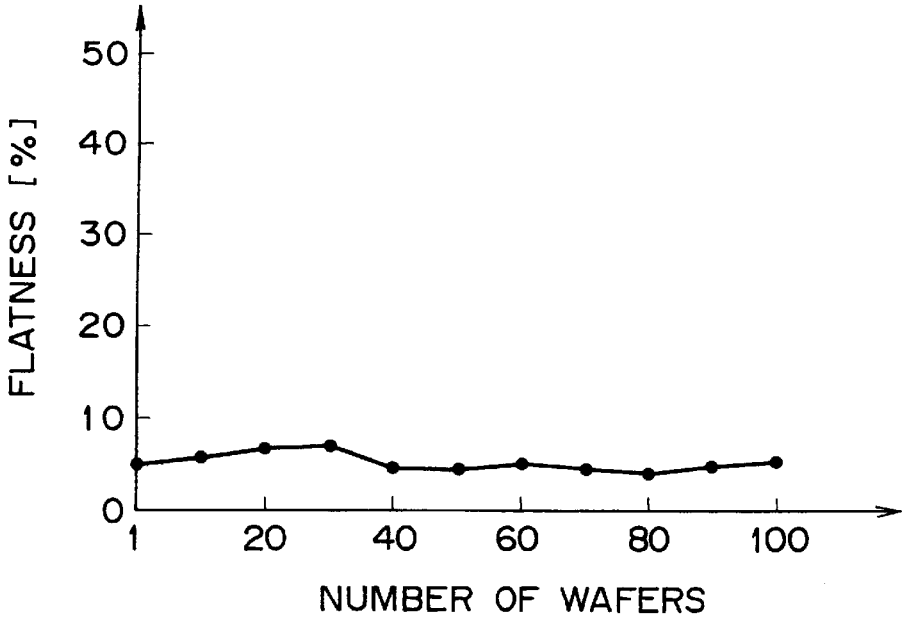
FIG. 44 is a characteristic curve diagram showing a change in flatness in the case where a semiconductor wafer is continuously polished.

FIG. 43 shows a result of measuring a variation in polished amount for a semiconductor wafer having a diameter of 8 inch. In this measurement, of 100 pieces of semiconductor wafers continuously polished, the 1st wafer (n=1) and the 50th wafer (n=50) are sampled, and polished amounts at 49 points spirally arranged on each sample are measured. From this measured result, it is apparent that the surface of the semiconductor wafer can be flattened not depending on locations on the surface of the semiconductor wafer. FIG. 44 shows variations (expressed by standard deviations δ) in flatness, each of which is obtained from polished amounts at 49 points as described above, for 100 pieces of the semiconductor wafers continuously polished. In FIG. 44, the ordinate is normalized based on an average value of the standard deviations. From this measured results, it is apparent that even a large number (for example, 100 pieces) of wafers can be stably polished.

Control of Polishing System

Figure 45:
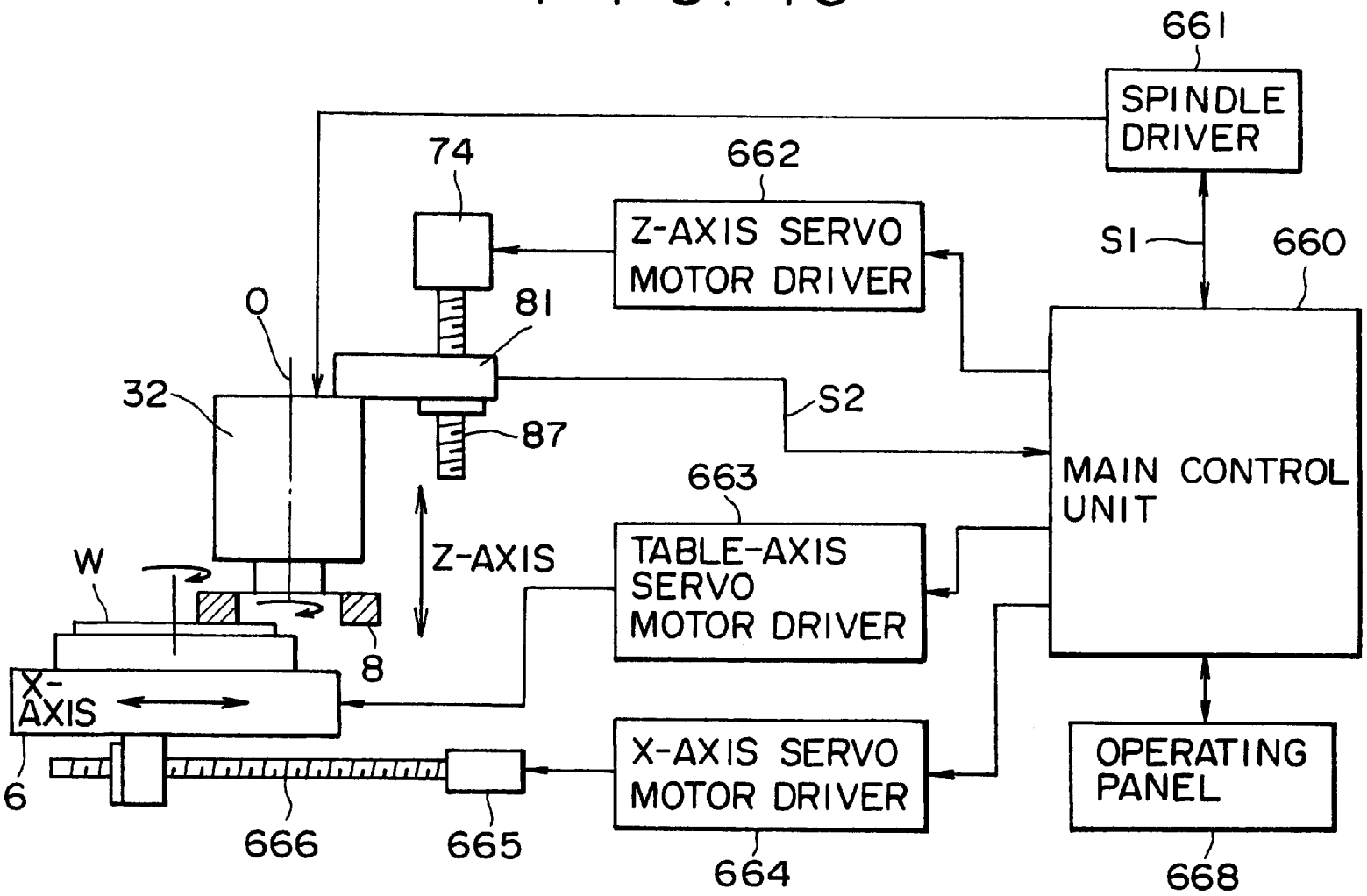
FIG. 45 is a block diagram showing a control system of the polishing system according to the third embodiment.

FIG. 45 is a block diagram showing a control system of the polishing system 30. The control system of the polishing system 30 includes a main control unit 660 composed of a computer and drivers for driving various motors on the basis of control signals outputted from the main control unit 660.

A main shaft driver 661 is adapted to rotate the main spindle 32 on the basis of a control signal outputted from the main control unit 660. At this time, the main shaft driver 661 forms a feedback loop with the main spindle 32 and changes a load current in response to a variation in load of the main spindle 32, to thereby rotate the main spindle 32 at a constant velocity based on the control signal. The main driver 661 also converts the load current into a load voltage to create a load detection signal S1 of the main spindle 32, and outputs the load detection signal S1 into the main control unit 660. Thus, the main driver 661 can detect the variation in load of the main spindle 32 through the main control unit 660.

A Z-axis driver 662 is adapted to rotate the Z-axis servo motor 74 on the basis of a control signal outputted from the main control unit 660, to allow the polishing pad 8 to be moved up and down for pressing the semiconductor wafer W.

A table-axis driver 663 is adapted to rotate the table-axis servo motor 74 disposed on the X-axis table 6 on the basis of a control signal outputted from the main control unit 660 (see FIG. 46), to thereby rotate the semiconductor wafer W at a specific rotational velocity.

An X-axis driver 664 is adapted to rotate an X-axis servo motor 665 on the basis of a control signal outputted from the main control unit 660, to thereby move the X-axis table 6. With respect to the X-axis servo motor 665, a ball screw 666 mounted on a rotational shaft of the X-axis servo motor 665 is screwed in a member mounted on the X-axis table 6, so that the X-axis driver 664 moves the X-axis table 7 by rotating the ball screw 666.

An operating panel 668 is used for operating the polishing system 30 by an operator.

Figure 46:
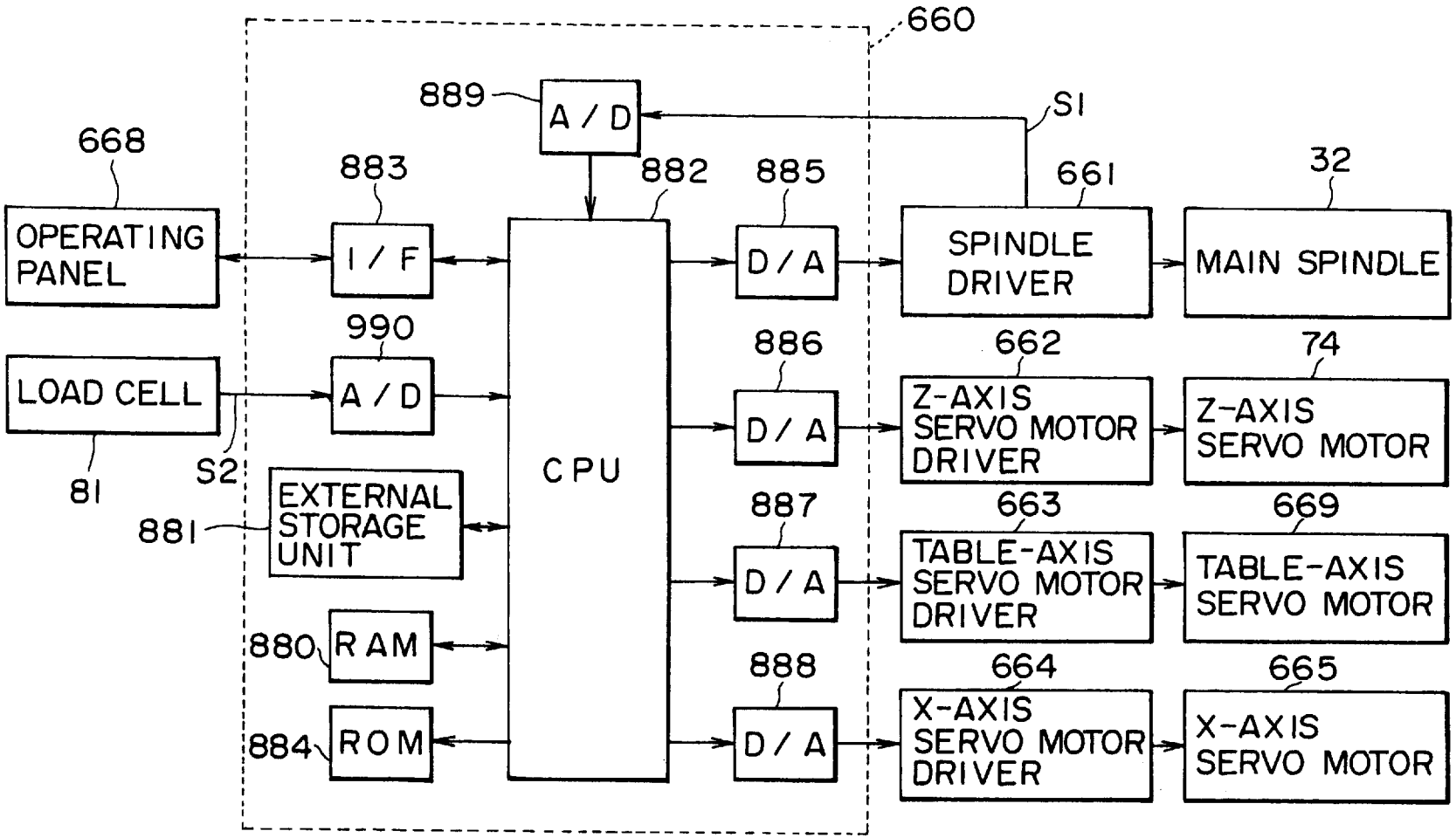
FIG. 46 is a block diagram showing a main control unit shown in FIG. 45 together with a peripheral configuration thereof.

FIG. 46 is a block diagram showing a control system of the polishing system 30 mainly containing the main control unit. The main control unit 660 ensures a work area in a RAM (Random Access Memory) 880, and executes a processing procedure recorded in an external storage unit 881 and an ROM (Read only Memory) 884 using a central processing unit 882, to thereby control operation of the entire polishing system 30.

Specifically, when a wafer cassette 61 is disposed and the operating panel 668 is operated, the central processing unit 882 detects the content inputted in the operating panel 668 by the operator through a specific I/F (Interface) 883, to drive a wafer carrying mechanism. When the semiconductor wafer W is set on the X-axis table 6 by drive of the wafer carrying mechanism, the central processing unit 882 outputs control signals to the drivers 661 to 664 through D/As (Digital/analog Conversion Circuits) 885 to 888 respectively, to drive a working portion.

Upon drive of the working portion, the central processing unit 882 moves the semiconductor wafer W to a specific position by drive of the X-axis table 6, and then rotates the semiconductor wafer W and also rotates the polishing pad 8. Further, the central processing unit 882 allows the polishing pad 8 to be pressed on the semiconductor wafer W and also allows the semiconductor wafer W to be reciprocated, to thereby polish a specific amount of the semiconductor wafer W. After polishing, the central processing unit 882 allows the polishing pad 8 to be escaped for ejecting the semiconductor wafer W.

During polishing, the central processing unit 882 monitors a variation in load of the main spindle 32 and a pressing force detection result S2 obtained by the load cells 81 through A/Ds (Analog/digital Conversion Circuits) 889 and 990, to thereby drive the main spindle 32 and the like under a constant condition.

Figure 47:
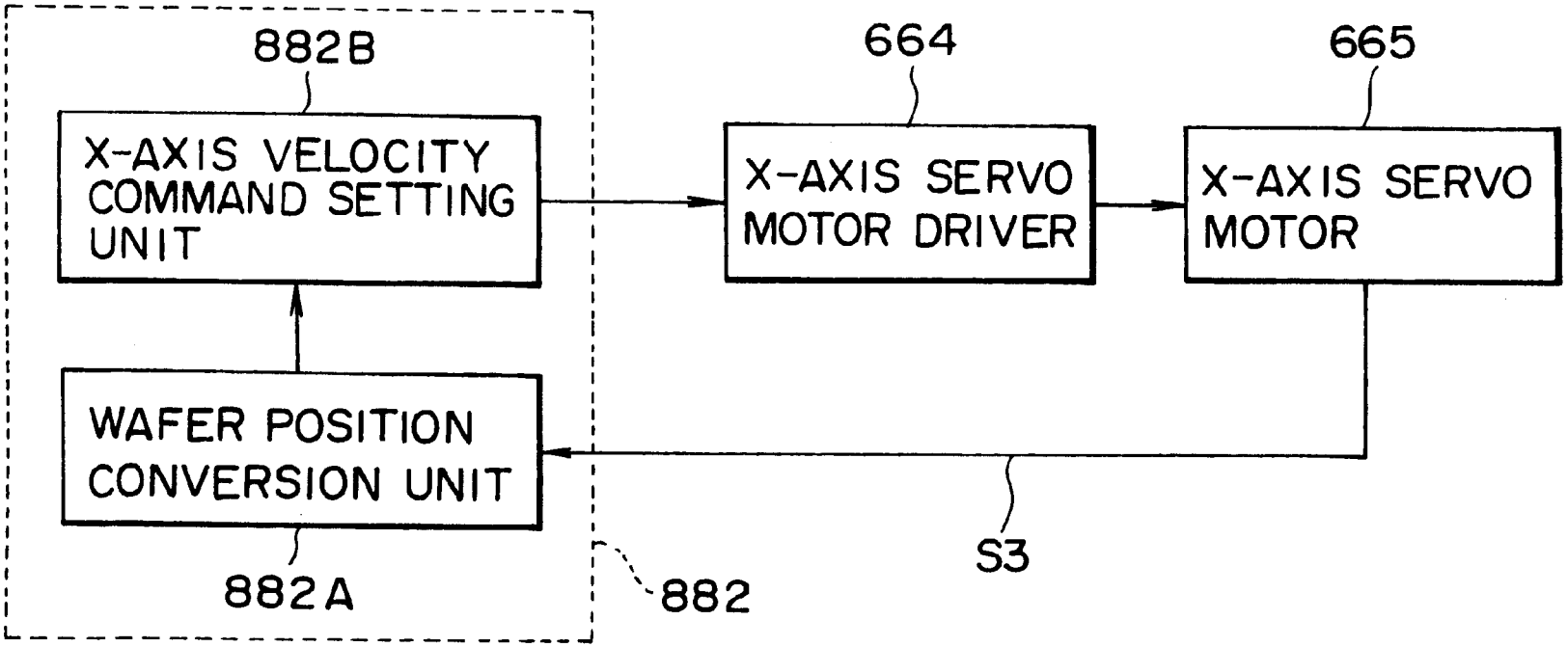
FIG. 47 is a function block diagram showing a central processing unit together with a peripheral configuration with respect to feed control of the semiconductor wafer.

FIG. 47 is a block diagram showing a function of the central processing unit 882 for controlling a feed velocity of the X-axis table 6. The central processing unit 882 receives a position detecting signal S3 of the X-axis table 6 from a peripheral configuration of the X-axis servo motor 665, converting the position detecting signal S3 into position detecting data by an analog/digital conversion circuit (not shown), and inputs the data into a wafer position conversion unit 882A. The wafer position conversion unit 882A of the central processing unit 882 detects a position of the semiconductor wafer W relative to the polishing pad 8 on the basis of the position detecting data. Further, an X-axis velocity command setting unit 882B of the central processing unit 882 creates velocity control data corresponding to the positional detection result detected by the wafer position conversion unit 882A, and outputs a control signal based on the velocity control data into the X-axis driver 664. In addition, the velocity control data are previously set through the operating panel 668.

In this way, as described with reference to FIGS. 42A and 42B, the central processing unit 882 controls the movement velocity of the X-axis table 6.

Figure 48:
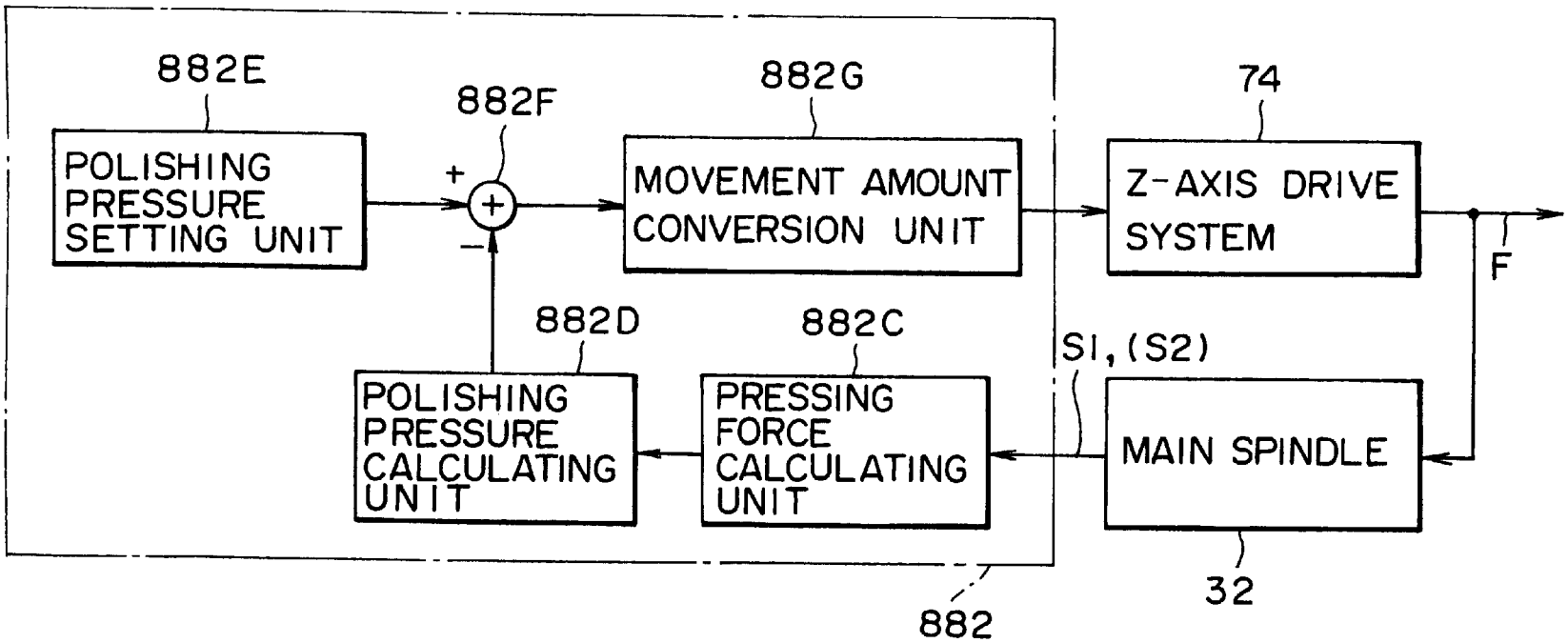
FIG. 48 is a function block diagram showing a central processing u nit together with a peripheral configuration with respect to control of a pressing force.

FIG. 48 is a block diagram showing a function of the central processing unit 882 for controlling a pressing force F of the polishing pad 8. The central processing unit 882 executes a series of control for the pressing force F of the polishing pad 8 by operation of an operator on the basis of a load detection signal S1 obtained through the main driver 661 (see FIG. 45) or on the basis of a detection result S2 obtained from the load cells 81.

Specifically, the central processing unit 882 calculates the pressing force F of the polishing pad 8 at a pressing force calculating unit 882C on the basis of the load detection signal S1 or detection result S2. Further, the central processing unit 882 divides, at a polishing pressure calculating unit 882D, the pressing force F calculated at the pressing force calculating unit 882C by an area of a region to be polished, to obtain a pressing force per unit area of the polishing pad 8.

The central processing unit 882 receives the predetermined pressing force data from a polishing pressure setting unit 882E and detects, at a subtracting unit 882F, an error value between the predetermined pressing force and the pressing force calculated at the polishing pressure calculating unit 882D. A movement amount conversion unit 882G outputs control data for driving the Z-axis servo motor 74 in such a manner that the above error value is converged at zero. Thus, the central processing unit 882 allows the polishing pad 8 to be pressed on the semiconductor wafer W at a constant pressing force per unit area, whereby the semiconductor wafer W is polished.

With this configuration, in the polishing system 30 (see FIG. 1), an unpolished semiconductor wafer W is contained in a wafer cassette 61 which is in turn disposed on a load buffer 63 side, and an empty wafer cassette 67 is disposed on an unload buffer 65 side.

When an operator operates, in such a state, the operating panel to start operation of the polishing system 30, the semiconductor wafer W is set from the wafer cassette 61 on the load buffer 63, being carried to the working portion by the wafer carrying mechanism, and is polished. When the semiconductor wafer W is carried to the working portion, the next semiconductor wafer W is set from the wafer cassette 61 on the load buffer 63. After completion of polishing, the semiconductor wafer W is carried from the working portion to the unload buffer 65 and the next semiconductor wafer is carried to the working portion.

In the polishing system 30, at the step of sequentially polishing the semiconductor wafers W contained in the wafer cassette 61 at the working portion, the X-axis table 6 stands by under an opening portion 90. When the semiconductor wafer W is placed on the X-axis table 6, the X-axis table 6 is moved to carry the semiconductor wafer W to a polishing position. At this time, the X-axis table 6 starts rotation of the semiconductor wafer W, and also reciprocates together with the semiconductor wafer W at the polishing position.

The polishing pad 8 stands by over the polishing position, and when the semiconductor wafer W is moved to the polishing position, the polishing pad 8 is rotated and is then lowered by drive of the Z-axis servo motor to be pressed on the surface of the semiconductor wafer W. In this way, the rotating polishing pad 8 is brought in contact with the surface of the semiconductor wafer W, to form a region to be polished. Thus, at the region to be polished, fine projecting portions on the semiconductor wafer W are polished by rotation of the polishing pad 8.

In the polishing system 30, the polishing pad 8 is rotated at a high velocity of 300 r/min so that a frequency generated by projecting portions of the semiconductor wafer W becomes higher than a basic resonance frequency of a mechanical transmission function between the polishing pad 8 and the semiconductor wafer W (see FIGS. 19 to 21B). In this case, since the polishing pad 8 is formed into a ring shape, the relation of the frequency generated by projecting portions of the semiconductor wafer W is kept in entire region to be polished. Thus, the polishing pad 8 presses a fine projecting portion against a pressing force generated by the projecting portion, to thereby positively polish the projecting portion.

The region to be polished is gradually displaced on the semiconductor wafer W by rotation and reciprocating motion of the semiconductor wafer W, to perform the positive polishing for projecting portions over the entire surface of the semiconductor wafer W. At this time, the rotational velocity of the semiconductor wafer W is set such that a frequency generated by waviness of the surface of the semiconductor wafer W is sufficiently lower than the basic resonance frequency of the mechanical transmission function between the polishing pad 8 and the semiconductor wafer W. Accordingly, the polishing pad 8 is elastically deformed along the waviness of the surface of the semiconductor wafer W, to thus uniformly polish the surface of the semiconductor wafer W.

In this way, the polishing system 30 is allowed to flatten fine irregularities while keeping a large waviness formed on the surface of the semiconductor wafer W (see FIG. 26).

In this polishing system 30, a slurry containing free abrasive grains having an average grain size in a range of ⅙ to ⅓ of that of fixed abrasive grains contained in the polishing pad 8 is supplied on the surface of the semiconductor wafer W. The region to be polished is lubricated with the slurry, to effectively polish the surface of the semiconductor wafer W by means of the free abrasive grains combined with the fixed abrasive grains.

At this time, fixed abrasive grains having fallen from the polishing pad 8 and polished waste from the semiconductor wafer W are escaped in pores formed in the polishing pad 8, to thereby effectively polish the surface of the semiconductor wafer W. The free abrasive grains also prevent clogging of the pores. As a result, it is possible to continuously polish several hundreds of semiconductor wafers with the initial polishing ability kept.

The polishing system 30 is configured that the rotational center axis O of the main spindle 32 for rotating the polishing pad 8 can be tilted a micro-angle by adjustment of the taper rings 50 and 51. When the rotational center axis O is tilted, the polishing pad 8 is correspondingly tilted with respect to the semiconductor wafer W and is brought in contact therewith. The polishing surface of the polishing pad 8 is obliquely cut in matching with the tilting of the rotational center axis O by a facing tool. An area of the region to be polished at which the polishing pad 8 is in contact with the semiconductor wafer W is changed depending on the tilting of the rotational center axis O of the main spindle 32 (see FIGS. 29 to 33C).

In this polishing system 30, the area of the region to be polished can be variously changed by suitably selecting the tilting of the rotational center axis O of the main spindle 32.

Further, in this polishing system 30, the polishing pad 8 is rotated by the main spindle 32 in a state in which a pressing force of the polishing pad 8 applied to the semiconductor wafer W is monitored on the basis of a detection result obtained by the load cells 18 or data of variation in load of the main spindle 32 and also a pressing force per unit area is kept at a specific setting value by control of the Z-axis servo motor. At this time, the semiconductor wafer W is reciprocated offset (on the left side, see FIGS. 34A to 37D) from the rotational center axis of the polishing pad 8 by the X-axis table in a state being rotated at a specific velocity.

In this polishing system 30, the dead weight 54 is disposed on the left side from the main spindle 32 to correct the offset of the pressing force caused by the offset reciprocating motion (see FIGS. 34A to 37D).

The feed velocity of the X-axis table thus reciprocated is controlled depending on the position of the region to be polished, to equalize the polished amount over the entire semiconductor wafer W, thereby flattening the polished surface of the semiconductor wafer W.

According to the third embodiment, the ring-shaped polishing pad 8 is pressed on the semiconductor wafer W to form a region to be polished. At this region to be polished, fine projecting portions on the surface of the semiconductor wafer W can be polished by rotating the polishing pad such that a frequency caused by the fine projecting portions is more than the basic resonance frequency of the mechanical transmission function between the polishing pad 8 and the semiconductor wafer W, thereby pressing the projecting portions in such a manner that the projecting portions are displaced in the direction reversed to the displacement direction due to the fine projecting portions. The surface of the semiconductor wafer W is thus flattened. Further, the surface of the semiconductor wafer W can be polished along a waviness of the surface of the semiconductor wafer W by displacing the region to be polished such that a frequency caused by the waviness of the surface of the semiconductor wafer W is sufficiently lower than the basic resonance frequency. In this way, the surface of the semiconductor wafer can be polished with a high accuracy.

At this time, the semiconductor wafer W can be effectively polished by use of fixed abrasive grains contained in the polishing pad in combination with free abrasive grains contained in a slurry, and by selecting an average grain size of the free abrasive grains in a range of ⅙ to ⅓ of that of the fixed abrasive grains.

Further, by forming pores in the polishing pad, it is possible to effectively avoid lowering of the polishing ability due to fixed abrasive grains having fallen from the polishing pad.

The entire semiconductor wafer W can be uniformly polished by rotating the polishing pad 8 and the semiconductor wafer W at specific velocities in a state in which a pressing force per unit area is kept constant, reciprocating the semiconductor wafer W, and changing the feed velocity of the reciprocating motion of the semiconductor wafer W thereby changing a displacement velocity of the region to be polished depending on the position of the region to be polished.

Since the polishing pad 8 is obliquely pressed on the semiconductor wafer W, the surface of the semiconductor wafer W can be polished under an optimum condition by suitably selecting an area of the region to be polished as needed.

Further, by disposing a dead weight on the left side (FIGS. 34A to 37D) from the main spindle 32, the offset of the pressing force due to the reciprocating motion of the semiconductor wafer offset from the polishing pad can be corrected, to thereby uniformly polishing the surface of the semiconductor wafer W.

In the third embodiment, the displacement velocity of the region to be polished is controlled depending on a position of the region to be polished by control of the feed velocity of the X-axis table; however, the present invention is not limited thereto. For example, the displacement velocity of the region to be polished is controlled depending on the position of the region to be polished by control of a rotational velocity of the semiconductor wafer W. to thereby equalize the polished amount at positions over the entire surface of the semiconductor wafer.

The polished amount at each position of the semiconductor wafer can be equalized by control a pressing force of the polishing pad, or rotational velocity of the polishing pad, in place of the displacement velocity of the region to be polished, or by combination of the above controls.

Figure 49:
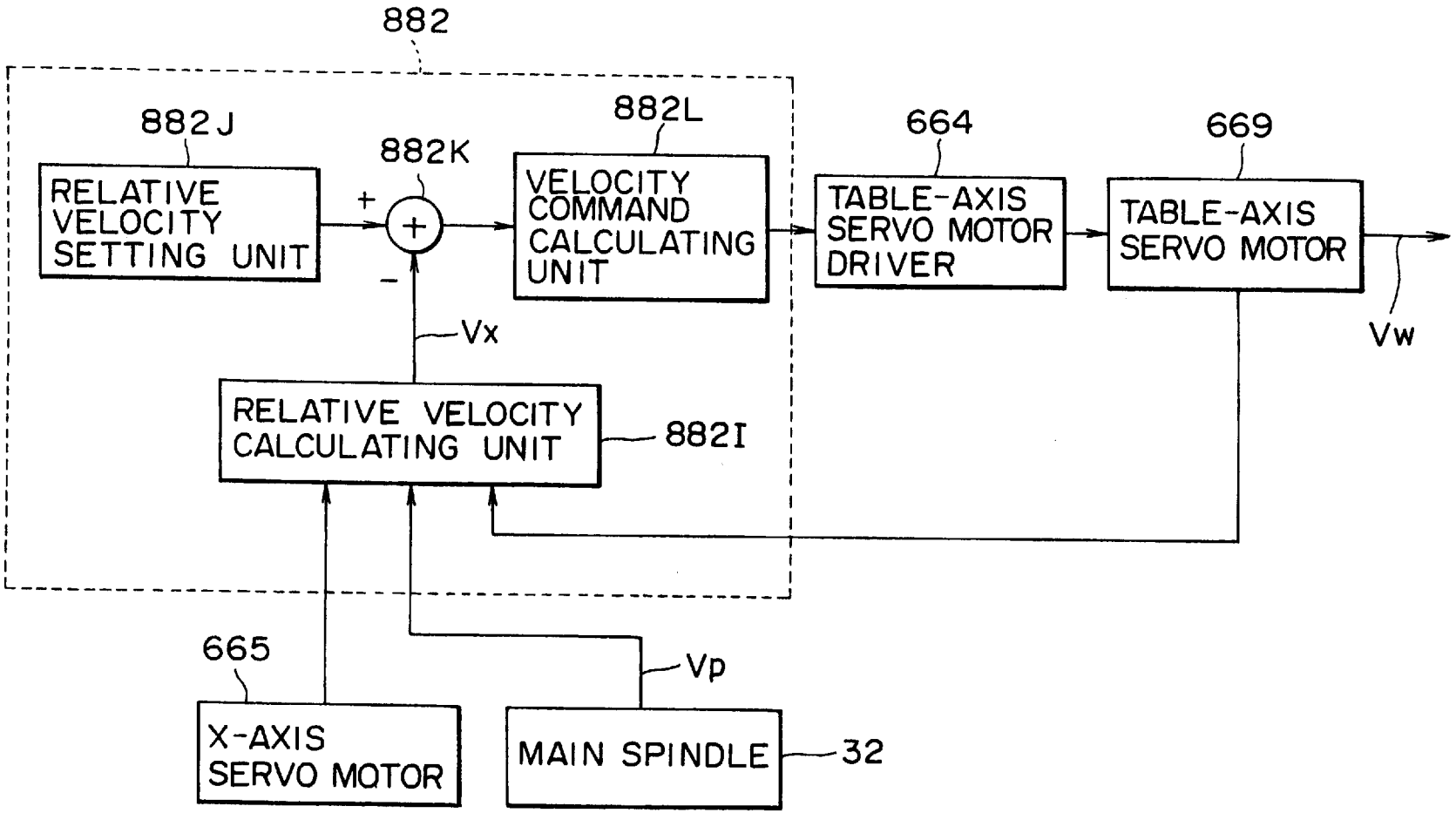
FIG. 49 is a function block diagram showing a control system for controlling a rotational velocity of a semiconductor wafer together with another peripheral configuration in a central processing unit of a polishing system according to a further embodiment.

FIG. 49 is a function block diagram showing a configuration of a central processing unit in the case of controlling a rotational velocity of the semiconductor wafer W. In the configuration shown in FIG. 49, the rotational velocity of the semiconductor wafer W is controlled on the basis of a relative velocity between the semiconductor wafer W and the polishing pad 8 at the region to be polished.

The central processing unit 882 detects, at a relative velocity calculating unit 882I, a position of a region to be polished on the basis of each rotational center axis of the semiconductor wafer W and the polishing pad 8 from the rotated amount of the X-axis servo motor 665.

The relative velocity calculating unit 882I calculates a linear velocity of the semiconductor wafer W at the region to be polished on the basis of the position of the region to be polished thus calculated and the rotational velocity of the table-axis servo motor 669. The relative velocity calculating unit 882I similarly calculates a linear velocity of the polishing pad 8 at the region to be polished on the basis of the position of the region to be polished thus calculated and the rotational velocity of the main spindle 32. Then, a relative velocity is obtained by addition of the two linear velocities thus calculated.

The central processing unit 882 calculates, at a subtracting unit 882K, an error value between the relative velocity held in a relative velocity setting unit 882J and the calculated relative velocity and creates, at a velocity command calculating unit 882L, control data such that the error value becomes zero. This allows not only equalization of the polished amount but also reduction in damages of the semiconductor wafer.

To be more specific, in the case where the relative velocity thus calculated is large, as compared with the case where the relative velocity is small, fine projecting portions are smoothly polished and a polishing rate over the entire surface of the semiconductor wafer is increased; however, a residual stress and an internal strain remaining in the polished surface of the semiconductor wafer becomes larger with an increase in relative velocity. Accordingly, by setting the relative velocity on the basis of the control reference and controlling the rotational velocity of the semiconductor wafer, it is possible to execute polishing with less damage.

In the above embodiment, a polishing rate depending on a position of a region to be polished is adjusted by control of a feed velocity of the X-axis table; however, the present invention is not limited thereto. For example, polished amounts at respective portions on a semiconductor wafer may be equalized by detecting a load of the polishing pad on the basis of an output voltage of the load cells or a load current of the main spindle and controlling a polishing rate on the basis of such a load.

Figure 50:
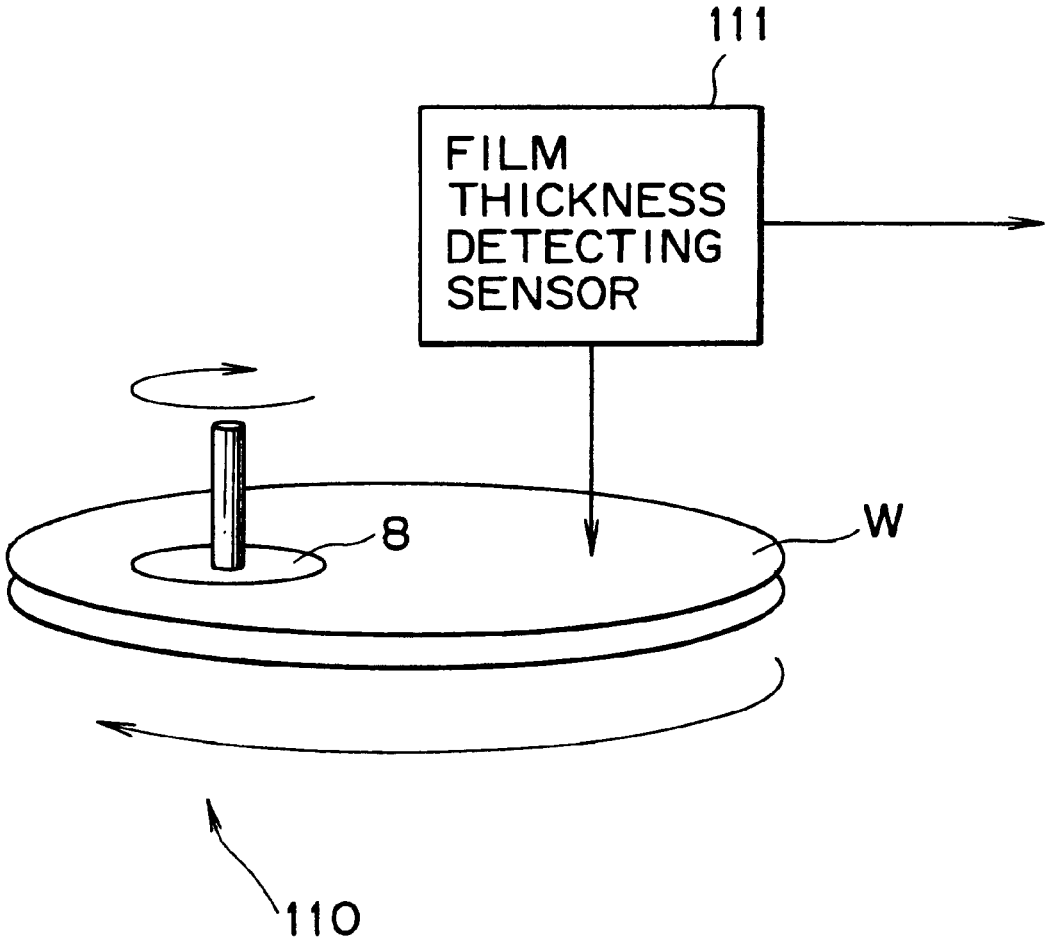
FIG. 50 is a perspective view showing a basic configuration of a polishing system according a further embodiment.

Although in the above embodiment a polishing rate is controlled in accordance with the pre-determined setting, the present invention is not limited thereto. For example, as in a polishing system 110 shown in FIG. 50, a polishing rate may be set by a method of measuring a film thickness by a film thickness sensor 111, setting a polishing target in real time on the basis of the measured result, and setting a polishing rate in accordance with the polishing target.

Although in the above embodiment a polishing rate is controlled on the basis of a load of the main spindle 32, the present invention is not limited thereto. For example, clogging of the polishing pad 8, excess and deficiency of a slurry, damage of the semiconductor wafer W, and the like may be detected by monitoring the load of the main spindle 32.

In the above embodiment a pressing force of the polishing pad 8 is detected on the basis of a load of the main spindle 32 or the measured result from the load cells; however, the present invention is not limited thereto. For example, in the case of the polishing system of a type in which the polishing pad 8 is pressed on a semiconductor wafer by an air cylinder, a pressing force may be directly detected on the basis of a cylinder pressure. Further, a pressing force may be detected on the basis of a drive torque of the Z-axis servo motor.

Although in the above embodiment a semiconductor wafer is reciprocated in such a manner as to be offset from the polishing pad, the present invention is not limited thereto. For example, a semiconductor wafer may be reciprocated with a stroke twice that in the above embodiment in such a manner as to be symmetric with respect to the polishing pad. In this case, it is possible to eliminate the need of arrangement of the dead weight.

Although in the above embodiment the dead weight is arranged at a fixed one point, the present invention is not limited thereto. For example, a position of the dead weight may be displaced along with reciprocating motion of a semiconductor wafer, to thereby usually keep a uniform pressing force per unit area.

In the above embodiment, description has been made by example of polishing a semiconductor wafer at a step of fabricating integrated circuits; however, the present invention is not limited thereto but may be applied to various applications including polishing of a lens or the like at a step of producing optical parts.

What is claimed is:

1. A polishing system comprising:

a holding means having a holding surface for holding an object to be polished;

a polishing pad having a polishing surface for polishing a surface to be polished of said object to be polished;

a rotating means for rotatably holding said polishing pad, relatively pressing the polishing surface of said polishing pad on the surface to be polished of said object to be polished to create a polishing pressure, and rotating said polishing pad;

a moving means for relatively moving, along a plane, the surface to be polished of said object to be polished and the polishing surface of said polishing pad in sliding-contact with each other;

a pressing force detecting means for detecting a relative pressing force applied from the polishing surface of said polishing pad to the surface to be polished of said object to be polished by said rotating means; and a pressure control means for outputting a control signal to said rotating means on the basis of a detection signal supplied from said pressing force detecting means so that the polishing pressure generated at said object to be polished becomes a specific value.

2. A polishing system according to claim 1, wherein said rotating means comprises:

a main shaft for rotatably holding said polishing pad facing to said object to be polished;

a main spindle for rotating said main shaft;

a slider for holding said main spindle;

a guide for holding said slider movably in the direction of an axial line of said main shaft;

a sub-slider provided movably along the direction of the axial line of said main shaft;

a driving means for moving said sub-slider along the direction of said main shaft; and a connecting member for connecting said slider to said sub-slider.

3. A polishing system according to claim 2, wherein said pressing force detecting means detects a force between the sub-slider and slider, said force being applied to said connecting member in the direction of the axial line of said main shaft.

4. A polishing system according to claim 3, wherein said pressing force detecting means is a load cell which connects said slider to said sub-slider and detects a force applied from said sub-slider to said slider in the direction of the axial line of said main shaft.

5. A polishing system according to claim 2, wherein the axial line of said main shaft, said guide, and operational points between said connecting member and said slider are positioned within a plane perpendicular to the holding surface.

6. A polishing system according to claim 2, wherein said connecting member is provided on said slider at each of two positions symmetric with respect to the axial line of said main shaft.

7. A polishing system according to claim 1, wherein said pressure control means calculates a polishing pressure generated on the surface to be polished of said object to be polished on the basis of both a detection signal detected by said pressing force detecting means and a slide-contact area between said object to be polished and the polishing surface of said polishing pad; compares the polishing pressure thus calculated with a setting pressure previously set; and outputs a control signal to said rotating means in such manner that said polishing pressure becomes the setting pressure on the basis of the comparison result.

8. A polishing system according to claim 7, wherein said pressure control means calculates the slide-contact area on the basis of a relative-positional relationship between the polishing surface of said polishing pad and the surface to be polished of said object to be polished.

9. A polishing system according to claim 1, wherein said polishing pad is formed into a ring-shape whose rotational center is the axis of said main shaft, and has a polishing surface perpendicular to the axial line of said main shaft.

10. A polishing system according to claim 1, which includes means for tilting a rotation of axis of the polishing pad at a specific angle relative to a perpendicular of said holding surface.

11. A polishing system according to claim 10, wherein the polishing surface of said polishing pad, which is in slide-contact with the surface to be polished of said object to be polished is tilted at the specific angle with respect to a plane perpendicular to the rotational axis of said polishing pad.

12. A polishing system according to claim 10, wherein said rotating means is configured so that the tilting angle of the rotational axis of said polishing pad with respect to the holding surface of said holding means is freely adjustable.

13. A polishing system according to claim 10, further comprising:

a pressure adjusting means for adjusting a working pressure applied from the polishing surface of said polishing pad to the surface to be polished of said object to be polished.

14. A polishing system according to claim 10, further comprising:

a polishing solution supply means for supplying a polishing solution allowing chemical-mechanical polishing, which is disposed between said polishing pad and said object to be polished.

15. A polishing system according to claim 10, wherein the polishing surface of said polishing pad is formed into a ring-shape.

16. A method of polishing a surface to be polished of an object to be polished by relatively moving, along a plane, a polishing surface of a rotating polishing pad and the surface to be polished of the object to be polished in slide-contact with each other, said method comprising the step of:

adjusting a pressing force applied from the polishing pad to the object to be polished to form a polishing pressure on the basis of a relative-positional relationship between the polishing surface of the polishing pad and the surface to be polished of the object to be polished, thereby polishing the surface to be polished of the object to be polished.

17. A polishing method according to claim 16, further comprising the steps of performing, prior to actual polishing, simulation of polishing a surface to be polished of an object to be polished by relatively moving, along a plane, a polishing surface of a rotating polishing pad and the surface to be polished of the object to be polished in slide-contact with each other; and calculating a polishing pressure allowing to improve uniformity of a surface to be polished of an object to be polished upon actual polishing in accordance with the relative-positional relationship between the polishing surface of the polishing pad and the surface to be polished of the object to be polished.

18. A polishing method according to claim 16, further comprising the step of:

specifying a relative movement velocity upon relative movement of the polishing surface of the polishing pad and the surface to be polished of the object to be polished.

19. A method according to claim 16, which includes tilting a rotational axis of said polishing pad at a specific angle to an axis extending perpendicular to the surface to be polished.

20. A polishing method according to claim 19, further comprising the steps of:

finishing, prior to polishing the object to be polished, the polishing surface of the polishing pad by facing-machining such that the polishing surface is tilted at a specific angle with respect to a plane perpendicular to the rotational axis of the polishing pad; and polishing the surface to be polished of the object to be polished using the polishing surface thus finished by facing-machining.

21. A polishing method according to claim 20, wherein facing-machining for the polishing surface of the polishing pad is performed by bringing the polishing surface of the polishing pad, said polishing pad being rotated in a state in which the rotational axis thereof is tilted at a specific angle with respect to an axis perpendicular to the surface to be polished of the object to be polished, with a facing tool for finishing the polishing surface; and relatively moving the polishing pad in the direction along the surface to be polished of the object to be polished, thereby forming a polishing surface tiled at the specific angle.

22. A polishing method according to claim 19 wherein a slide-contact area between the surface to be polished of the object to be polished and the polishing surface is adjusted by adjusting the tilting angle of the rotational axis of the polishing pad with respect to the surface to be polished of the object to be polished.

23. A polishing method according to claim 19, wherein a slide-contact area between the surface to be polished of the object to be polished and the polishing surface is adjusted by adjusting a working pressure applied from the polishing surface of the polishing pad to the surface to be polished of the object to be polished.

24. A polishing method according to claim 19, wherein the polishing surface of the polishing pad is formed into a ring-shape, and the polishing surface is tilted at a specific angle with respect to a plane perpendicular to the rotational axis of the polishing pad; and the tilted polishing surface of the polishing pad is brought tangentially in slide-contact with the surface to be polished of the object to be polished, to thereby polish said polishing surface.

25. A polishing method according to claim 19, wherein polishing is performed while supplying a polishing solution allowing chemical-mechanical polishing between the polishing pad and the object to be polished.

* * * * *